US005210012A

United States Patent [19]

Ono et al.

[11] Patent Number: 5,210,012

[45] Date of Patent: May 11, 1993

[54] SILVER HALIDE COLOR PHOTOGRAPHIC MATERIAL

[75] Inventors: Michio Ono; Kouichi Hanaki; Kei Sakanoue; Shigeo Hirano; Mitsuru Yamamoto, all of Kanagawa, Japan

[73] Assignee: Fuji Photo Film Co., Ltd., Kanagawa, Japan

[21] Appl. No.: 648,894

[22] Filed: Jan. 31, 1991

[30] Foreign Application Priority Data

| | | | |
|---|---|---|---|
| Jan. 31, 1990 | [JP] | Japan | 2-21127 |
| Jan. 31, 1990 | [JP] | Japan | 2-21128 |
| Jan. 31, 1990 | [JP] | Japan | 2-21129 |
| May 10, 1990 | [JP] | Japan | 2-120822 |

[51] Int. Cl.[5] ..... G03C 7/20; G03C 7/26; G03C 7/32; G03C 1/42

[52] U.S. Cl. ..... 430/566; 430/219; 430/223; 430/544; 430/957; 430/955

[58] Field of Search ..... 430/219, 223, 544, 957, 430/959, 955, 566

[56] References Cited

U.S. PATENT DOCUMENTS

| | | | |
|---|---|---|---|
| 4,310,621 | 1/1982 | Odenwalder et al. | 430/544 |
| 4,345,024 | 8/1982 | Hirano et al. | 430/544 |
| 4,636,456 | 1/1987 | Takahashi et al. | 430/957 |
| 4,740,453 | 4/1988 | Nakamura et al. | 430/957 |
| 4,770,982 | 9/1988 | Tchijima et al. | 430/223 |
| 4,791,049 | 12/1988 | Kojima et al. | 430/544 |

FOREIGN PATENT DOCUMENTS

| | | |
|---|---|---|
| 0167168 | 1/1986 | European Pat. Off. . |
| 62-103639 | 5/1987 | Japan . |
| 64-546 | 1/1989 | Japan . |

*Primary Examiner*—Richard L. Schilling
*Attorney, Agent, or Firm*—Birch, Stewart, Kolasch & Birch

[57] ABSTRACT

A silver halide color photographic material is provided comprising on a support at least one silver halide emulsion layer containing at least one of the compounds represented by formulae (I) to (III):

(I)

wherein $R_{11}$ represents in which $R_{13}$ represents an alkyl, aryl or heterocyclic group, and $R_{14}$ and $R_{15}$ each represents hydrogen, alkyl group or aryl group; $R_{12}$ represents a substituent having a Hammett's substituent constant $\sigma p$ of 0.3 or less; n represents an integer 0 to 2, and when n is 2, the two $R_{12}$'s may be the same or different; B represents a group which releases PUG after being separated from a hydroquinone nucleus; PUG represents a development inhibitor; l represents an integer; and A and A' each represents hydrogen or a group capable of being removed by an alkali; $R_{11}$ and $R_{12}$, $R_{11}$ and A or A', $R_{12}$ and A or A', and two $R_{12}$'s may together form a ring;

(II)

wherein $Q^1$ represents an atomic group containing at least one hetero atom and is required for the formation of a heterocylic group containing 5 or more members together with carbon atoms connected thereto; $R^{21}$ represents a group capable of substituting on the hydroquinone nucleus; and B, PUG, l, A and A' are as defined above;

(III)

wherein $R_{31}$ represents an alkyl group containing two or more carbon atoms in which the carbon atom adjacent to the carbonyl group is not substituted by a hetero atom, a cycloalkyl group, an aryl group or a heterocyclic group; $R_{32}$ and $R_{33}$ each represents hydrogen or a substituent having a Hammett's substituent constant $\sigma p$ of 0.3 or less; and B, PUG, l, A and A' are as defined above.

7 Claims, No Drawings

SILVER HALIDE COLOR PHOTOGRAPHIC MATERIAL

FIELD OF THE INVENTION

The present invention relates to a silver halide color photographic material which provides improvements in interimage effect, sharpness and inhibition of fogging during preservation of raw products.

BACKGROUND OF THE INVENTION

It has been known that silver halide color photographic materials undergo color development in which the resulting oxidation product of an aromatic primary amine color developing agent reacts with a coupler to produce indophenol, indoaniline, indamine, azomethine, phenoxazine, phenazine, and analogous dyes, forming color images. In this process, a subtractive color process is normally employed to effect color reproduction. Silver halide emulsions which are selectively sensitive to blue, green and red light, and agents for the formation of color images complementary to these colors, i.e., yellow, magenta and cyan are used in the subtractive color process. In order to form a yellow color image, acylacetanilide or dibenzoylmethane couplers are used. In order to form a magenta color image, pyrazolone, pyrazolobenzimidazole, pyrazolopyrazole, pyrazolotriazole, cyanoacetophenone or indazolone couplers are mainly used. In order to form a cyan color image, phenol or naphthol couplers are mainly used.

However, dyes thus produced from these couplers do not exhibit an ideal absorption spectrum. In particular, magenta and cyan dyes thus produced exhibit a broad absorption spectrum or subsidiary absorption in a short wavelength range. This is not desirable with respect to color reproduction in color photographic light-sensitive materials.

In particular, such a subsidiary absorption in a short wavelength range. tends to cause a drop in saturation. This disadvantage can be somewhat reduced by developing an interimage effect.

Examples of approaches for improving this interimage effect include the use of DIR hydroquinones as disclosed in U.S. Pat. Nos. 3,379,529, 3,620,746, 4,377,634, and 4,332,878, and JP-A-49-129536 (the term "JP-A" as used herein means an "unexamined published Japanese patent application").

These DIR hydroquinones undergo oxidation during development to release a development inhibitor. However, when the rate of oxidation of these hydroquinones during development is raised to such an extent that the interimage effect is improved, photographically significant disadvantages develop (e.g., increase of fogging during preservation of raw products or during development). On the contrary, when the reducing power of these DIR hydroquinones is lowered to such an extent that such an increase of fogging is developed, it causes a lack of reducing power during development and hence a lack of release of a development inhibitor, giving little or no improvements in the interimage effect.

When a fog inhibitor as disclosed in U.S. Pat. Nos. 2,131,038, 2,694,716, 2,444,605, and 2,232,707 is used in combination with such a DIR hydroquinone, fogging can be somewhat inhibited, but the development activity of the DIR hydroquinone is lowered, causing a drop in the interimage effect.

As mentioned above, it has heretofore been very difficult to develop a great interimage effect without causing the DIR hydroquinone to increase fogging. It has thus been keenly desired to provide an approach for developing an interimage effect while preventing the DIR hydroquinone from increasing fogging.

SUMMARY OF THE INVENTION

It is therefore an object of the present invention to provide a multilayer color photographic light-sensitive material which exhibits a great interimage effect without causing an increase in fogging during preservation of raw products.

It is another object of the present invention to provide a multilayer color photographic light-sensitive material which exhibits a high sharpness and a great interimage effect without deteriorating graininess.

It is a further object of the present invention to provide a silver halide black-and-white light-sensitive material which exhibits a high sharpness and an excellent graininess without causing an increase in fogging.

These and other objects of the present invention will become more apparent from the following detailed description and examples.

The objects of the present invention are accomplished with a silver halide color photographic material comprising on a support at least one silver halide emulsion layer, characterized in that there is contained at least one of the compounds represented by formulae [I] to [III]:

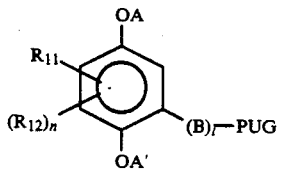

(I)

wherein $R_{11}$ represents

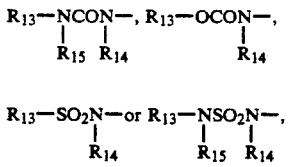

(in which $R_{13}$ represents an alkyl, aryl or heterocyclic group, and $R_{14}$ and $R_{15}$ each represents hydrogen, alkyl group or aryl group); $R_{12}$ represents a substituent having a Hammett's substituent constant $\sigma p$ of 0.3 or less; n represents an integer of 0, 1 or 2 (when n is 2, the two $R_{12}$'s may be the same or different); B represent a group which releases PUG after being separated from a hydroquinone nucleus; PUG represents a development inhibitor; l represents an integer; and A and A' each represents hydrogen or a group capable of being removed by an alkali ($R_{11}$ and $R_{12}$, $R_{11}$ and A or A', $R_{12}$ and A or A', and two $R_{12}$ s may link to form a ring);

(II)

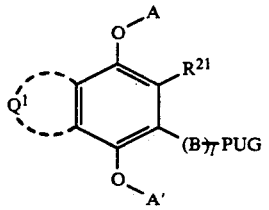

wherein $Q^1$ represents an atomic group containing at least one hetero atom and is required for the formation of a heterocyclic group containing 5 or more members together with carbon atoms connected thereto; $R^{21}$ represents a group capable of substituting on the hydroquinone nucleus; and B, PUG, l, A and A' are as defined above;

(III)

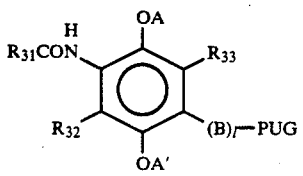

wherein $R_{31}$ represents an alkyl group containing two or more carbon atoms in which the carbon atom adjacent to the carbonyl group is not substituted by a hetero atom, a cycloalkyl group, an aryl group or a heterocyclic group; $R_{32}$ and $R_{33}$ each represents hydrogen or a substituent having a Hammett's substituent constant $\sigma p$ of 0.3 or less; and B, PUG, l, A and A' are as defined above.

DETAILED DESCRIPTION OF THE INVENTION

As a result of a further study, it was found that among the group of compounds represented by formula [III], those represented by formulae [IIIA] and [IIIB] can be used in a small amount to exhibit excellent properties.

(IIIA)

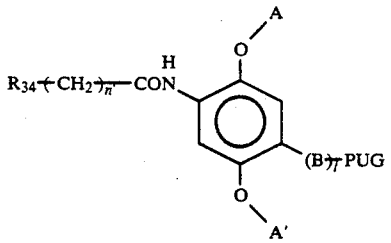

wherein $R_{34}$ represents a substituent; n' represents an integer of 2 or more; and PUG, A, A', B and l are as defined above.

(IIIB)

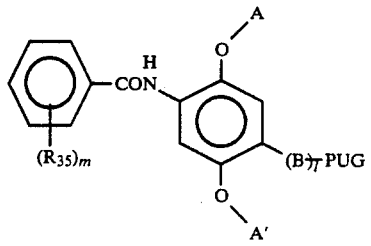

wherein $R_{35}$ represents a substituent; m represents an integer of 1 to 5 (when m is 2 or more, the plurality of $R_{35}$'s may be the same or different); and A, A', B, PUG and l are as defined in formula [I].

The inventors made extensive studies to overcome the disadvantages of the prior art DIR hydroquinones. As a result, the inventors found a surprising fact that the use of DIR hydroquinones represented by formulae [I], [II] and/or [III] enables a drastic improvement in the interimage effect without causing an increase in fogging during preservation of raw products.

As a result of a further study, it was found that among the group of compounds represented by formula [I], those represented by formula [IA] can be used in small amounts to exhibit excellent properties.

(IA)

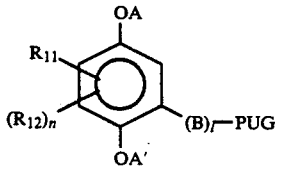

wherein $R_{11}$, $R_{12}$, B, PUG, A, A', n and l are as defined in formula [I].

Examples of known approaches for improving the interimage effect while preventing the DIR hydroquinone from causing an increase in fogging include the combined use of compounds as disclosed in JP-A-63-17445. In the present invention, a great interimage effect can be accomplished without causing an increase in fogging by using at least one of the compounds represented by formulae [I] to [III] in an amount less than the prior art DIR hydroquinones without using these prior art fog inhibitors.

Formulae [I] and [IA] of the present invention will be further described hereinafter.

$R_{11}$ represents

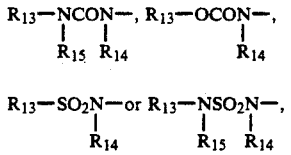

(in which $R_{13}$ represents a substituted or unsubstituted alkyl group ($C_{1-30}$ alkyl, e.g., methyl, ethyl, iso-propyl, n-decyl, n-hexadecyl), substituted or unsubstituted aryl group ($C_{6-30}$ aryl group, e.g., phenyl, naphthyl, m-dodecylamindophenyl, m-hexadecylsulfonamidophenyl, p-dodecyloxyphenyl), or heterocyclic group (e.g., 2-pyridyl, 4-pyridyl, 3-pyridyl, 2-furyl). Examples of substituents to be contained in $R_{13}$ include an alkyl group, aryl group, alkoxy group, aryloxy group, alkylthio group, arylthio group, carboxylamido group, sulfonamido group, alkoxycarbonylamino group, ureido group, carbamoyl group, alkoxycarbonyl group, sulfamoyl group, sulfonyl group, cyano group, halogen, acyl group, carboxyl group, sulfo group, nitro group, and heterocyclic residue. $R_{14}$ and $R_{15}$ may be the same or different and each represents hydrogen or a substituent represented by $R_{13}$.

In formulae [I] and [IA], the group represented by $R_{14}$ is preferably hydrogen.

In formulae [I] and [IA], $R_{12}$ represents a substituent having a Hammett's substituent constant $\sigma 0$ of 0.3 or less. Examples of such a substituent include a substituted or unsubstituted alkyl group ($C_{1-30}$ alkyl, e.g., methyl, ethyl, iso-propyl, n-decyl, n-hexadecyl), substituted or unsubstituted aryl group ($C_{6-30}$ aryl, e.g., phenyl, naphthyl, m-dodecylamidophenyl, m-hexadecylsulfonamidophenyl, p-dodecyloxyphenyl), alkoxy group ($C_{1-30}$ alkoxy, e.g., methoxy, ethoxy, n-hexyloxy, n-hexadecyloxy), aryloxy group ($C_{6-30}$ aryloxy, e.g., phenoxy, naphthyl), alkylthio group ($C_{1-30}$ alkylthio, e.g., methylthio, n-butylthio, n-decylthio), arylthio group ($C_{6-30}$ arylthio, e.g., phenylthio, 2-n-butyloxy-5-tert-octylphenylthio), acylamino group (e.g., acetamido, n-decanamido, benzamido), sulfonamido group (e.g., methanesulfonamido, n-butanesulfonamido), and halogen (e.g., chlorine, bromine, fluorine).

In formulae [I] and [IA], $R_{11}$ and $R_{12}$, $R_{11}$ and A or A', $R_{12}$ and A or A', and two $R_{12}$'s may together form a ring. The ring thus formed is preferably 5- to 7-membered.

In formulae [I] and [IA], l preferably represents an integer of 0 to 2.

Preferred among the compounds represented by formula [I] are those represented by formula [IA]. Further preferred among these compounds are those represented by formula [IB].

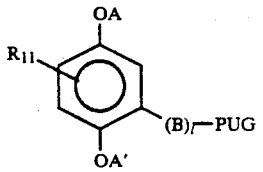

(IB)

wherein $R_{11}$, B, PUG, A, A' and l are as defined in formulae [I] and [IA].

Formula [II] will be described hereinafter.

In formula [II], $Q^1$ represents an atomic group containing at least one hetero atom and required for the formation of a heterocyclic group containing 5 or more members together with carbon atoms connected thereto, $R^2$I represents a group capable of substituting on the hydroquinone nucleus, and B, PUG, l, A and A' are as defined above.

Formula [II] will be further described hereinafter.

$Q^1$ represents a divalent group containing at least one hetero atom. Examples of such a divalent group include an amido bond, divalent amino group, ether bond, thioether bond, imino bond, sulfonyl group, carbonyl group, alkylene group, and alkenylene group. Such a divalent group may be a combination of a plurality of these divalent groups. These divalent groups may further contain substituents. However, if $Q^1$ contains an ether bond, it is not 5-membered.

$R_{21}$ represents a group capable of substituting on the hydroquinone nucleus. Specific examples of such a group include hydrogen, substituted or unsubstituted alkyl group (preferably $C_{1-30}$ alkyl, e.g., methyl, ethyl, t-butyl, t-octyl, dimethylaminomethyl, n-pentadecyl), substituted or unsubstituted aryl group (preferably $C_{6-33}$ aryl, e.g., phenyl, p-tolyl), substituted or unsubstituted alkylthio group (preferably $C_{1-30}$ alkylthio, e.g., n-butylthio, n-octylthio, sec-octylthio, tetradecylthio, 2-dimethylaminoethylthio), substituted or unsubstituted arylthio group (preferably $C_{6-30}$ arylthio, e.g., phenylthio, 2-carboxyphenylthio, p-chlorophenylthio, 2-butoxy-5-t-octylphenylthio, 2-methoxycarbonylphenylthio), halogen (e.g., F, Cl, Br, I), hydroxyl group, substituted or unsubstituted alkoxy group (preferably $C_{1-30}$ alkoxy group, e.g., methoxy, ethoxy, benzyloxy, octyloxy, dodeoyloxy), substituted or unsubstituted aryloxy group (preferably $C_{6-30}$ aryloxy, e.g., phenoxy, 4-carboxyphenoxy), substituted or unsubstituted acyl group (preferably $C_{1-30}$ acyl, e.g., acetyl, propionyl, benzoyl, chloroacetyl, 3-carboxypropionyl, octadecylcyl), substituted or unsubstituted alkoxycarbonyl group preferably $C_{2-30}$ alkoxycarbonyl, e.g methoxycarbonyl, ethoxycarbonyl, phenoxycarbonyl, octadecyloxycarbonyl, methoxyethoxycarbonyl), substituted or unsubstituted amido group (preferably $C_{1-30}$ amido, e.g., acetamido, propionamido, 3-carboxypropionamido, lauroylamido), substituted or unsubstituted sulfonamido group (preferably $C_{1-30}$ sulfonamido e.g , methanesulfonamido, p-toluenesulfonamido), substituted or unsubstituted carbamoyl group (preferably $C_{1-30}$ carbamoyl, e.g., carbamoyl, N-butylcarbamoyl, N-(2-methoxyethyl)cabamoyl, N-octylcarbamoyl, pyrrolidinocarbonyl, morpholinocarbonyl, N-hexadecylcarbamoyl), substituted or unsubstituted sulfamoyl group (preferably $C_{0-30}$ sulfamoyl, e.g., sulfamoyl, dibutylsulfamoyl), substituted or unsubstituted sulfonyl group (preferably $C_{1-30}$ sulfonyl, e.g., methanesulfonyl, benzenesulfonyl, p-dodecylbenzenesulfonyl), and heterocyclic residue (e.g., 5-tetrazolyl, 2-benzoxazolyl).

Formula [III] will be described hereinafter.

In formula [III], $R_{31}$ represents a substituted or unsubstituted alkyl containing two or more carbon atoms in which the carbon atom adjacent to the carbonyl group is not substituted by a hetero atom, a substituted or unsubstituted cycloalkyl group, a substituted or unsubstituted aryl group or a substituted or unsubstituted heterocyclic group. Examples of such an alkyl group include preferably a $C_{2-30}$ a alkyl group (e.g., ethyl, n-nonyl, n-undecyl, n-pentadecyl, 1-(2,5-di-tert-amylphenoxy)propyl, 1-hexylnonyl). Examples of such a cyclopentyl group include $C_{6-30}$ cycloalkyl group (e.g., cyclopentyl, 4-methylcyclohexyl). Examples of such an aryl group include preferably a $C_{6-30}$ aryl group (e.g., phenyl, naphthyl, m-dodecanamidophenyl, m-hexadecylsulfonamidophenyl, p-dodecyloxyphenyl). Examples of such a heterocyclic group include 2-pyridyl, 4-pyridyl, 3-pyridyl, and 2-furyl. Examples of substituents to be contained in $R_{31}$ include an alkyl group, aryl group, alkoxy group, aryloxy group, alkylthio group, arylthio group, carboxylamido group, sulfonamido group, alkoxycarbonylamino group, ureido group, carbamoyl group, alkoxycarbonyl group, sulfamoyl group, sulfonyl group, cyano group, halogen, acyl group, carboxyl group, sulfo group, nitro group, and heterocyclic residue.

In formula [III], $R_{32}$ and $R_{33}$ each represents a substituent having a Hammett's substituent constant $\sigma p$ of 0.3 or less. Examples of such a substituent include substituted or unsubstituted alkyl group (e.g., methyl, ethyl, n-nonyl, n-undecyl), substituted or unsubstituted aryl group (e.g., phenyl, naphthyl, m-dodecanamidophenyl, m-hexadecylsulfonamidophenyl), alkoxy group (e.g., methoxy, ethoxy, n-hexyloxy, n-hexadecyloxy), aryloxy group (e.g., phenoxy, naphthoxy), alkylthio group (e.g., methylthio, n-butylthio, n-decylthio), arylthio group (e.g., phenylthio, 2-n-butyloxy-5-tert-octylphenylthio), acylamino group (e.g., acetylamido, n-decanoic amido, benzamido), sulfonamido (e.g., methanesulfonamido, n-butanesulfonamido, n-dodecylsulfonamido), and halogen (e.g., chlorine, bromine, fluorine).

Preferred examples of substituents represented by $R_{34}$ and $R_{35}$ in formulae [IIIA] and [IIIB] include an alkyl group (e.g., n-heptyl, n-nonyl, n-tridecyl), aryl group (e.g., phenyl, naphthyl), alkoxy group (e.g., n-hexyloxy, 2-ethylhexyloxy, n-decyloxy, n-dodecyloxy, n-hexadecyloxy), aryloxy group (e.g., phenoxy, 2,4-di-tert-amylphenoxy, 2-chloro-4-tert-amylphenoxy, 3-pentadecylphenoxy), alkylthio group (e.g., n-hexylthio, n-decylthio, n-hexadecylthio), arylthio group (e.g., phenylthio, 2-n-butyloxy-5-tert-octylphenylthio, 4-dodecyloxyphenylthio), carboxylamido group (e.g., n-decanoic amido, 2-(2',4'-di-tert-amylphenoxy)-butanoic amido, n-hexadecanoic amido, 2-ethylhexanoic amido, 3-decanoic amido, benzamido), sulfonamido group (e.g., n-dodecylsulfonamido, n-hexadecylsulfonamido, 4-n-dodecyloxybenzenesulfonamido), alkoxycarbonylamino group (e.g., n-dodecyloxycarbonylamino, n-hexyloxycarbonylamino), sulfamoyl group (e.g., n-decylsulfamoyl, n-hexadecylsulfamoyl), sulfonyl group (e.g., n-octanesulfonyl, n-dodecanesulfonyl, benzenesulfonyl), ureido group (e.g., N-n-dodecylcarbamoylamino, N-n-hexadecylcarbamoylamino), carbamoyl group (e.g., N-n-dodecylcarbamoyl, N-n-hexadecylcarbamoyl), alkoxycarbonyl group (e.g., 2-ethylhexyloxycarbonyl, n-hexadecylcarbonyl), cyano group, halogen, nitro group, and hydroxyl group. These substituents may be further substituted by these groups.

In formula [IIIA], $R_{34}$ is preferably a $C_{5-30}$ substituent, and n' is preferably an integer of 2 to 5.

In formula [IIIB], the total number of carbon atoms contained in $R_{35}$ is preferably in the range of 5 to 30.

A, A', B and PUG in formulae [I], [II] and [III] will be further described hereinafter.

Preferred examples of the group capable of being removed by an alkali represented by A or A' (hereinafter referred to as "precursor group") include hydrolyzable groups such as an acyl group, alkoxycarbonyl group, aryloxycarbonyl group, carbamoyl group, imidoyl group, oxazolyl group and sulfonyl group, precursor groups of the type utilizing a reverse Michael reaction as described in U.S. Pat. No. 4,009,029, precursor groups of the type utilizing as an intramolecular nucleus anion produced after the cleavage of a ring as described in U.S. Pat. No. 4,310,612, precursor groups which undergo electron migration of an anion via a conjugated system to cause a cleavage reaction as described in U.S. Pat. Nos. 3,674,478, 3,932,480, and 3,993,661, precursor groups which undergo electron migration of anion produced by the cleavage of a ring to cause a cleavage reaction as described in U.S. Pat. No. 4,335,200, and precursor groups utilizing an imidomethyl group as described in U.S. Pat. Nos. 4,363,865, and 4,410,618.

The group represented by B in formulae [I], [II] and [III] is a divalent group which undergoes oxidation of its hydroquinone nucleus by an oxidation product of a developing agent during development to produce a quinone unit which then releases $^{\theta}\!\!\leftarrow\!\!B\!\!\rightarrow_{l}$ PUG from which PUG is then released. This divalent group may have an effect of adjusting timing. The group represented by B may be a group capable of reacting with another molecule of an oxidation product of a developing agent to produce a coupler which releases PUG. Alternatively, the group represented by B may be a redox group. When l is 0, PUG is directly connected to the hydroquinone nucleus. When l is 2 or more, it means a combination of the two or more same or different B's.

If B represents a divalent linking groups having an effect of adjusting timing, examples of such a divalent linking group include the following groups:

(1) Groups Utilizing the Cleavage Reaction of Hemiacetal

Examples of such groups include those represented by formula (T-1) as described in U.S. Pat. No. 4,146,396, and JP-A-60-249148, and JP-A-60-249149. In formula (T-1), the mark * indicates the position at which B is connected leftward in formulae [I], [II] and [III], and the mark ** indicates the position at which B is connected rightward in formulae [I], [II] and [III].

(T-1)

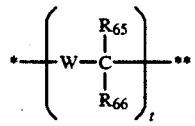

wherein W represents oxygen, sulfur or

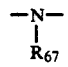

in which $R_{67}$ represents a substituent; $R_{65}$ and $R_{66}$ each represents hydrogen or a substituent; and t represents an integer of 1 or 2. When t is 2, the two

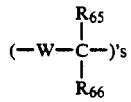

may be the same or different. Typical examples of substituents represented by $R_{65}$, $R_{66}$ and $R_{67}$ include $R_{69}$, $R_{69}CO$—, $R_{69}SO_2$—,

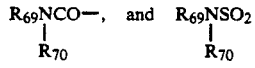

in which $R_{69}$ represents an aliphatic group, aromatic group or heterocyclic group, and $R_{70}$ represents an aliphatic group, aromatic group, heterocyclic group or hydrogen. Preferred examples of the group represented by $R_{70}$ include $C_{1-32}$, preferably $C_{1-22}$ straight-chain or branched chain or cyclic, saturated or unsaturated, substituted or unsubstituted aliphatic group (e.g., methyl, ethyl, benzyl, phenoxybutyl, isopropyl), $C_{6-10}$ substituted or unsubstituted aromatic group (e.g., phenyl, 4-methylphenyl, 1-naphthyl, 4-dodecyloxyphenyl), and 4- to 7-membered heterocyclic group containing as a hetero atom a nitrogen atom, sulfur atom or oxygen atom (e.g., 2-pyridyl, 1-phenyl-4-imidazolyl, 2-furyl, benzothienyl). $R_{65}$, $R_{66}$ and $R_{67}$ each represents a divalent group. $R_{65}$, $R_{66}$ and $R_{67}$ may be connected to each other to form a cyclic structure. Specific examples of the group represented by formula (T-1) include the following groups:

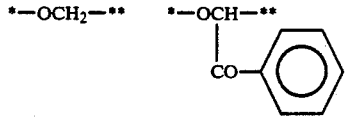

-continued

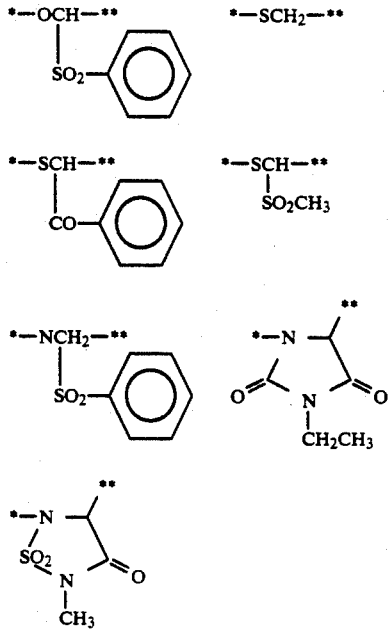

(2) Groups Which Utilize an Intramolecular Nucleophilic Substitution Reaction to Cause Cleavage Reaction Examples of such groups include timing groups as described in U.S. Pat. No. 4,248,962. These timing groups can be represented by formula (T-2):

$$* - Nu - Link - E - ** \qquad (T\text{-}2)$$

wherein the mark * indicates the position at which B is connected leftward in formulae [I], [II] and [III]; the mark  indicates the position at which B is connected rightward in formulae [I], [II] and [III]; Nu represents a nucleophilic group (examples of nucelophilic seeds: oxygen atom or sulfur atom); E represents an electrophilic group which undergoes a nucleophilic attack by Nu to enable the cleavage of the bond ; and Link represents a linking group which sterically relates Nu to E so that they can undergo an intramolecular nucleophilic substitution reaction. Specific examples of the group represented by formula (T-2) include the following groups:

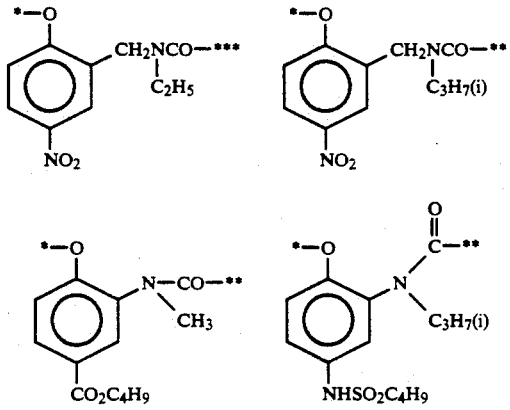

-continued

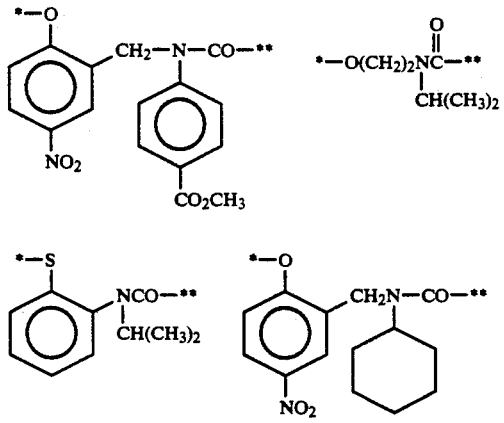

(3) Groups Which Utilize an Electron Migration Reaction Along a Conjugated System to Cause a Cleavage Reaction Examples of such groups include those described in U.S. Pat. Nos. 4,409,323, and 4,421,845. These groups can be represented by formula (T-3):

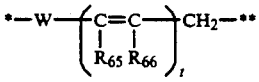

(T-3)

wherein the marks * and **, W, $R_{65}$, $R_{66}$ and t have the same meanings as in formula (T-1). Specific examples of these groups include the following groups:

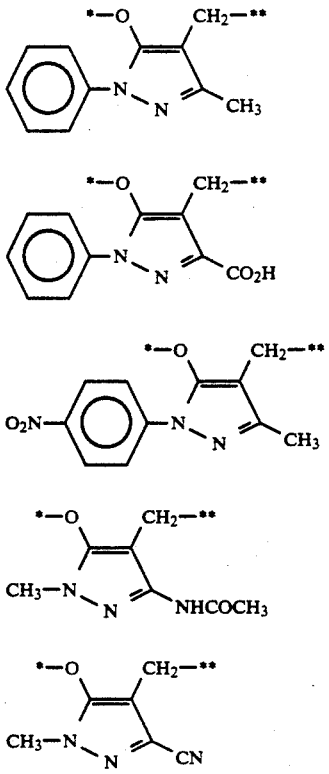

-continued

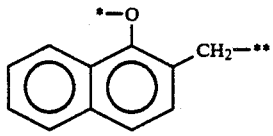

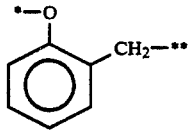

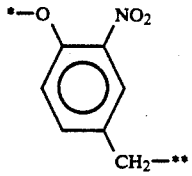

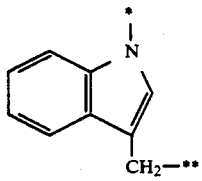

(4) Groups Utilizing a Cleavage Reaction by the Hydrolysis of Ester

Examples of these groups include linking groups as described in West German Patent Laid-Open No. 2,626,315. Specific examples of these linking groups will be set forth below. In the following formulae (T-4) and (T-5), the marks * and ** have the same meanings as defined in formula (T-1).

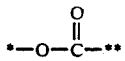

(T-4)

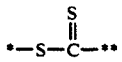

(T-5)

(5) Groups Utilizing the Cleavage Reaction of Iminoketal

Examples of these groups include linking groups as described in U.S. Pat. No. 4,546,073. These linking groups are represented by formula (T-6):

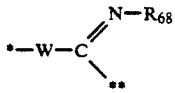

wherein the marks * and ** and W have the same meanings as defined in formula (T-1); and $R_{68}$ has the same meaning as $R_{67}$. Specific examples of the group represented by formula (T-6) are set forth below.

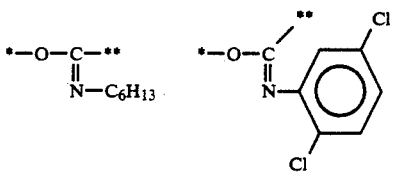

-continued

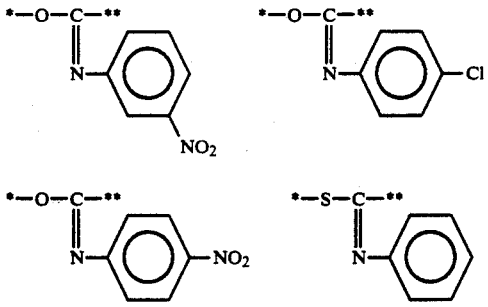

Examples of couplers or redox groups represented by B include the following groups.

Examples of phenolic couplers represented by B include a coupler connected to the hydroquinone nucleus at a hydroxyl group from which a hydrogen atom is excluded. Examples of 5-pyrazolone couplers represented by B include a coupler which has tautomerized to 5-hydroxypyrazole connected to the hydroquinone nucleus at the hydroxyl group from which the hydrogen atom is excluded. Such a coupler becomes a phenolic coupler or 5-pyrazolone coupler only when it is separated from the hydroquinone nucleus. PUG is connected to their coupling positions.

Preferred examples of the group represented by B which undergoes cleavage from an oxidation product of the hydroquinone nucleus to become a coupler include those represented by the following formulae (C-1), (C-2), (C-3) and (C-4).

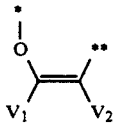

(C-I)

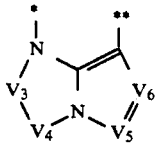

(C-2)

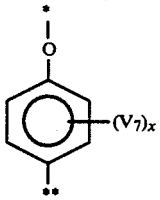

(C-3)

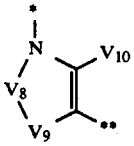

(C-4)

wherein $V_1$ and $V_2$ each represents a substituent; $V_3$, $V_4$, $V_5$ and $V_6$ each represents nitrogen or substituted or unsubstituted methine group; $V_7$ represents a substituent; x represents an integer of 0 to 4 (when x is plural, the plurality of $V_7$'s may be the same or different and two $V_7$'s may link to form a cyclic structure); $V_8$ represents a —CO— group, —$SO_2$— group, oxygen atom or substituted imino group; $V_9$ represents a nonmetallic atom group for the constitution of a 5- to 8-membered ring with

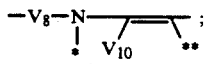

and $V_{10}$ represents hydrogen or substituent, with the proviso that $V_1$ and $V_2$ represent divalent groups which may link to form a 5- to 8-membered ring with

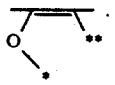

V1 preferably represents $R_{71}$. Preferred examples of the group represented by $V_2$ include $R_{72}$, $R_{72}CO$—,

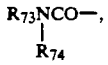

$R_{72}SO_2$, $R_{72}S$—, $R_{72}O$—, and

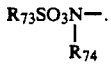

Examples of a ring formed by $V_1$ and $V_2$ include indenes, indoles, pyrazoles, and benzothiophenes.

Preferred examples of substituents to be contained in the substituted methine group represented by $V_3$, $V_4$, $V_5$ and $V_6$ include $R_{71}$, $R_{73}O$—, $R_{71}S$—, and $R_{71}CONH$—.

Preferred examples of the group represented by $V_7$ include a halogen, $R_{71}$, $R_{71}CONH$—, $R_{71}SO_2NH$—, $R_{73}O$—, $R_{71}S$—,

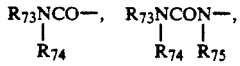

$R_{71}CO$—, and $R_{73}OOC$—. Examples of a cyclic structure formed by a plurality of $V_7$'s include naphthalenes, quinolines, oxyindoles, benzodiazepine-2,4-diones, benzimidazole-2-ones, and benzothiophenes.

The substituted imino group represented by $V_8$ is preferably $R_{73}N<$.

Preferred examples of the cyclic structure which $V_9$ forms with

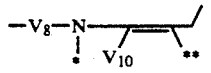

include indoles, imidazolinones, 1,2,5-thiadiazoline-1,1-dioxides, 3-pyrazoline-5-ones, 3-isoxazoline-5-ones, and

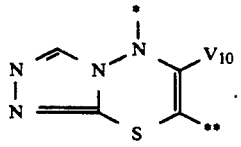

Preferred examples of the group represented by $V_{10}$ includes $R_{73}$, $R_{73}O$—,

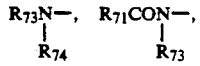

and $R_{71}S$—.

In the foregoing, $R_{71}$ and $R_{72}$ each represents an aliphatic group, aromatic group or heterocyclic group, and $R_{73}$, $R_{74}$ and $R_{75}$ each represents hydrogen, aliphatic group, aromatic group or heterocyclic group. The aliphatic group, aromatic group and heterocyclic group are as defined above, with the proviso that the total number of carbon atoms contained therein is each preferably 10 or less.

Specific examples of the group represented by formula (C-1) include the following groups:

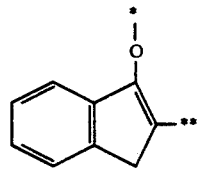

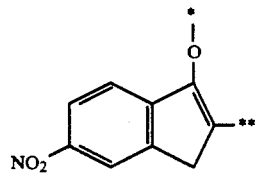

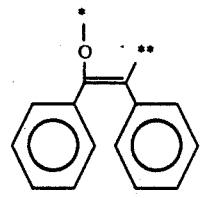

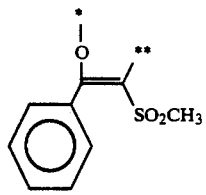

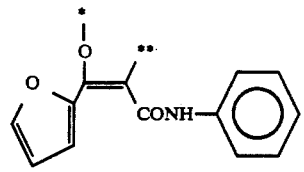

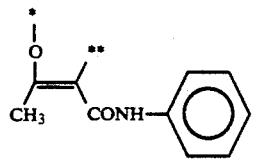

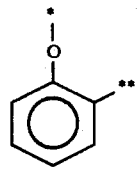

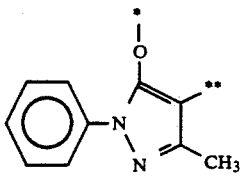

-continued
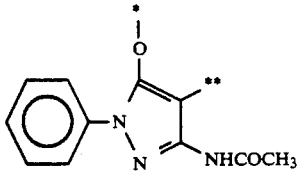
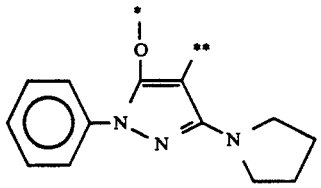
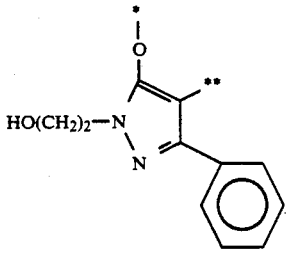
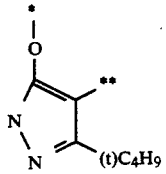
Specific examples of the group represented by formula (C-2) include the following groups:
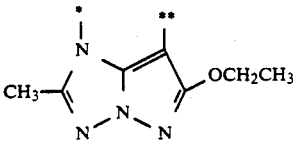
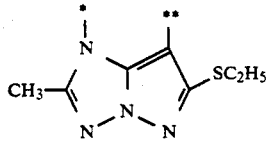
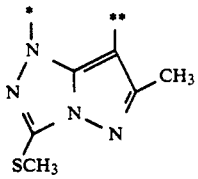
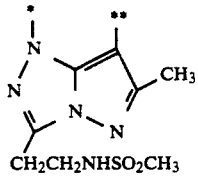
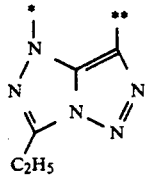
-continued
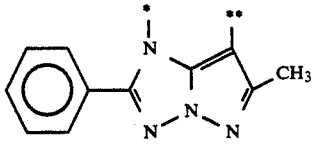
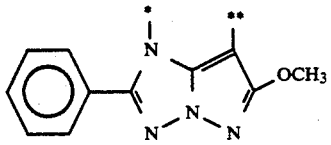
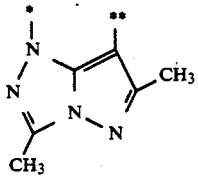
Specific examples of the group represented by formula (C-3) include the following groups:
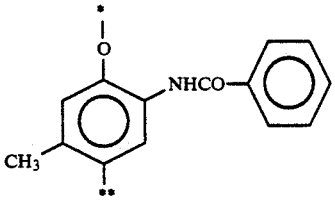
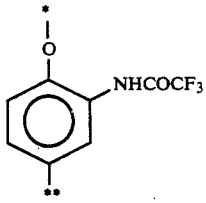
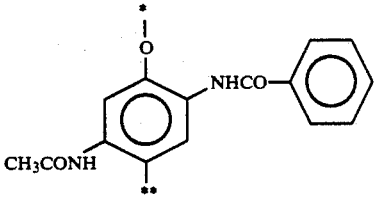
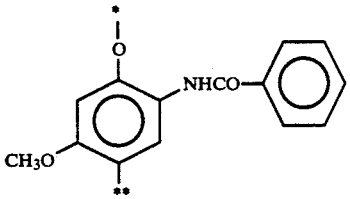
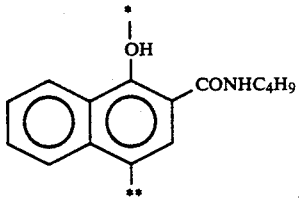

-continued

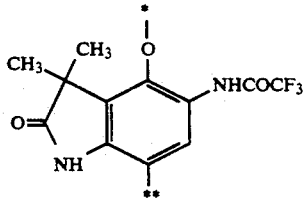

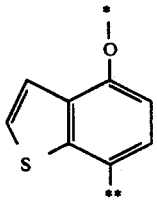

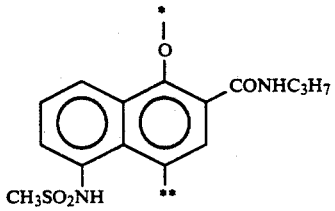

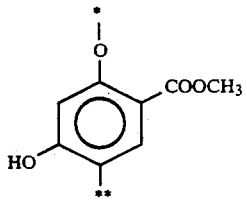

Specific examples of the group represented by formula (C-4) include the following groups:

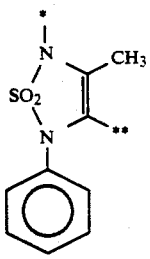

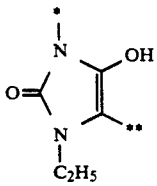

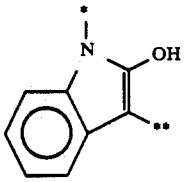

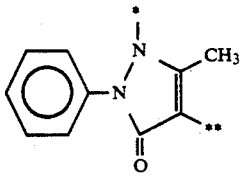

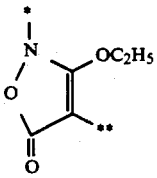

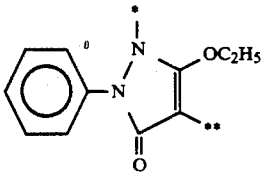

-continued

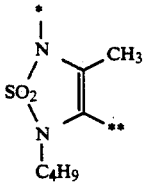

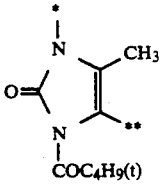

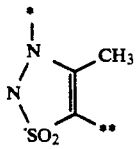

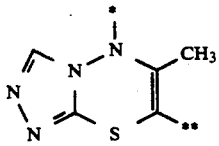

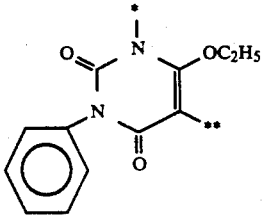

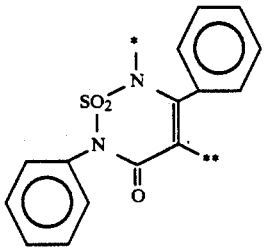

When the group represented by B in formulae [I], [II] and [III] is a group which undergoes cleavage from the hydroquinone nucleus to produce a redox group, it is preferably represented by formula (R-1):

$$*-P-(X=Y)_n-Q-A \qquad \text{(R-1)}$$

wherein P and Q each independently represents an oxygen atom or substituted or unsubstituted imino group; at least one of nX's and nY's represents a methine group containing —PUG as a substituent and the others each represent a nitrogen atom or substituted or unsubstituted methine group; n represents an integer of 1 to 3 (nX's and nY's may be the same or different); and A represents a hydrogen atom or a group capable of being removed by an alkali as defined in formula (I). Any two substituents among P, X, Y, Q and A may be divalent groups which are connected to each other to form a cyclic structure. For example, $(X=Y)_n$ may form a benzene ring, pyridine ring or the like.

When P and Q each represents a substituted or unsubstituted imino group, it is preferably an imino group represented by a sulfonyl group or an acyl group.

In this case, P and Q are represented by the following formulae:

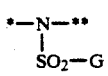

(N-1)

-continued

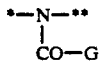

(N-2)

wherein the mark * indicates the position at which it is connected to A; and the mark ** indicates the position at which it is connected to one of free bonding portions of $-(X=Y)_n-$.

In these formulae, preferred examples of the group represented by G include $C_{1-32}$, preferably $C_{1-22}$ straight-chain or branched, chain or cyclic, saturated or unsaturated, substituted or unsubstituted aliphatic group (e.g., methyl, ethyl, benzyl, phenoxybutyl, isopropyl), $C_{6-10}$ substituted or unsubstituted aromatic group (e.g., phenyl, 4-methylphenyl, 1-naphthyl, 4-dodecyloxyphenyl), and 4- to 7-membered heterocyclic group containing as a hetero atom a nitrogen atom, sulfur atom or oxygen atom (e.g., 2-pyridyl, 1-phenyl-4-imidazolyl, 2-furyl, benzothienyl).

In formula (R-1), P and Q preferably each is independently an oxygen atom or a group represented by formula (N-1).

In formula (R-1), P is preferably an oxygen atom, and A is a hydrogen atom.

More preferably, the other X's and Y's are substituted or unsubstituted methine groups, except for the case where X and Y each represents a methine group containing PUG as substituent.

Particularly preferred among the groups represented by formula (R-1) are those represented by the following formulae (R-2) and (R-3):

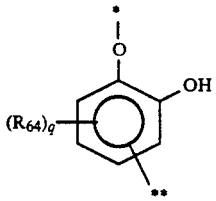

(R-2)

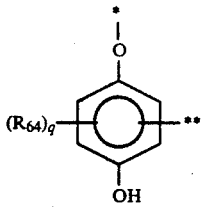

(R-3)

wherein the mark * represents the position at which it is connected to the hydroquinone nucleus; and the mark ** indicates the position at which it is connected to PUG.

$R_{64}$ represents a substituent. q represents an integer of 0 to 3. When q is 2 or more, the two $R_{64}$'s may be the same or different. When the two $R_{64}$'s are substituents on adjacent carbon atoms, they may be divalent groups which are connected to each other to form a cyclic structure which is a benzene-condensed ring. Examples of such a cyclic structure include naphthalenes, benzonorbornenes, chromans, indoles, benzothiophenes, quinolines, benzofurans, 2,3-dihydrobenzofurans, indans, and indenes. These cyclic structures may further contain one or more substituents. Preferred examples of substituents to be contained on these substituted condensed rings and preferred examples of $R_{64}$ which does not form a condensed ring will be set forth hereinafter.

In particular, these groups include an alkoxy group (e.g., methoxy, ethoxy), acylamino group (e.g., acetamide, benzamide), sulfonamido group (e.g., methanesulfonamido, benzenesulfonamido), alkylthio group (e.g., methylthio, ethylthio), carbamoyl group (e.g., N-propylcarbamoyl, N-t-butylcarbamoyl, N-i-propylcarbamoyl), alkoxycarbonyl group (e.g., methoxycarbonyl, propoxycarbonyl), aliphatic group (e.g., methyl, t-butyl), halogen atom (e.g., fluorine, chlorine), sulfamoyl group (e.g., N- propylsulfamoyl, sulfamoyl), acyl group (e.g., acetyl, benzoyl), hydroxyl group, carboxyl group, and heterocyclic thio group (e.g., group represented by PUG described later, such as 1-phenyltetrazolyl-5-thio, 1-ethyltetrazolyl-5-thio). Typical examples of the cyclic structure formed by the connection of two $R_{64}$'s include:

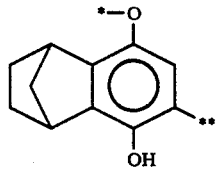

wherein the marks * and ** are as defined in formula (R-3).

In formulae [I], [II] and [III], PUG represents a development inhibitor. Specific examples of such a development inhibitor include a tetrazolylthio group, benzoimidazolylthio group, benzothiazolylthio group, benzoxazolylthio group, benzotriazolyl group, benzoindazolyl group, triazolylthio group, oxadiazolylthio group, imidazolylthio group, thiadiazolylthio group, thioether-substituted triazolyl group (e.g., development inhibitor as described in U.S. Pat. No. 4,579,816), and oxazolylthio group. These groups may contain substituents as necessary. Preferred examples of such substituents include $R_{77}$, $R_{78}O-$, $R_{77}S-$, $R_{77}OCO-$, $R_{77}O-SO-$, halogen atom, cyano group, nitro group, $R_{77}SO_2-$, $R_{78}CO-$, $R_{77}COO-$,

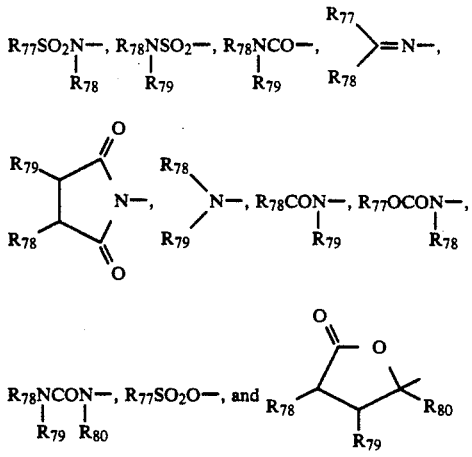

in which $R_{77}$ represents an aliphatic group, aromatic group or heterocyclic group, and $R_{78}$, $R_{79}$ and $R_{80}$ each represents an aliphatic group, aromatic group, heterocyclic group or hydrogen atom. When there are two or more $R_{77}$'s, $R_{78}$'s, $R_{79}$'s and $R_{80}$'s in one molecule, they may be connected to each other to form a ring (e.g., benzene ring). The above mentioned aliphatic group is a $C_{1-20}$, preferably $C_{1-10}$ saturated or unsaturated, branched or straight-chain, chain or cyclic, substituted or unsubstituted aliphatic hydrocarbon group. The above mentioned aromatic group is a $C_{6-20}$, preferably $C_{6-10}$ substituted or unsubstituted phenyl group or substituted or unsubstituted naphthyl group. The above mentioned heterocyclic group is a $C_{1-18}$, preferably $C_{1-7}$ saturated or unsaturated, substituted or unsubstituted, preferably 4- to 8-membered heterocyclic group containing as hetero atoms a nitrogen atom, sulfur atom or oxygen atom. When these aliphatic, aromatic and heterocyclic groups contain substituents, examples of these substituents include the heterocyclic thio groups as described in the examples of development inhibitors and those described as substituents which may be contained in these heterocyclic groups.

In formulae [I], [II] and [III], a particularly preferred development inhibitor is a compound which exhibits a development inhibiting effect upon cleavage but is decomposed (or converted) to a compound which substantially does not affect the photographic properties after flowing into the color developer.

Examples of such a development inhibitor include those described in U.S. Pat. No. 4,477,563, and JP-A-60-218644, JP-A-60-221750, JP-A-60-233650, and JP-A-61-11743.

In formula [IB], $R_{11}$ is preferably

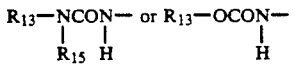

in which $R_{13}$ and $R_{15}$ are as defined above.

In formula [IB], A and A' each preferably is hydrogen.

In formula [IB], l is preferably 0 or 1

In formula [II], $Q^1$ is preferably represented by

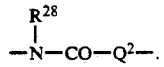

Examples of $Q^2$ include a divalent amino group, ether bond, thioether bond, alkylene bond, ethylene bond, imino bond, sulfonyl group, carbonyl group, arylene group, divalent heterocyclic group, and a group obtained by combining a plurality of these groups.

$R_{28}$ represents hydrogen, alkyl group (which may contain substituents; preferably $C_{1-10}$ alkyl, such as methyl, ethyl, isopropyl, butyl, cyclohexyl, 2-methoxyethyl, benzyl, aryl), aryl group (which may contain substituents; preferably $C_{6-12}$ aryl, such as phenyl, p-tolyl) or heterocyclic group (which may contain substituents; preferably $C_{3-10}$, such as 2-pyridyl, 2-imidazolyl, 2-furyl).

$R^{21}$ is preferably hydrogen or a substituent having a Hammett's substituent constant $\sigma p$ of 0 or more.

Examples of such a substituent include those described with reference to $R^{21}$, such as a halogen atom, substituted or unsubstituted acyl group, alkoxycarbonyl group, amido group, sulfonamide group, carbamoyl group, sulfamoyl group, sulfonyl group, formyl group, cyano group, substituted methyl group (e.g., chloromethyl, trifluoromethyl, hydroxymethyl, benzyl), and heterocyclic residue.

The number of members to be contained in the heterocyclic group containing $Q^1$ is preferably 5 to 7. Particularly preferred among these heterocyclic groups are compounds represented by formula [IIA]:

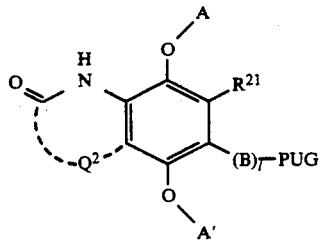

(IIA)

wherein $Q^2$ is as defined above; and $R^{21}$, A, A', B, PUG and l have the same meanings as defined in formula [II]. l is preferably an integer of 0, 1, or 2.

In formulae [III], [IIIA], and [IIIB], l is preferably 0, 1 or 2.

In the present invention, particularly preferred among the compounds represented by formulae [I] to [III] are those represented by formula [I].

Specific examples of compounds which can be used in the present invention will be set forth below, but the present invention should not be construed as being limited thereto.

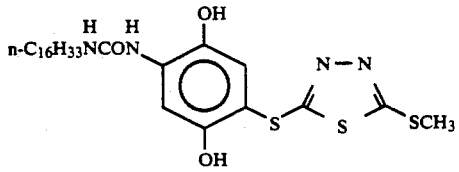

I-(1)

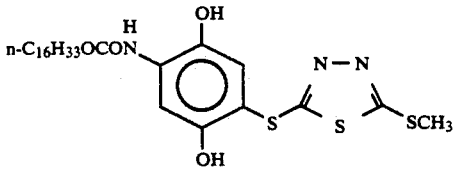

I-(2)

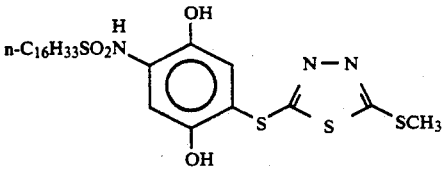

I-(3)

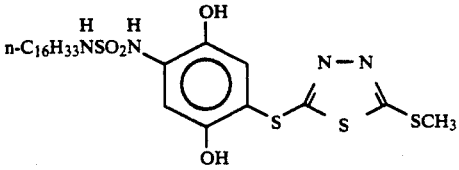

I-(4)

-continued
I-(5)
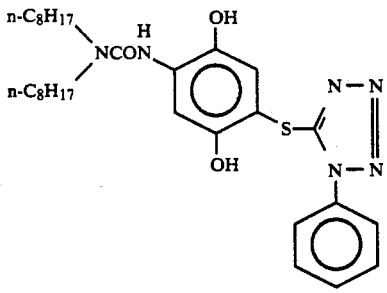
I-(6)
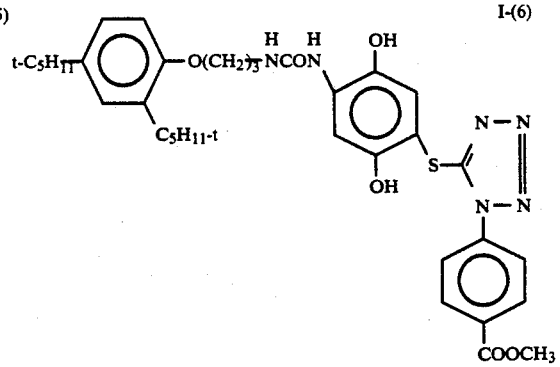
I-(7)
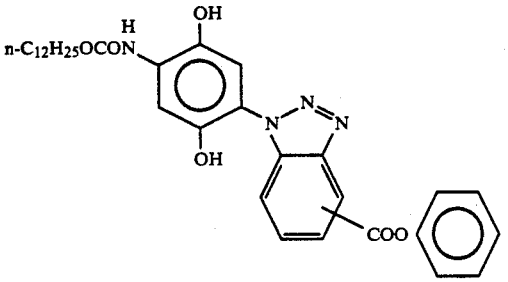
I-(8)
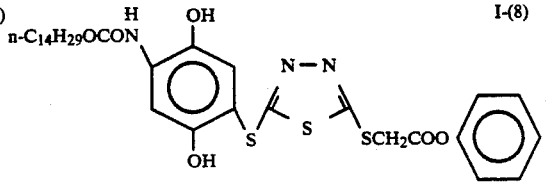
I-(9)
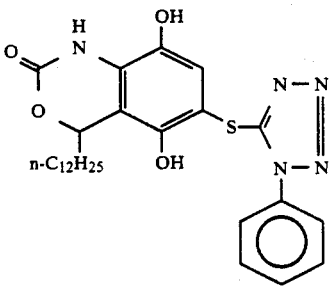
I-(10)
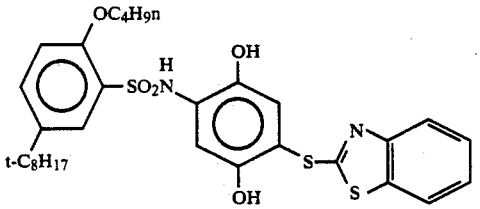
I-(11)
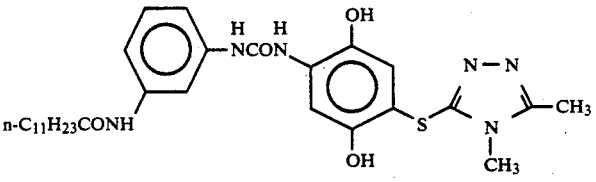
I-(12)
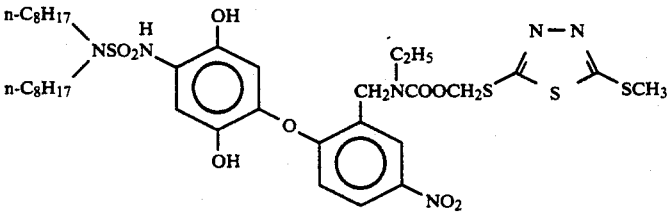
I-(13)
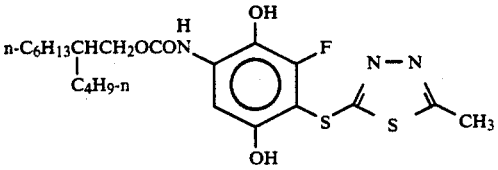
I-(14)
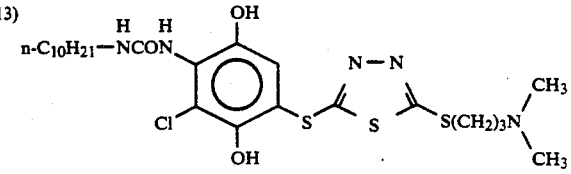

-continued
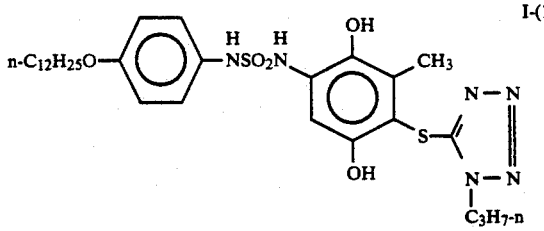
I-(15)
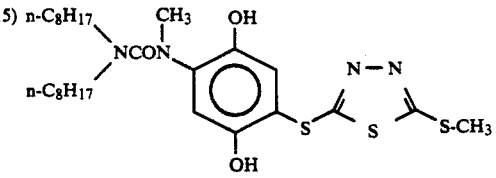
I-(16)
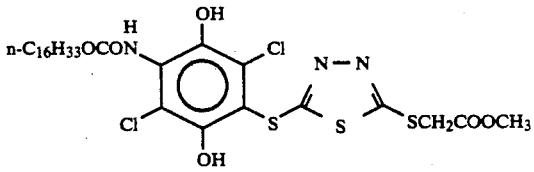
I-(17)
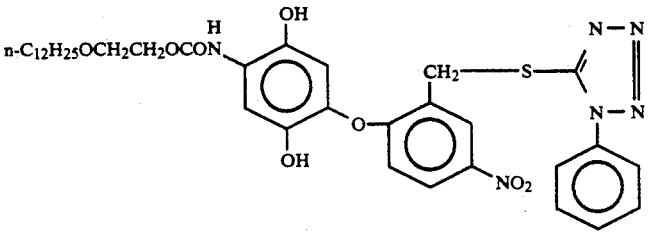
I-(18)
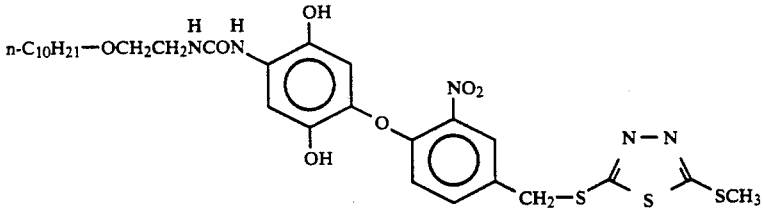
I-(19)
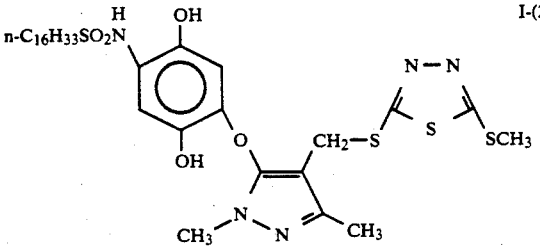
I-(20)
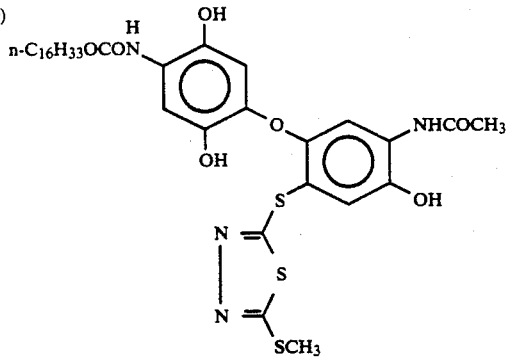
I-(21)
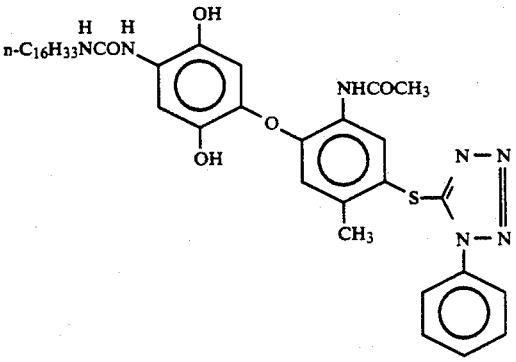
I-(22)
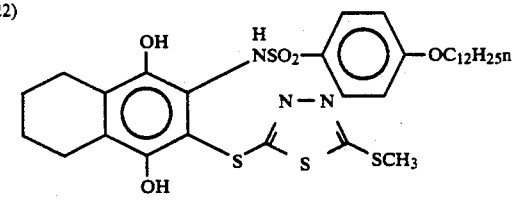
I-(23)

-continued
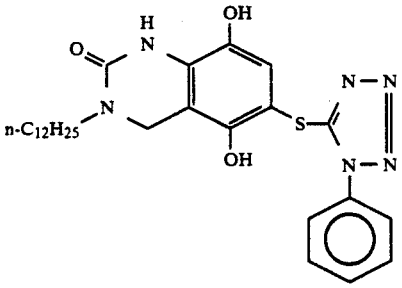
I-(24)
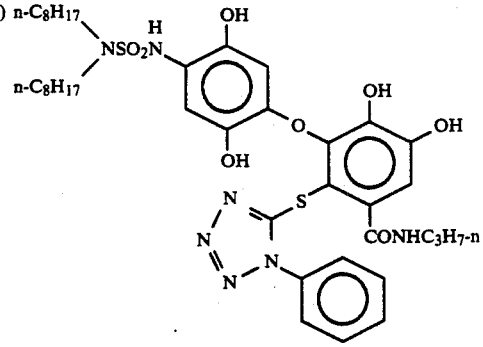
I-(25)
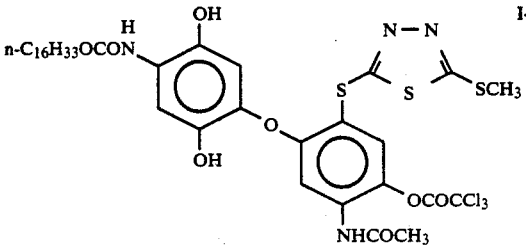
I-(26)
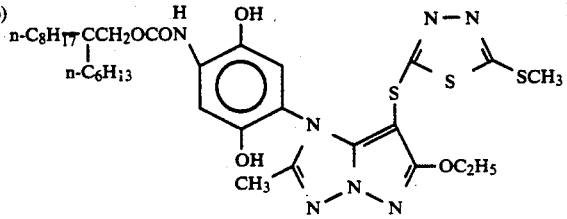
I-(27)
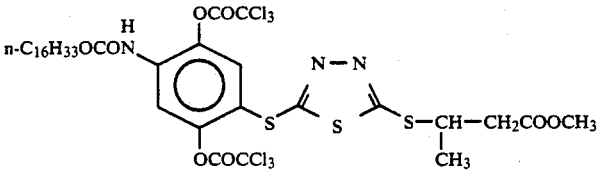
I-(28)
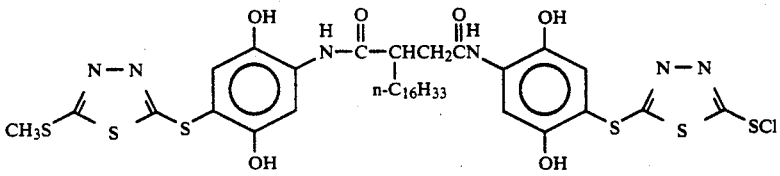
I-(29)
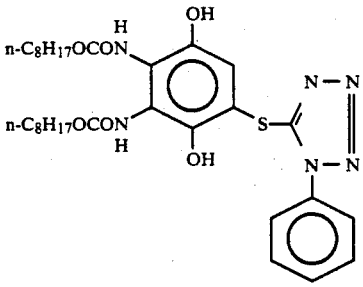
I-(30)
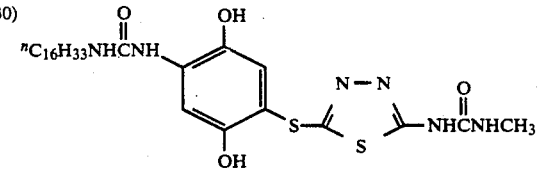
I-(31)
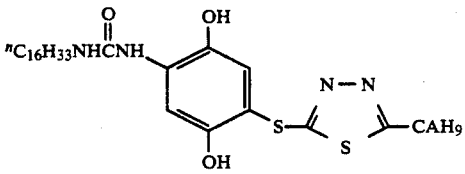
I-(32)
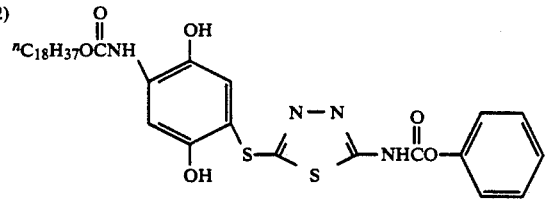
I-(33)
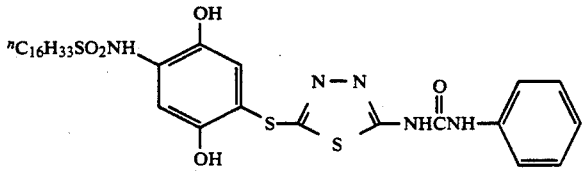
I-(34)

-continued
I-(35)
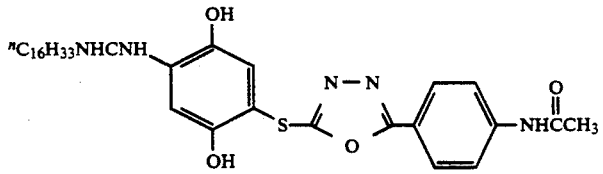
I-(36)
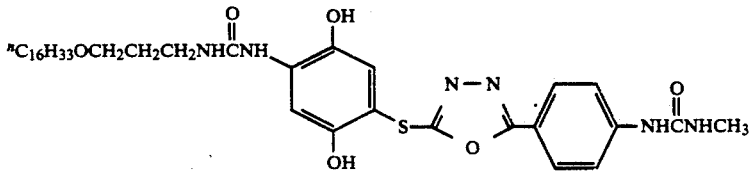
I-(37)
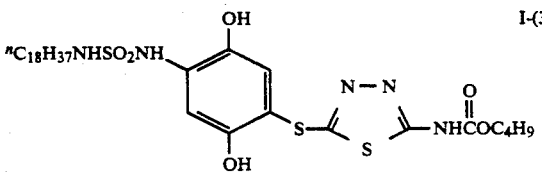
I-(38)
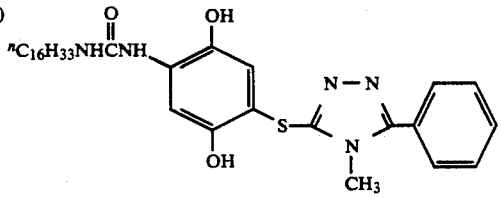
I-(39)
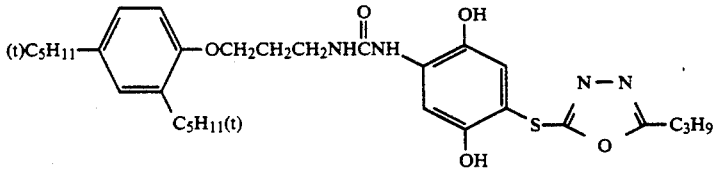
I-(40)
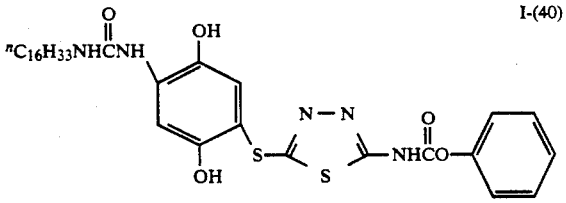
II-(1)
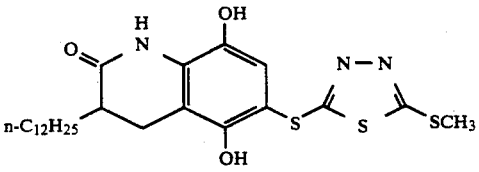
II-(2)
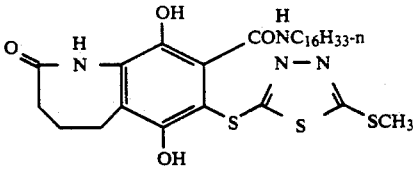
II-(3)
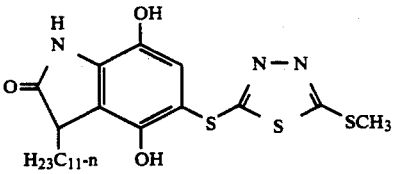
II-(4)
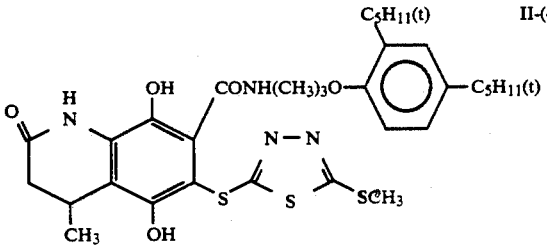
II-(5)
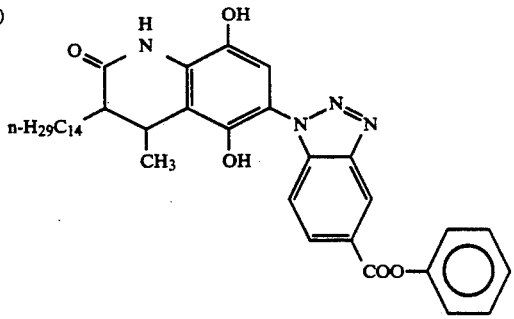

-continued
II-(6)
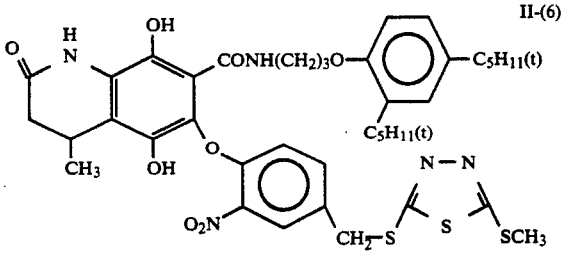
II-(7)
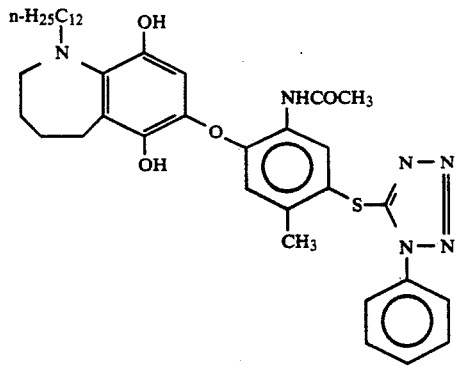
II-(8)
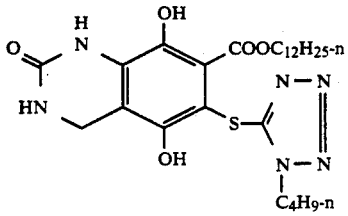
II-(9)
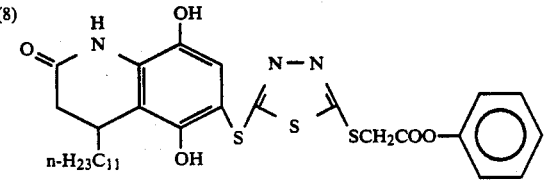
II-(10)
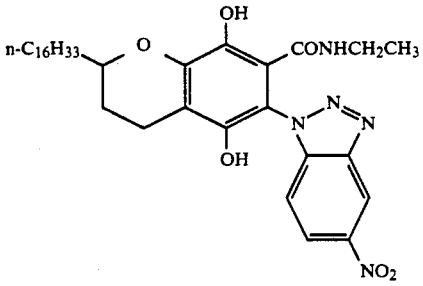
II-(11)
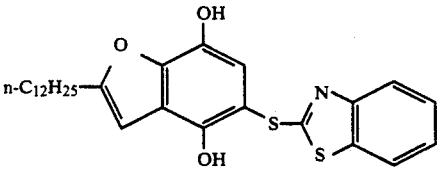
II-(12)
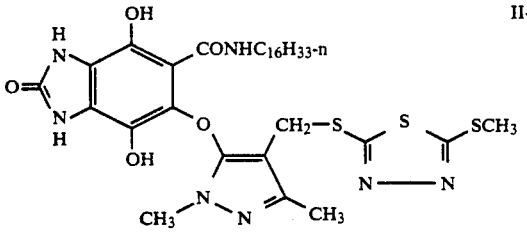
II-(13)
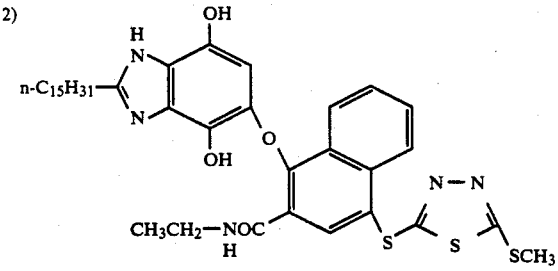
II-(14)
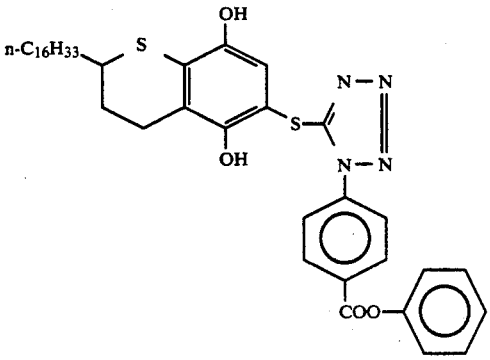
II-(15)
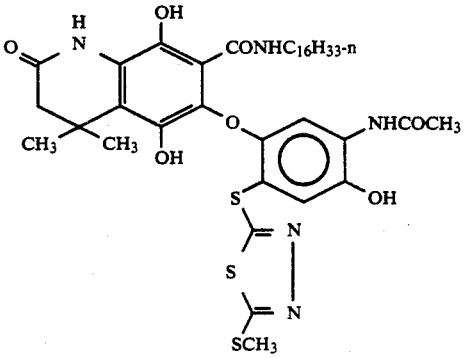

-continued
II-(16)
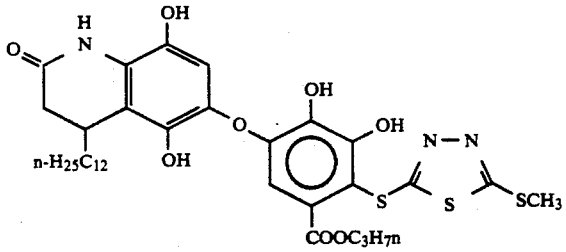
II-(17)
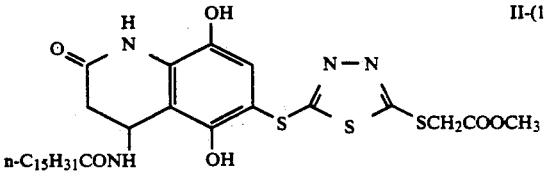
II-(18)
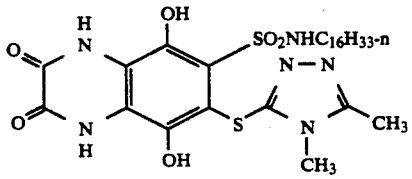
II-(19)
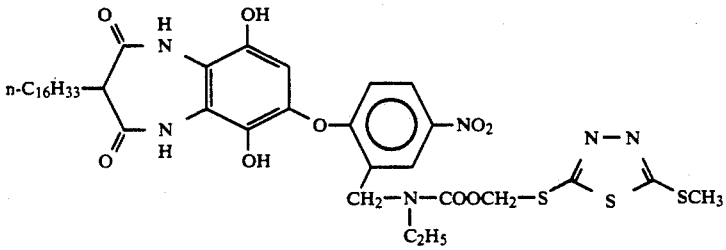
II-(20)
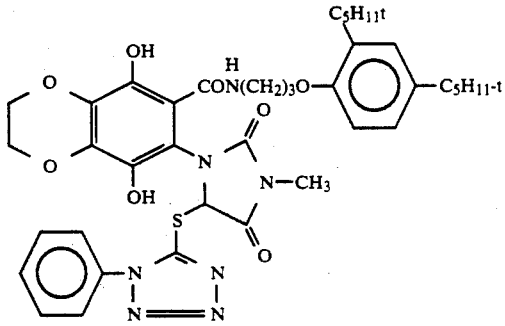
II-(21)
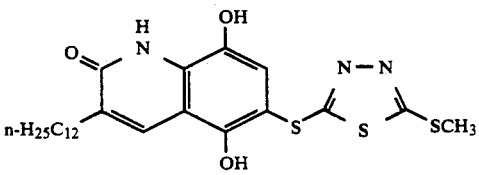
II-(22)
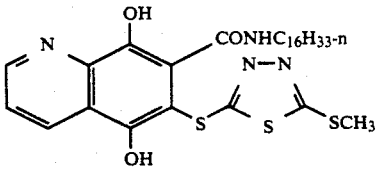
II-(23)
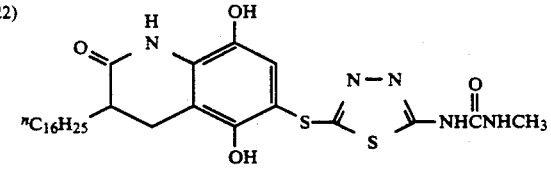
II-(24)
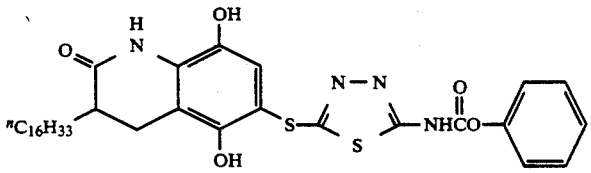
II-(25)
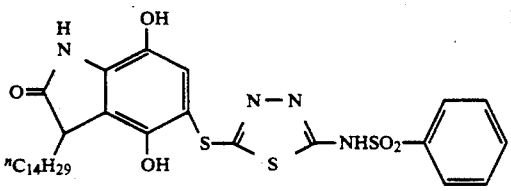
II-(26)
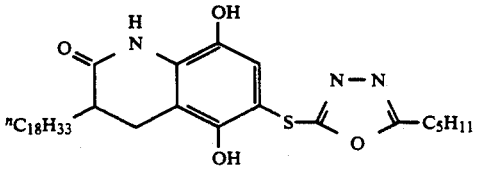

-continued
II-(27)
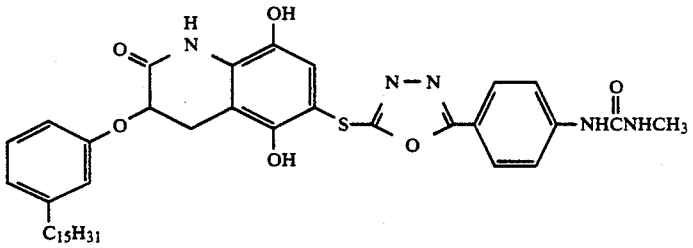
II-(28)
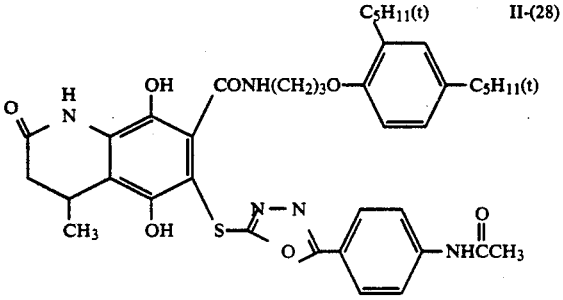
III-(1)
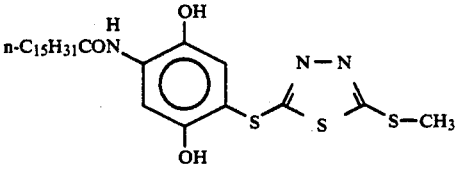
III-(2)
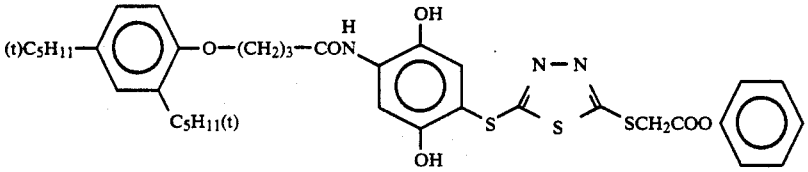
III-(3)
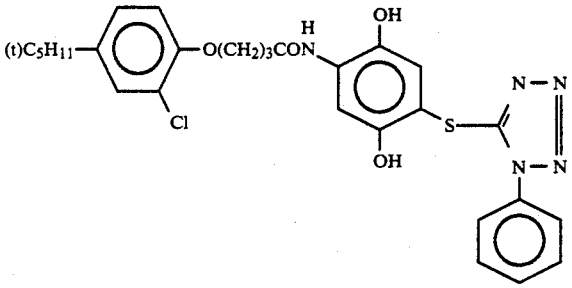
III-(4)
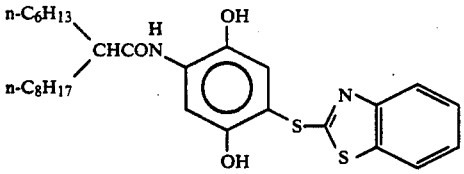
III-(5)
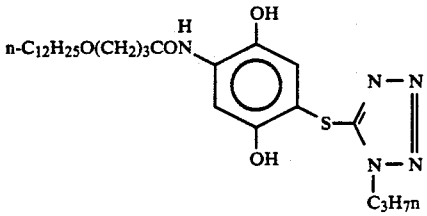
III-(6)
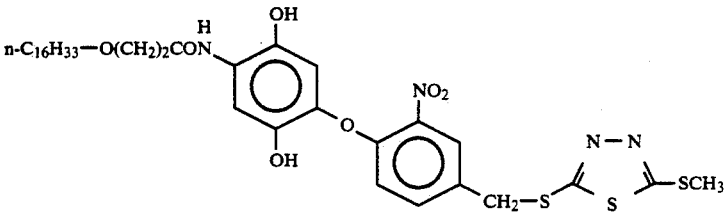

-continued
III-(7)
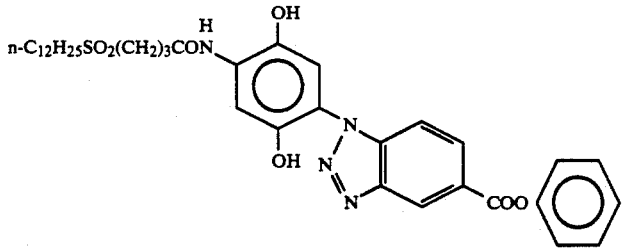
III-(8)
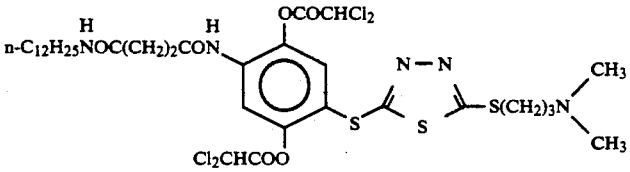
III-(9)
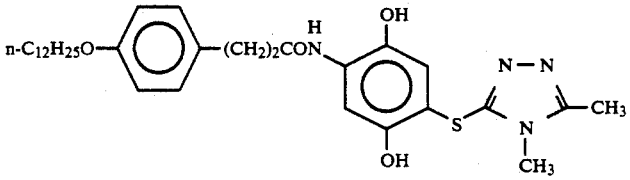
III-(10)
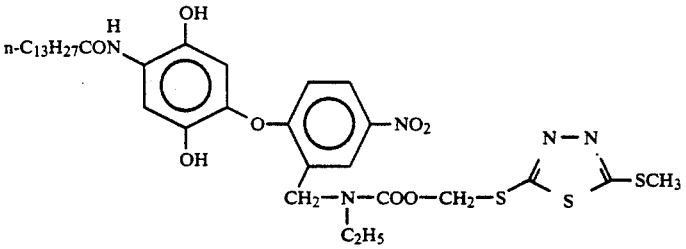
III-(11)
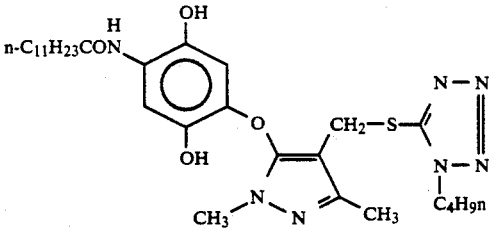
III-(12)
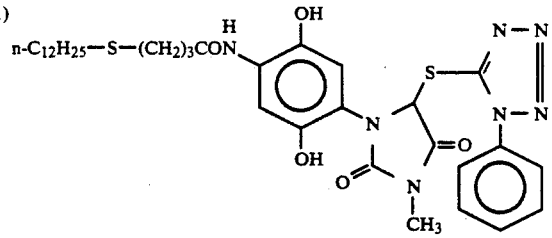
III-(13)
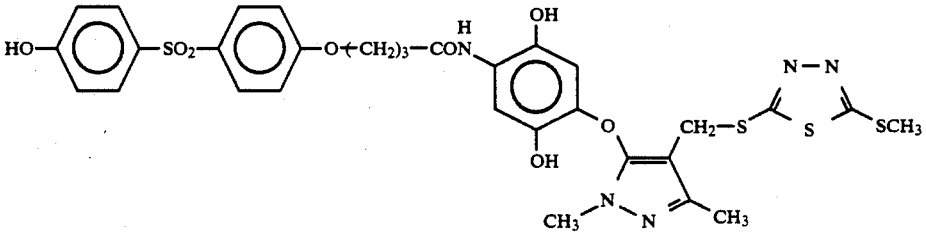

-continued
III-(14)
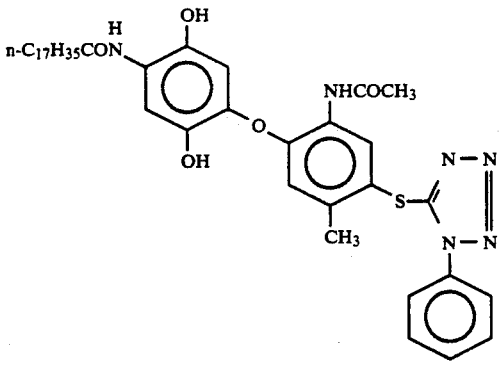
III-(15)
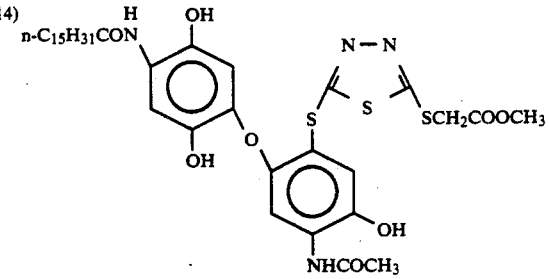
III-(16)
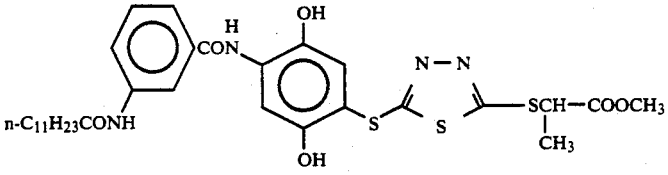
III-(17)
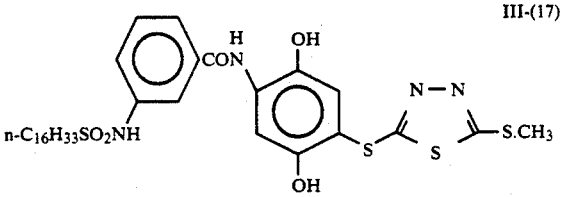
III-(18)
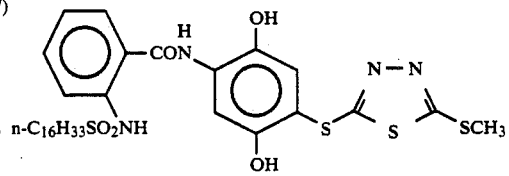
III-(19)
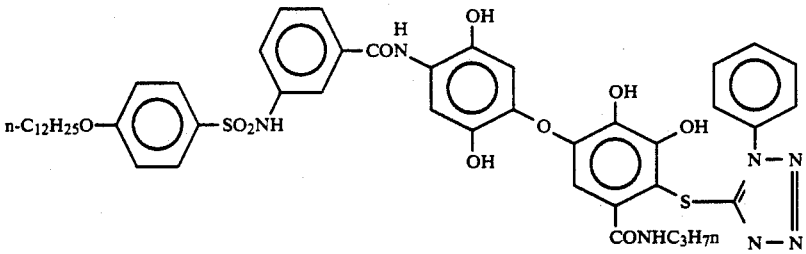
III-(20)
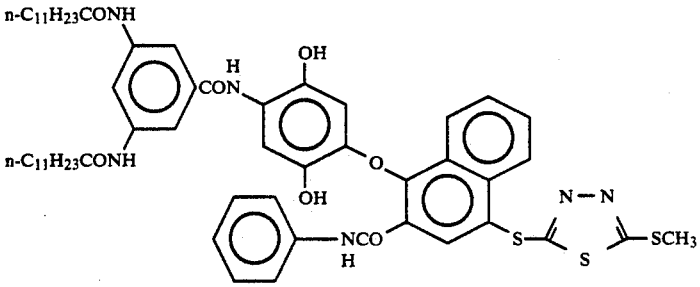

-continued
III-(21)
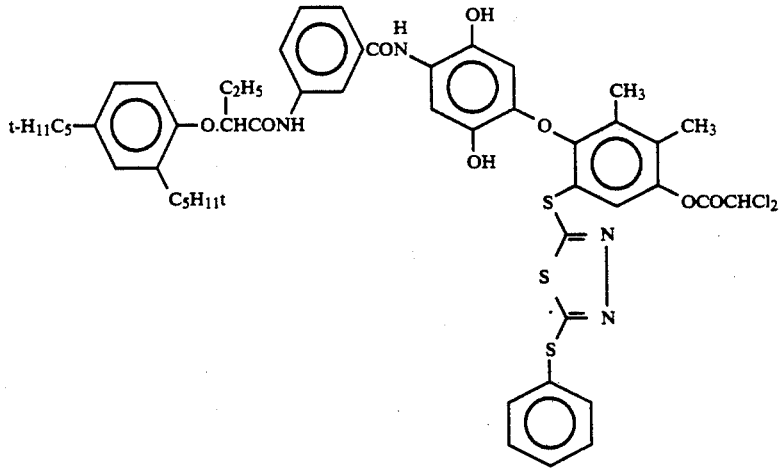
III-(22)
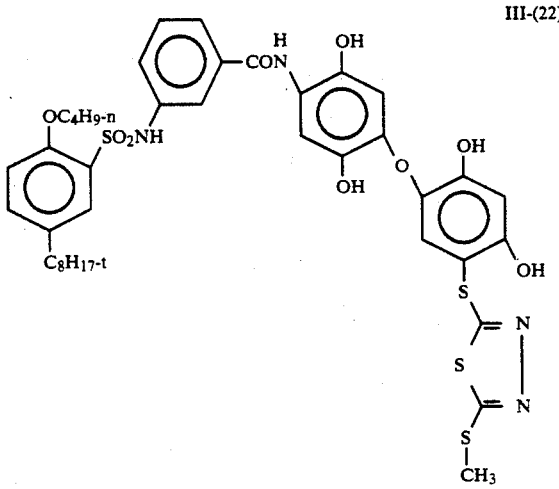
III-(23)
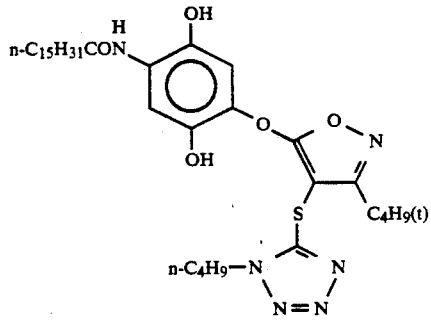
III-(24)
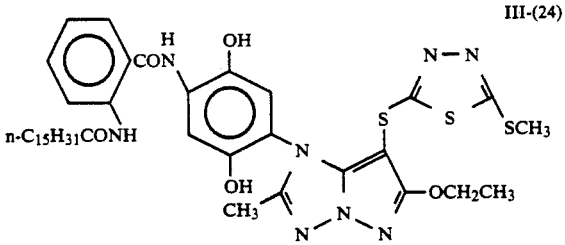
III-(25)
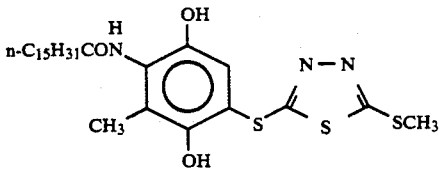
III-(26)
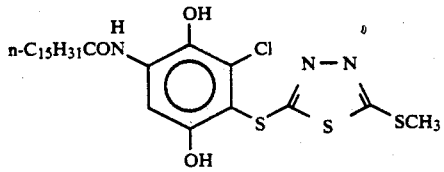
III-(27)
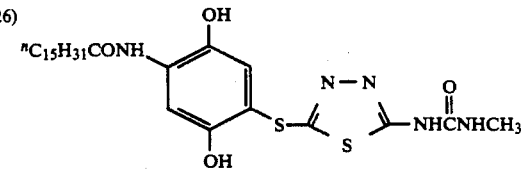

-continued
III-(28)
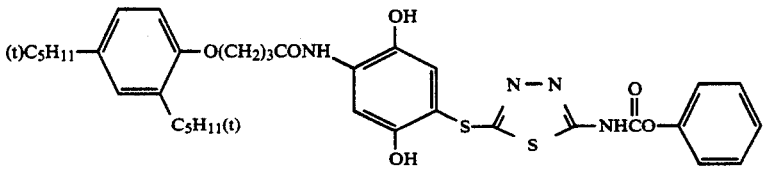
III-(29)
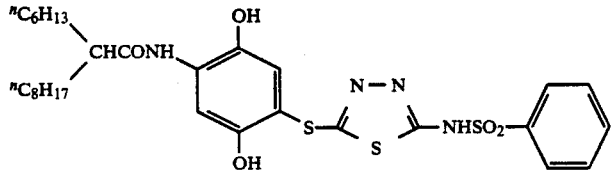
III-(30)
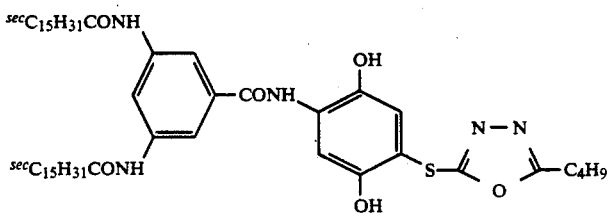
III-(31)
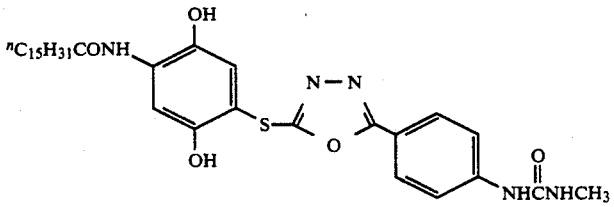
III-(32)
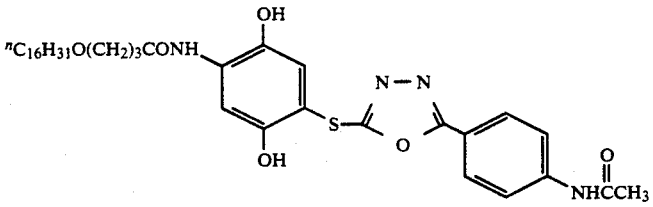
Specific examples of methods for the synthesis of these compounds will be set forth below. The synthesis of the compounds of the present invention can be easily accomplished by these methods.
SYNTHESIS EXAMPLE 1
Exemplary Compounds I-(1)
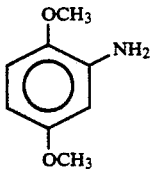
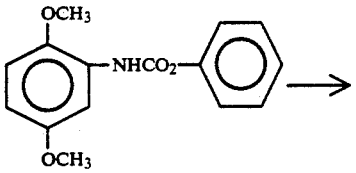
(1-A)
-continued
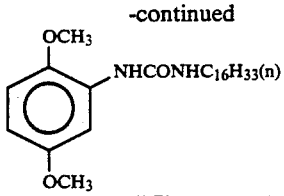
(1-B)
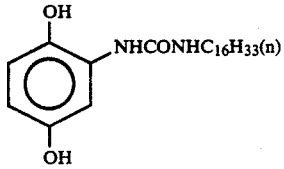
(1-C)

-continued

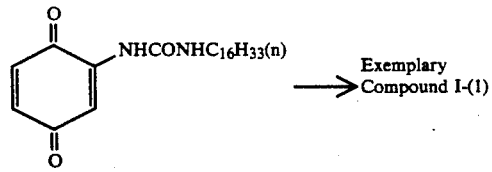

(1-D)

1) Synthesis of 1-A 400 ml of acetonitrile and 26 ml of pyridine were added to 50 g of 2,5-dimethoxyaniline. 46 g of phenylchloroformate was then added dropwise to the material. The mixture was stirred at room temperature for 3 hours. After the reaction was completed, an aqueous solution of hydrochloric acid was added to the reaction mixture. The reaction mixture was then extracted with ethyl acetate, washed with water, dried, and concentrated to obtain 50 g of the desired compound.

2) Synthesis of 1-B 300 ml of acetonitrile and 22 g of 1-hexadecylamine were added to 25 g of 1-A thus obtained. The mixture was then heated under reflux for 5 hours. After the reaction was completed, an aqueous solution of hydrochloric acid was added to the reaction mixture. The resulting crystal was filtered off, washed with acetonitrile, and then dried to obtain 35 g of the desired compound.

3) Synthesis of 1-C 250 ml of a 47% hydrobromic acid was added to 16 g of 1-B thus obtained. The mixture was then heated under reflux for 2 hours. After the reaction was completed, water was added to the reaction mixture. The resulting crystal was filtered off, washed with acetonitrile, and dried to obtain 11 g of the desired compound.

4) Synthesis of 1-D 50 ml of ethanol and 0.9 g of 2,3-dichloro-5,6-dicyano-1,4-benzoquinone were added to 1.5 g of 1-C thus obtained. The mixture was then stirred at room temperature for 30 minutes. After the reaction was completed, the resulting crystal was filtered off, and then dried to obtain 1.3 g of the desired compound.

5) Synthesis of Exemplary Compound I-(1)

150 ml of ethyl acetate was added to 1.3 g of 1-D thus obtained. Then, 0.6 g of 2-mercapto-5-methylthio-1,3,4-thiadiazole and 0.1 g of p-toluenesulfonic acid monohydride were added to the mixture. The mxiture was then stirred at a temperature of 50° C. for 1 hour. After the reaction was completed, the resulting insoluble matters were filtered off, and the filtrate was then concentrated. The residue was crystallized from acetonitrile, filtered off, and then dried to obtain 0.9 g of the desired compound. (m.p. 131.1°–133.2° C.)

SYNTHESIS EXAMPLE 2

Exemplary Compound I-(2)

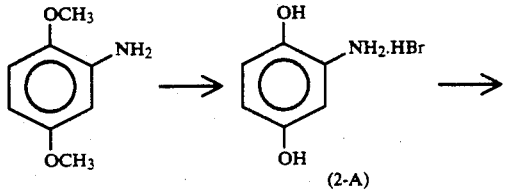

(2-A)

-continued

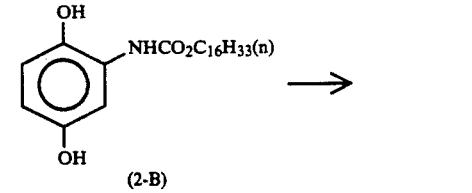

(2-B)

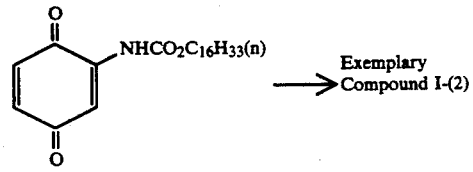

(2-C)

1) Synthesis of 2-A 450 ml of a 47% hydrobromic acid was added to 80 g of 2,5-dimethoxyaniline. The mixture was then heated under reflux for 6 hours. After the reaction was completed, the reaction mixture was concentrated. The resulting crystal was filtered off, washed with acetonitrile, and dried to obtain 87 g of the desired compound.

2) Synthesis of 2-B 300 ml of acetonitrile was added to 30 g of 2-A thus obtained. The mixture was then stirred with 28 ml of pyridine in a stream of nitrogen at room temperature for 15 minutes. A solution of 48 g of n-hexadecylchloroformate in 150 ml of N,N-dimethylacetamide was then added dropwise to the system. The system was then stirred in a stream of nitrogen at room temperature for 3 hours. After the reaction was completed, an aqueous solution of hydrochloric acid was added to the reaction mixture. The resulting crystal was filtered off, washed with acetonitrile, and then dried to obtain 54 g of the desired compound.

3) Synthesis of 2-C 50 ml of ethyl acetate and 45 g of manganese dioxide were added to 30 g of 2-B thus obtained. The mixture was then stirred at a temperature of 45° C. for 3 hours. After the reaction was completed, the resulting insoluble matters were filtered off, and the filtrate was then concentrated to obtain 23 g of the desired compound.

4) Synthesis of Exemplary Compound I-2

600 ml of methylene chloride was added to 2.0 g g of 2-C thus obtained. Then, 9.2 g of 2-mercapto-5-methylthio-1,3,4-thiadiazole and 0.5 g of p-toluenesulfonic acid monohydrate were added to the mixture. The mixture was then refluxed at room temperature for 2 hours. After the reaction was completed, the resulting crystal was filtered off, and then dried to obtain 27.8 g of the desired compound. (m.p. 135.8°–136.0° C.)

SYNTHESIS EXAMPLE 3

Exemplary Compound I-3

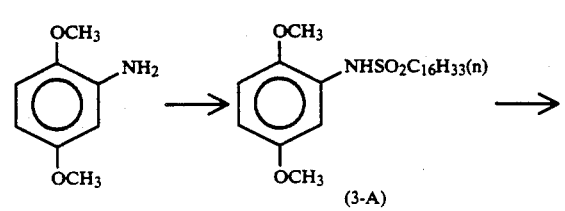

(3-A)

-continued

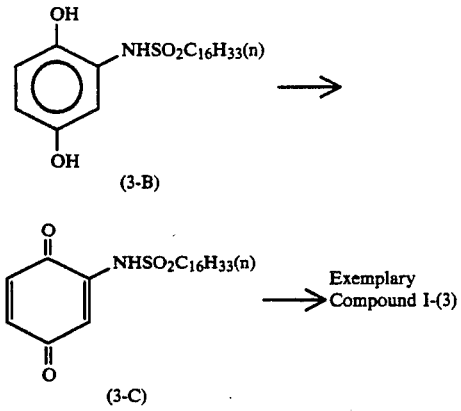

1) Synthesis of 3-A 100 ml of acetonitrile and 8 ml of pyridine were added to 15 g of 2,5-dimethoxyaniline. 36 g of 1 -hexadecanesulfonyl chloride was then added dropwise to the system. The mixture was stirred at a temperature of 40° C. for 5 hours. After the reaction was completed, the resulting crystal was filtered off, and then dried to obtain 21 g of the desired compound.

2) Synthesis of 3-B 100 ml of methylene chloride was added to 10.0 g of 3-A thus obtained. 6 ml of boron tribromide was added dropwise to the system while being cooled with ice. The system was stirred for 2 hours while being cooled with ice. Water was then added to the system. The system was extracted with ethyl acetate, washed with water, dried and then concentrated. The residue was then crystallized from acetonitrile, filtered off, and dried to obtain 7.9 g of the desired compound.

3) Synthesis of 3-C 100 ml of ethyl acetate and 10.0 g of manganese dioxide were added to 7.5 g of 3-B thus obtained. The mixture was then stirred at room temperature for 1 hour. After the reaction was completed, the resulting insoluble matters were filtered off, and the filtrate was then concentrated to obtain 7.0 g of the desired compound.

4) Synthesis of Exemplary Compound I-3

50 ml of methylene chloride was added to 6.8 g of 3-C thus obtained. Then, 3.0 g of 2-mercapto-5-methylthio-1,3,4-thiadiazole and 0.5 g of p-toluenesulfonic acid monohydrate were added to the mixture. The mixture was then stirred at room temperature for 2 hours. After the reaction was completed, the resulting crystal was filtered off, and them dried to obtain 6.0 g of the desired compound. (m.p. 133.6°–135.0° C.)

SYNTHESIS EXAMPLE 4

Exemplary Compound II-(1)

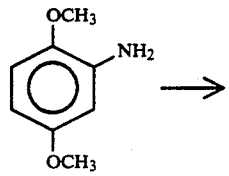

-continued

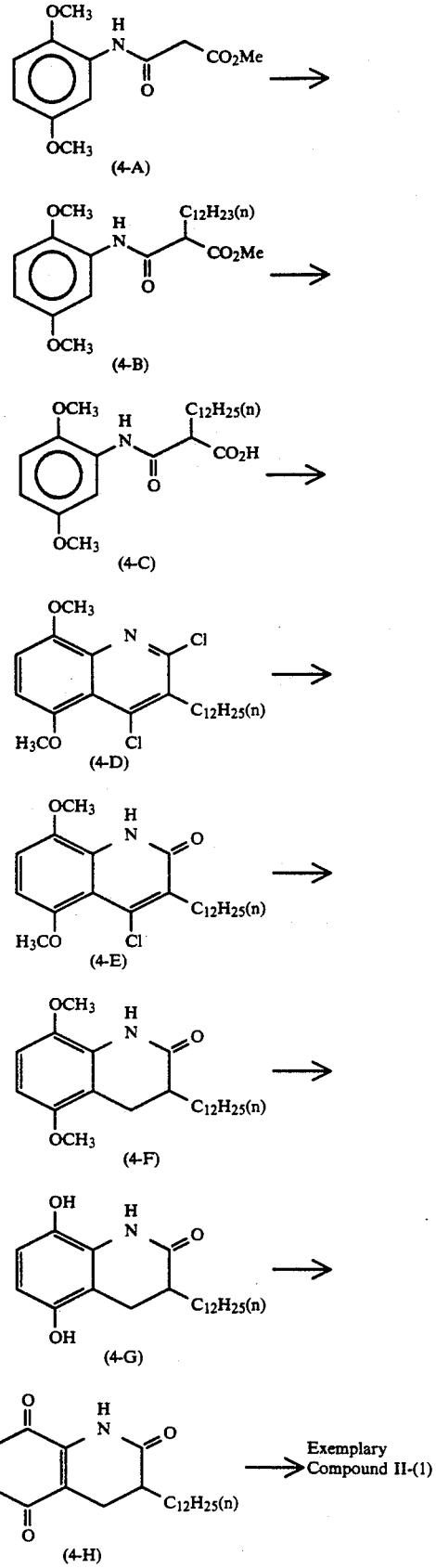

1) Synthesis of 4-A 31 g of 2,5-dimethoxyaniline and 17 ml of pyridine were added to 350 ml of acetonitrile. A solution of 20 ml of methylmalonyl chloride in 50 ml of acetonitrile was then added dropwise to the mixture. The mixture was stirred at room temperature for 5 hours. Water was added to the system. The system was then extracted with ethyl acetate, washed with water, dried, and concentrated. The residue was then crystallized from a mixture of ethyl acetate and n-hexane to obtain 31 g of the desired compound.

2) Synthesis of 4-B 50 ml of methanol was added to 5.0 g of 4-A thus obtained. Then, 3.8 g of a 28% methanol solution of sodium methoxide was added to the mixture. The mixture was stirred at room temperature for 10 minutes. 4.9 g of n-dodecyl bromide was added dropwise to the system. The reaction mixture was stirred at a temperature of 45° C. for 3 hours, allowed to cool, and them poured into water. The resulting crystal was filtered off, washed with water, and then dried. The material was recrystallized from methanol to obtain 1.9 g of the desired compound.

3) Synthesis of 4-C 30 ml of a 5% aqueous solution of sodium hydroxide and 10 ml of methanol were added to 1.8 g of 4-B thus obtained. The mixture was then stirred at a temperature of 70° to 75° C. for 2.5 hours. After being allowed to cool, the reaction mixture was poured into an aqueous solution of hydrochloric acid. The resulting crystal was filtered off, washed with water, and then dried to obtain 1.7 g of the desired compound.

4) Synthesis of 4-D 15 ml of phosphorus oxychloride was added to 3.0 g of 4-C thus obtained. The mixture was then heated under reflux for 1 hour. After being allowed to cool, the reaction mixture was gradually poured into water. The resulting crystal was filtered off, washed with water, and then dried. The material was recrystallized from methanol to obtain 2.0 g of the desired compound.

5) Synthesis of 4-E 30 ml of isopropyl alcohol and 10 ml of water were added to 2.5 of 4-D thus obtained. Then, 5 ml of concentrated sulfuric acid was added to the mixture. The reaction mixture was heated under reflux for 8.5 hours. After being allowed to cool, the reaction mixture was then poured into water. The resulting crystal was filtered off, washed with water, and then dried to obtain 2.0 g of the desired compound.

6) Synthesis of 4-F 110 ml of isopropyl alcohol and a solution of 0.3 g of sodium hydroxide in 10 ml of water were added to 3.5 g of 4-E thus obtained. Then, 1.0 g of 10% palladium carbon was added to the reaction mixture. The reaction mixture was then stirred at a temperature of 80° to 85° C. in the presence of hydrogen (20 kg/cm$^2$) for 7.5 hours. After the reaction system was allowed to cool, the catalyst was removed by filtration, and the filtrate was then concentrated. Water was poured into the residue. The resulting crystal was filtered off, washed with water, and then dried to obtain 2.7 g of the desired compound.

7) Synthesis of 4-G 40 ml of 47 % hydrobromic acid was added to 2.6 g of 4-F thus obtained. The reaction mixture was then heated under reflux for 3.5 hours. The reaction system was allowed to cool. Water was then added to the reaction system. The reaction product was extracted with ethyl acetate, washed with water, dried, and then concentrated. The residue was crystallized from acetonitrile to obtain 2.1 g of the desired compound.

8) Synthesis of 4-H 6.0 g of manganese dioxide and 150 ml of ethyl acetate were added to 2.0 g of 4-G thus obtained. The reaction mixture was then stirred at room temperature for 1.5 hours. After the resulting insoluble matter was removed by filtration, the filtrate was concentrated to obtain 1.9 g of the desired compound.

9) Synthesis of Exemplary Compound II-(1)

50 ml of methylene chloride was added to 1.8 g of 4-H thus obtained. 0.9 g of 2-mercapto-5-methylthio-1,3,4-thiadiazole and 0.1 g of p-toluenesulfonic acid monohydrate were added to the reaction mixture. The reaction mixture was then stirred at room temperature for 1 hour. The resulting crystal was filtered off, washed with acetonitrile, and then dried to obtain 1.2 g of the desired compound. (m.p. 111.3°–111.9° C.)

SYNTHESIS EXAMPLE 5

(Exemplary Compound II-(2)

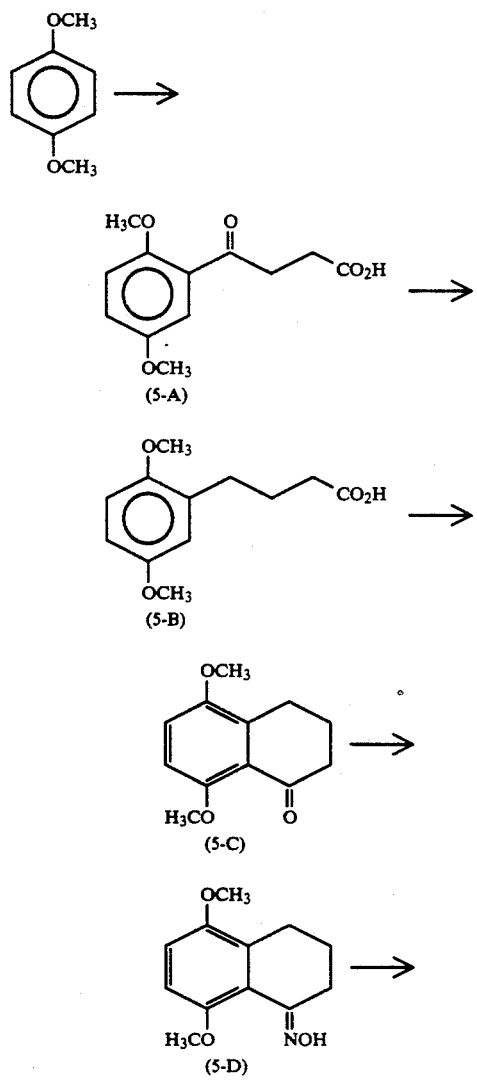

-continued

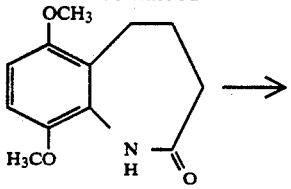

(5-E)

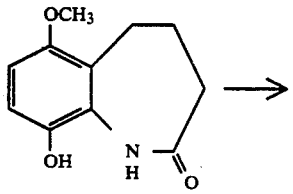

(5-F)

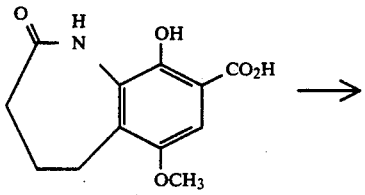

(5-G)

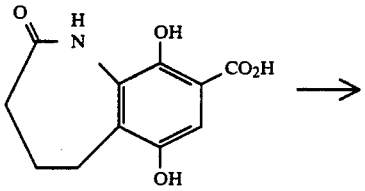

(5-H)

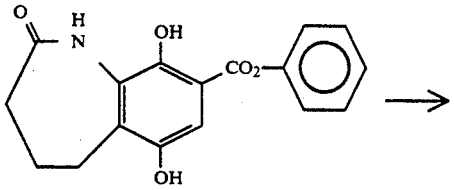

(5-I)

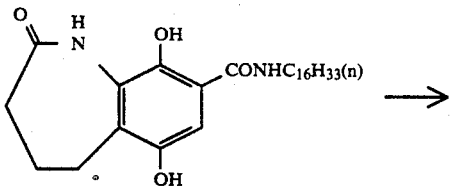

(5-J)

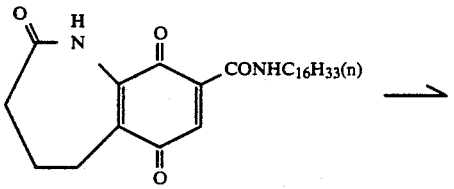

(5-K)

Exemplary Compound II-(2)

Synthesis of 5-A 200 ml of nitrobenzene was added to 30 g of succinic anhydride. 80 g of aluminum chloride was added to the reaction mixture while being cooled with ice. The reaction mixture was stirred for 30 minutes while being cooled with ice. A solution of 41 g of 1,4-dimethoxybenzene in 300 ml of nitrobenzene was added dropwise to the reaction mixture. The reaction mixture was then stirred for 3 hours while being cooled with ice. The reaction mixture was poured into ice water, extracted with ethyl acetate, washed with water, dried, and then concentrated. The residue was then crystallized from a mixture of ethyl acetate and n-hexane to obtain 38 g of the desired compound.

2) Synthesis of 5-B 100 ml of acetic acid and 100 ml of tert-butanol were added to 15 g of 5-A thus obtained. Then, 2 g of 10% palladium carbon was added to the reaction mixture. The reaction mixture was stirred at a temperature of 50° C. for 6 hours in the presence of hydrogen (50 kg/cm$^2$). After being allowed to cool, the catalyst was removed by filtration. Water was added to the reaction product. The reaction product was extracted with ethyl acetate, washed with water, dried, and then concentrated to obtain 12 g of the desired compound.

3) Synthesis of 5-C 100 ml of toluene was added to 10 g of 5-B thus obtained. 23 ml of thionyl chloride was then added dropwise to the reaction mixture. The reaction mixture was then stirred at a temperature of 70° to 80° C. for 2 hours, allowed to cool, and concentrated. 70 ml of methylene chloride was added to the residue. The reaction mixture was then added dropwise to a solution of 6 g of aluminum chloride in 50 ml of methylene chloride while being cooled with ice. After being cooled with ice for 2 hours, the reaction mixture was poured into ice water, extracted with ethyl acetate, washed with water, dried, and then concentrated to obtain 6 g of the desired compound.

4) Synthesis of 5-D 38 ml of ethanol and 13 ml of water were added to 4.5 g of 5-C thus obtained, 1.5 g of hydroxylamine hydrochloride and 3.9 g of sodium acetate. The reaction mixture was then heated under reflux for 5 hours. The reaction product was allowed to cool. Water was added to the reaction product. The resulting crystal was filtered off, washed with water, and then dried to obtain 4.6 g of the desired compound.

5) Synthesis of 5-E 10.0 g of polyphosphoric acid was added to 4.5 g of 5-D thus obtained. The reaction mixture was stirred at a temperature of 90° C. for 1.5 hours. The reaction mixture was allowed to cool. Water was added to the reaction product. The reaction product was extracted with ethyl acetate, washed with water, dried, and then concentrated to obtain 4.1 g of the desired compound.

6) Synthesis of 5-F 100 ml of methylene chloride was added to 4.0 g of 5-E thus obtained. 4.5 g of boron tribromide was then added dropwise to the reaction mixture while being cooled with ice. The reaction mixture was stirred for 3 hours while being cooled with ice. Water was then added to the reaction system. The reaction product was extracted with methylene chloride, washed with water, dried, and then concentrated to obtain 3.6 g of the desired compound.

7) Synthesis of 5-G 50 ml of dimethyl formamide was added to 3.5 g of 5-F thus obtained and 9.3 g of potassium carbonate. The reaction mixture was then stirred at a temperature of 170° C. in the presence of carbon dioxide (40 kg/cm$^2$) for 7 hours. The reaction system was then allowed to cool. An aqueous solution of hydrochloric acid was then added to the reaction system. The resulting crystal was filtered off, washed with water, and then dried to obtain 3.3 g of the desired compound.

8) Synthesis of 5-H 50 ml of 47% hydrobromic acid was added to 3.3 g of 5-G thus obtained. The reaction mixture was then heated under reflux for 3 hours. The reaction system was allowed to cool. Water was added to the reaction system. The resulting crystal was filtered off, washed with water, and then dried to obtain 3.1 g of the desired compound.

9) Synthesis of 5-I 4.1 g of triphenyl phosphate and 0.1 ml of phosphorus trichloride were added to 3.1 g of 5-H thus obtained. The reaction mixture was then stirred at a temperature of 110° C. for 3.5 hours. The reaction system was then allowed to cool. Water was added to the reaction system. The reaction system was extracted with ethyl acetate, washed with water, dried, and then concentrated to obtain 3.1 g of the desired compound.

10) Synthesis of 5-J 50 ml of acetonitrile was added to 3.0 g of 5-I thus obtained and 2.3 g of n-hexadecylamine. The reaction mixture was then heated under reflux for 3 hours. The reaction mixture was then allowed to cool. The reaction mixture was concentrated. The residue was crystallized from a mixture of ethyl acetate and n-hexane to obtain 3.6 g of the desired compound.

11) Synthesis of 5-K 50 ml of ethyl acetate was added to 3.5 g of 5-J thus obtained and 5.0 g of manganese dioxide. The reaction mixture was then stirred at room temperature for 4 hours. After the resulting insoluble matter was removed by filtration, the filtrate was then concentrated to obtain 3.2 g of the desired compound.

12) Synthesis of Exemplary Compound II-(2)

50 ml of methylene chloride was added to 3.0 g of 5-K thus obtained. Then, 1.1 g of 2-mercapto-5-methylthio-1,3,4-thiadiazole and 0.1 g of p-toluenesulfonic acid monohydrate were added to the reaction mixture. The reaction mixture was then stirred at room temperature for 2 hours. The resulting crystal was filtered off, washed with water, and then dried to obtain 2.7 g of the desired compound. (m.p. 123.4°–127.1° C.)

SYNTHESIS EXAMPLE 6

Exemplary Compound II-(4)

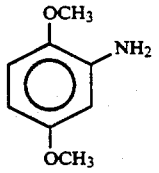

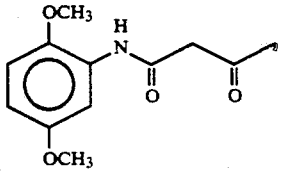

(6-A)

-continued

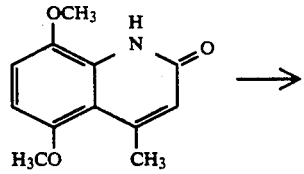

(6-B)

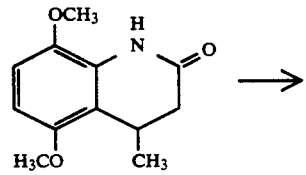

(6-C)

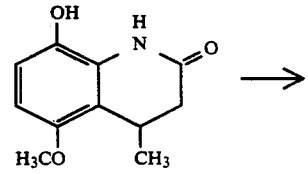

(6-D)

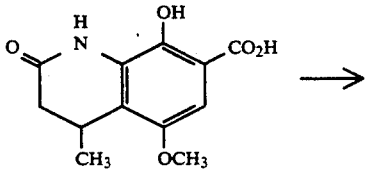

(6-E)

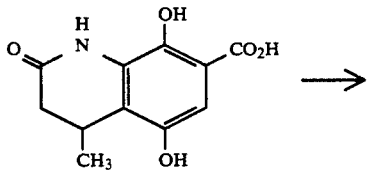

(6-F)

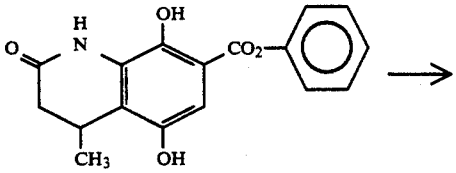

(6-G)

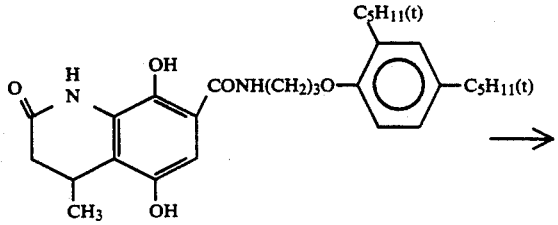

(6-H)

-continued

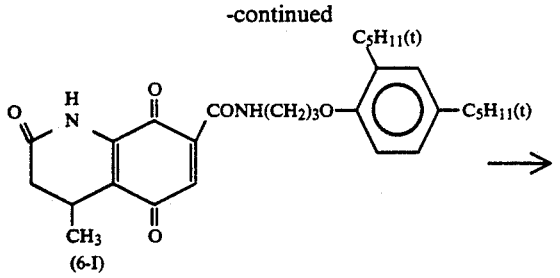

(6-I)

Exemplary Compound II-(4)

1) Synthesis of 6-A 300 ml of acetonitrile was added to 150 g of 2,5-dimethoxyaniline and 87 ml of pyridine. 69 ml of diketene was added dropwise to the mixture. The reaction mixture was then heated under reflux for 2 hours. The reaction system was allowed to cool. Water was then added to the reaction system. The reaction system was extracted with ethyl acetate, washed with water, dried, and then concentrated. The residue was crystallized from a mixture of ethyl acetate and n-hexane to obtain 130 g of the desired compound.

2) Synthesis of 6-B 210 ml of acetic acid was added to 15 g of 6-A thus obtained. 7 ml of concentrated sulfuric acid was then added dropwise to the mixture. The reaction mixture was stirred at a temperature of 45° C. for 4.5 hours. The reaction system was allowed to cool. The resulting crystal was filtered off, washed with water, and then dried to obtain 13 g of the desired compound.

3) Synthesis of 6-C 80 ml of ethanol was added to 6-B thus obtained. 1.0 g of 10% palladium carbon was then added to the mixture. The reaction mixture was stirred at a temperature of 80° to 85° C. in the presence of hydrogen (30 kg/cm$^2$) for 7 hours. The reaction system was allowed to cool. The catalyst was filtered off, and the filtrate was then concentrated to obtain 2.1 g of the desired compound.

4) Synthesis of 6-D 50 ml of methlene chloride was added to 2.0 g of 6-C thus obtained. 2.3 g of boron tribromide was added dropwise to the reaction mixture while being cooled with ice. The reaction system was then stirred while being cooled with ice for 3 hours. Water was added to the reaction system. The reaction product was extracted with methylene chloride, washed with water, and then dried to obtain 1.8 g of the desired compound.

5) Synthesis of 6-E 40 ml of dimethylformamide was added to 1.7 g of 6-D thus obtained and 4.5 g of potassium carbonate. The reaction mixture was then stirred at a temperature of 170° C. in the presence of carbon dioxide (40 kg/cm$^2$) for 7 hours. The reaction system was then allowed to cool. An aqueous solution of hydrochloric acid was then added to the reaction system. The resulting crystal was filtered off, washed with water, and then dried to obtain 1.5 g of the desired compound.

6) Synthesis of 6-F 40 ml of 47% hydrobromic acid was added to 1.4 g of 6-E thus obtained. The reaction mixture was then heated under reflux for 5 hours. The reaction system was allowed to cool. Water was added to the reaction system. The reaction product was extracted with ethyl acetate, washed with water, dried, and then concentrated to obtain 1.3 g of the desired compound.

7) Synthesis of 6-G 1.6 g of triphenyl phosphate and 0.1 ml of phosphorus trichloride were added to 1.2 g of 6-F thus obtained. The reaction mixture was then stirred at a temperature of 110° C. for 4 hours. The reaction system was then allowed to cool. Water was added to the reaction system. The reaction system was extracted with ethyl acetate, washed with water, dried, and then concentrated to obtain 1.4 g of the desired compound.

8) Synthesis of 6-H 30 ml of acetonitrile was added to 1.3 g of 6-G thus obtained and 1.2 g of 3-(2',4'-di-tert-amylphenoxy)-propylamine. The reaction mixture was then heated under reflux for 3 hours. The reaction mixture was then allowed to coo.1 and then concentrated. The residue was crystallized from n-hexane to obtain 1.8 g of the desired compound.

9) Synthesis of 6-I 30 ml of ethyl acetate was added to 1.7 g of 6-H thus obtained and 2.5 g of manganese dioxide. The reaction mixture was then stirred at room temperature for 2 hours. After the resulting insoluble matter was removed by filtration, the filtrate was then concentrated to obtain 1.6 g of the desired compound.

10) Synthesis of Exemplary Compound II-(4)

30 ml of methylene chloride was added to 1.5 g of 6-I thus obtained. Then, 0.5 g of 2-mercapto-5-methylthio-1,3,4-thiadiazole and 0.1 g of p-toluenesulfonic acid monohydrate were added to the reaction mixture. The reaction mixture was then stirred at room temperature for 2 hours. The resulting crystal was filtered off, washed with water, and then dried to obtain 1.4 g of the desired compound. (m.p. 118.3°-121.0° C.)

SYNTHESIS EXAMPLE 7

Synthesis of Compound III-(1)

1) Synthesis of 2,5-dimethoxy-n-hexadecanoylanilide (7-1)

153 g of 2,5-dimethoxyaniline and 97 ml of pyridine were mixed with 1 l of acetonitrile. 275 g of n-hexadecanoyl chloride was then added dropwise to the reaction mixture while being cooled with ice. The reaction system was stirred at room temperature for 1 hour. The resulting crystal was filtered off, washed with acetonitrile, and then dried to obtain 313 g of the desired compound.

2) Synthesis of n-hexadecanoylaminohydroquinone (7-2)

114 g of (7-1) thus obtained was dissolved in 500 ml of toluene. 117 g of aluminum chloride was gradually added to the solution while being stirred over an oil bath at a temperature of 50° C. The reaction mixture was then stirred over an oil bath at a temperature of 50° C. for 2 hours. The temperature of the oil bath was raised to 80° C. and the reaction system was further stirred for 1 hour. After the reaction was completed, the temperature of the reaction mixture was returned to room temperature. The reaction system was then gradually poured into ice water. The resulting crystal was filtered off, washed with water and then with acetonitrile, and then dried to obtain 103.7 g of the desired compound.

3) Synthesis of n-hexadecanoylaminobenzoquinone (7-3)

30 g of (7-2) thus obtained was dissolved in 600 ml of ethyl acetate. 60 g of manganese dioxide was then added to the solution. The reaction mixture was stirred at room temperature for 4 hours. The reaction mixture was filtered off at an elevated temperature, and the filtrate was then concentrated. The concentrate was recrystallized from acetonitrile to obtain 27 g of the desired compound.

4) Synthesis of Compound (III-1)

11.5 g of 2-mercapto-5-methylthio-1,3,4-thiadiazole and 2 g of p-toluenesulfonic acid were dissolved in 200 ml of chloroform. 25 g of (7-3) obtained in step 3) was added to the solution at room temperature while stirring.

The reaction mixture was then stirred at room temperature for 30 minutes. The resulting crystal was filtered off. The resulting crude crystal was recrystallized with acetonitrile to obtain 31 g of a colorless crystal of the desired compound (III-(1)). (m.p. 165°-166° C.)

SYNTHESIS EXAMPLE 8

Synthesis of Compound III-(17)

1) Synthesis of m-nitrobenzoic acid-2,5-dimethoxyanilide (8-1)

26 ml of thionyl chloride was added dropwise to a solution of 56.1 g of m-nitrobenzoic acid in 300 ml of acetonitrile while being cooled with ice. 52.1 g of 2,5-dimethoxyaniline was added to the reaction mixture. The reaction system was stirred at room temperature for 30 minutes. The resulting crystal was filtered off. The crude crystal thus obtained was recrystallized from acetonitrile to obtain 61 g of the desired compound.

2) Synthesis of m-nitrobenzoic acid-2,5-dimethoxyanilide (8-21)

A mixture of 45 g of reduced iron, 4.5 g of ammonium chloride, 60 ml of water and 400 ml of isopropanol was stirred at an elevated temperature over a steam bath. 60 g of (8-1) thus obtained was gradually added to the reaction system. The reaction system was heated under reflux for 1 hour. The reaction mixture was cooled to room temperature where iron powder was removed by filtration. The filtrate was concentrated. The residue was dissolved in ethyl acetate, washed with water, and dried. The solvent was then distilled off. As a result, 53 g of the desired compound was obtained in the form of oily matter.

3) Synthesis of m-hexadecanesulfonamidobenzoic acid-2,5-dimethoxyanilide (8-3)

20 g of (8-2) thus obtained was dissolved in 100 ml of acetonitrile and 7.1 ml of pyridine. 26.3 g of hexadecanesulfonyl chloride was added to the solution. The reaction mixture was heated to a temperature of 60° C. where it was then stirred for 3 hours. 100 ml of water was then added to the reaction system. The resulting crystal was filtered off. The crude crystal thus obtained was recrystallized from acetonitrile to obtain 35 g of the desired compound.

4) Synthesis of m-hexadecanesulfonamidobenzamido hydroquinone (8-4)

15 g of (8-3) thus obtained was dissolved in 200 ml of toluene. 12.5 g of aluminum chloride was added to the solution at room temperature. The reaction mixture was then stirred over an oil bath at a temperature of 40° C. for 30 minutes. The temperature of the oil bath was raised to 90° C. and the reaction system was further stirred for 2 hours. After the reaction was completed, the reaction mixture was poured into ice water. The resulting crystal was filtered off, washed with water and then with acetonitrile at an elevated temperature to obtain 11 g of the desired compound.

5) Synthesis of m-hexadecanesulfonamidobenzamidobenzoquinone (8-5)

11 g of (8-4) thus obtained was dissolved in 300 ml of chloroform and 50 ml of dimethylacetamide. 20 g of manganese dioxide was then added to the solution. The reaction mixture was stirred at room temperature for 1 hour.

The reaction mixture was filtered off, and the filtrate was then concentrated. Water was added to the concentrate. The resulting crystal was filtered off, and then washed with acetonitrile to obtain 8.7 of the desired compound.

6) Synthesis of Compound (III-(17))

8.7 g of (8-5) thus obtained was dispersed in 60 ml of chloroform. 2.7 g of 2-mercapto-5-methylthio-1,3,4-thiadiazole and 0.5 g of p-toluenesulfonic acid were added to the reaction mixture. The reaction mixture was then stirred at room temperature for 1 hour.

The resulting crystal was filtered off, and then recrystallized from acetonitrile to obtain 7.2 g of a colorless crystal of the desired compound (III-(17)). (m.p. 189°-190° C.)

The present color photographic light sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers containing a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the desired application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided further from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order toward the support. In another embodiment, BH, BL, GL, GH, RH, and RL can be arranged in this order toward the support. In a further embodiment, BH, BL, GH, GL, RL, and RH can be arranged in this order toward the support.

As described in JP-B-55-34932 (the term "JP-B" as used herein means an "examined Japanese patent publication"), a blue-sensitive layer, GH, RH, GL, and RL can be arranged in this order toward the support. Alternatively, as described in JP-A-56-25738 and 62-63936, a blue-sensitive layer, GL, RL, GH, and RH can be arranged in this order toward the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangment, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order toward the support in a color-sensitive layer as described in JP-A-59-2024643.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer can be arranged in this order.

In the case where the layer structure comprises four or more layers, the order of arrangement of the layers can also be altered as described above.

In order to improve the color reproducibility, a donor layer (CL) described in U.S. Pat. Nos. 4,663,271, 4,705,744 and 4,707,436 and JP-A-62-160448 and JP-A-63-89850 and having an interimage effect and a different spectral sensitivity distribution from the main light-sensitive layer such as BL, GL and RL may be preferably provided adjacent or close to the main light-sensitive layer.

As described above, various layer structures and arrangements can be selected depending on the purpose of the light-sensitive material.

A suitable silver halide to be incorporated in the photographic emulsion layer in the present color light-sensitive material for photographing is silver bromoiodide, silver chloroiodide or silver bromochloroiodide containing silver iodide in an amount of about 30 mol % or less. Particularly suitable is silver bromoiodide containing silver iodide in an amount of about 2 mol % to about 25 mol %.

Silver halide grains in the photographic emulsions may be so-called regular grains having a regular crystal form, such as a cube, an octahedron and a tetradecahedron, or those having an irregular crystal form such as a sphere and a tabular form, those having a crystal defect such as a twinning plane, or those having a combination of these crystal forms.

The silver halide grains may be either fine grains of about 0.2 μm or smaller in diameter or giant grains having a projected area diameter of up to about 10 μm, preferably fine grains having a diameter of 0.1 to 0.2 μm. The emulsion may be either a monodisperse emulsion or a polydisperse emulsion.

The preparation of the silver halide photographic emulsion which can be used in the present invention can be accomplished by any suitable method as described in Research Disclosure No. 17643 (Dec. 1978), pp. 22–23, "I. Emulsion Preparation and Types", and No. 18716 (Nov. 1979), page 648, *Research Disclosure* No. 307105 (Nov. 1989), pages 863–865, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394 can be preferably used in the present invention.

Tabular grains having an aspect ratio of about 5 or more can be used in the present invention. The preparation of such tabular grains can be easily accomplished by any suitable method as described in Gutoff, "Photograpahic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction. Mixtures of grains having various crystal forms may also be used.

The silver halide emulsion to be used in the present invention is normally subjected to physical ripening, chemical ripening and spectral sensitization. Additives to be used in these steps are described in Research Disclosure Nos. 17643 and 18716 as tabulated below.

In the present invention, finely divided light-insensitive silver halide grains are preferably used. Finely divided light-insensitive silver halide grains are finely divided silver halide grains which are not sensitive to light upon imagewise exposure for obtaining color images and are not substantially developed. Preferably, finely divided light-insensitive silver halide grains are not previously fogged.

Finely divided silver halide grains have a silver bromide content of 0 to 100 mol % and may optionally contain silver chloride and/or silver iodide, preferably 0.5 to 10 mol % of silver iodide.

Finely divided silver halide grains preferably have an average grain diameter of 0.01 to 0.5 μm (as calculated in terms of the average diameter of a projected area corresponding to a sphere), more preferably 0.02 to 0.2 μm.

The preparation of finely divided silver halide grains can be accomplished in the same manner as ordinary light-sensitive silver halide. In this case, the surface of the silver halide grains does not need to be optically sensitized. Also, silver halide grains do not need to be spectrally sensitized. However, before being added to the coating solution, the silver halide emulsion preferably comprises a known stabilizer such as a triazole, an azaindene, a benzothiazolium or a mercapto compound incorporated therein.

Known photographic additives which can be used in the present invention are also described in the above cited two references as shown in the following table.

| Kind of additive | RD17643 [Dec. '78] | RD18716 [Nov. '79] | RD307105 [Nov. '89] |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and super-sensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 LC | p. 873 |
| 7. Stain inhibitor | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 650 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

In order to inhibit a deterioration in the photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couplers can be used in the present invention. Specific examples of the color couplers are described in the patents described in the above cited Research Disclosure No. 17643, VII-C to G and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (Jun. 1984) and 24230 (Jun. 1984), and WO(PCT)88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Laid-Open No. 3,329,729, European Patents 121,365A and 249,453A, and JP-A-61-42658.

Typical examples of polymerized dye-forming couplers are described in U.S. Pat. Nos. 3,451,820, 4,080,211, 4,367,282, 4,409,320, and 4,576,910, British Patent 2,102,173, and European Patent 341,188A.

Couplers which form a dye having a moderate diffusibility preferably include those described in U.S. Pat. No. 4,366,237, British Patent 2,125,570, European Patent 96,570, and West German Patent Publication No. 3,234,533.

Colored couplers for correction of unnecessary absorptions of the developed color preferably include those described in Research Disclosure No. 17643, VII-G, U.S. Pat. Nos. 4,163,670, 4,004,929, and 4,138,258, JP-B-57-39413, and British Patent 1,146,368. Furthermore, couplers for correction of unnecessary absorptions of the developed color by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can be preferably used.

Couplers capable of releasing a photographically useful residual upon coupling can also be used in the present invention. Preferred examples of DIR couplers which release a developing inhibitor are described in the patents cited in RD 17643, VII-F, and No. 307105, VII-F, JP-A-57-151944, JP-A-57-154234, JP-A-60-184248, and JP-A-63-37346, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds or DIR couplers or DIR coupler-releasing couplers as described in JP-A-60-185950 and JP-A-62-24252, couplers capable of releasing a dye which returns to its original color after release as described in European Patents 173,302A and 313,308A, couplers capable of releasing a bleach accelerator as described in RD Nos. 11449 and 24241, and JP-A-61-201247, couplers capable of releasing a ligand as described in U.S. Pat. No. 4,553,477, couplers capable of releasing a leuco dye as described in JP-A-63-75747, and couplers capable of releasing a fluorescent dye as described in U.S. Pat. No. 4,774,181.

The incorporation of these couplers in the light-sensitive material can be accomplished by any suitable known dispersion method.

Examples of high boiling point solvents to be used in an oil-in-water dispersion process are described in U.S. Pat. No. 2,322,027.

Specific examples of high boiling point organic solvents having a boiling point of 175° C. or higher at normal pressure which can be used in an oil-in-water dispersion process include phthalic esters (e.g., dibutyl phthalate, dicylcohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic acid esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of a latex dispersion method and specific examples of latexes to be used in dipping are described in U.S. Pat. No. 4,199,363, West German Patent Application (OLS) 2,541,274, and 2,541,230.

Various preservatives or antimold agents such as 1,2-benzisothiazoline-3-one, n-butyl, p-hydroxybenzoate, phenol, 4-chloro-3,5-dimethylphenol, 2-phenoxyethanol, and 2-(4-thiazolyl)benzimidazole as described in JP-A-63-257747, 62-272248, and 1-80941 may be preferably incorporated in the present color light-sensitive material.

The present invention is applicable to various types of color light-sensitive materials, particularly preferably to color negative films for common use or motion picture, color reversal films for slide or television, color papers, color positive films and color reversal papers.

Suitable supports which can be used in the present invention are described in the above cited RD 17643 (page 28) and 18716 (right column on page 647 to left column on page 648).

In the present light-sensitive material, the total thickness of all the hydrophilic colloidal layers on the emulsion side is preferably in the range of 28 μm or less, more preferably 23 μm or less, particularly 20 μm or less. The film swelling rate $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling rate $T_{\frac{1}{2}}$ can be determined by a method known in the art, e.g., by means of a swellometer of the type described in A. Green et al, "Photographic Science Engineering", vol. 19, No. 2, pp. 124–129. $T_{\frac{1}{2}}$ is defined as the taken until half the saturated film thickness is reached wherein the saturated film thickness is 90% of the maximum swollen film thickness reached when the light-sensitive material is processed with a color developer at a temperature of 30° C. for 195 seconds.

The film swelling rate $T_{\frac{1}{2}}$ can be adjusted by adding a film hardener to gelatin as binder or altering the ageing condition after coating. The percentage of swelling of the light-sensitive material is preferably in the range of 150 to 400%. The percentage of swelling can be calculated from the maximum swollen film thickness determined as described above in accordance with the equation: (maximum swollen film thickness − film thickness)/film thickness.

The color photographic light-sensitive material according to the present invention can be developed in accordance with an ordinary method as described in RD Nos 17643 (pp. 28–29), 18716 (left column—right column on page 651) and 307105 (pp. 880–881).

The color developer to be used in the development of the present light-sensitive material is preferably an alkaline aqueous solution containing as a main component an aromatic primary amine color developing agent. An aminophenolic compound can be effectively used as a color developing agent. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these cgmpounds is 3-methyl-4-amino-N-ethyl-N-β-hydroxyethylaniline sulfate. These compounds can be used in combination of two or more thereof depending on the desired application.

The color developer normally contains a pH buffer such as a carbonate and a phosphate of an alkaline metal or a development inhibitor or fog inhibitor such as bromides, iodides, benzimidazoles, benzothiazoles and mercapto compounds. If desired, the color developer may further contain various preservatives, e.g., hydroxylamine, diethylhydroxylamine, sulfites, hydrazines (e.g., N,N-biscarboxymethyl hydrazine), phenylsemicarbazides, triethanolamine, and catecholsulfonic acids; organic solvents, e.g., ethylene glycol and diethylene glycol; development accelerators, e.g., benzyl alcohol, polyethylene glycol, quaternary ammonium salts, and amines; color-forming couplers; competing couplers; auxiliary developing agents, e.g., 1-phenyl-3-pyrazolidone; viscosity-imparting agents; various chelating agents exemplified by aminopolycarboxylic acids, aminopolyphosphoric acids, alkylphosphonic acids, and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

Reversal processing is usually carried out by black-and-white development followed by color development. Black-and-white developers to be used can contain one or more of the known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 l or less per $m^2$ of the light-sensitive material. However, the replenishment rate depends on the type of color photographic material to be processed. The replenishment rate may be reduced to 500 ml/$m^2$ or less by decreasing the bromide ion concentration in the replenisher. When the replenishment rate is reduced, it is preferable to reduce the area of the liquid surface in contact with air in the processing tank to prevent evaporation and air-oxidation of the liquid.

The area of the liquid surface in contact with air can be represented by the opening value defined as follows:

$$\text{Opening value} = \frac{\text{Area of liquid surface in contact with air } (cm^3)}{\text{volume of liquid } (cm^3)}$$

The opening value is preferably in the range of 0.1 or less, more preferably 0.001 to 0.05. The reduction of the opening value can be accomplished by providing a cover such as floating cover on the surface of a photographic processing solution in the processing tank, or by a process which comprises the use of a mobile cover as described in JP-A-1-82033, or a slit development process as described in JP-A-63-216050. The reduction of the opening value can be applied not only to color development and black-and-white development but also to the subsequent steps such as bleach, blix, fixing, rinse and stabilization. The replenishment rate can also be reduced by a means for suppressing accumulation of the bromide ion in the developing solution.

The color development time is normally selected between 2 and 5 minutes. The color development time can be further reduced by carrying out color development at an elevated temperaure and at a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up processing, bleach may be followed by blix. Further, when two blix baths connected in series are used, an embodiment wherein blix is preceded by fixation, and an embodiment wherein blix is followed by bleach may be arbitrarily selected according to the intended purpose. Bleaching agents to be used include compounds of polyvalent metals, e.g., iron (III), peroxides, quinones, and nitro compounds. Typical examples of these bleaching agents are organic complex salts of iron (III) with aminopolycarboxylic acis, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetato)iron (III) complex salts are preferred in view of speeding up processing and conservation of the environment. In particular, aminopolycarboxylic acid-iron (III) complex salts are useful in both a bleaching solution and a blix solution. The bleaching or blix solution comprising such an aminopolycarboxylic acid-iron (III) complex salt normally has a pH value of 4.0 to 8.0. For speeding up processing, it is possible to adopt a lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patent 1,290,812, and 2,059,988, JP-A-53-32736, JP-A-53-57831, JP-A-53-37418, JP-A-53-72623, JP-A-95630, JP-A-53-95631, JP-A-53-104232, JP-A-53-124424 JP-A-53-141623, and JP-A-53-28426, and Research Disclosure No. 17129 (July 1978), thiazolidine derivatives as described in JP-A-50-140129, thiourea derivatives as described in JP-B-45-8506, JP-A-52-20832, JP-A-53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A-49-40943, JP-A-49-59644, JP-A-53-94927, JP-A-54-35727, JP-A-55-26506, and JP-A-58-163940, and bromine ions. Preferred among these compounds are compounds containing a mercapto group or a disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for photography.

The bleaching solution or the blix solution to be used in the present invention may preferably comprise an organic acid besides the above mentioned compounds for the purpose of inhibiting bleach stain. A particularly preferred organic acid is a compound having an acid dissociation constant (pKa) of 2 to 5. Specific examples of such an organic acid include acetic acid and propionic acid.

Fixing agents to be used for fixation include thiosulfates, thiocyanates, thioethers, thioureas, and a large amount of iodides. The thiosulfates are normally used, with ammonium thiosulfate being applicable most broadly. These thiosulfates may be preferably used in combination with thiocyanates, thioether compounds, thiourea or the like. As preservatives for the fixing bath or the blix bath there can be preferably used sulfites, bisulfites, carbonyl bisulfite adducts or sulfinic acid compounds as described in European Patent 294769A. Further, various aminopolycarboxylic acids or organic phosphonic acids can be added to the fixing bath or blix bath for the purpose of stabilizing the solution.

In the present invention, the fixing solution or blix solution preferably comprises a compound having a pKa of 6.0 to 9.0, preferably imidazole such as imidazole, 1-methylimidazole, 1-ethylimidazole and 2-methylimidazole, in an amount of 0.1 to 10 mol/l.

The total desilvering time is preferably short so long as poor desilvering does not take place. The total desilvering time is preferably in the range of 1 to 3 minutes, more preferably 1 to 2 minutes. The desilvering temperature is in the range of 25° to 50° C., preferably 35° to 45° C. In this preferred temperature range, the desilvering rate can be improved, and the occurrence of stain after processing can be effectively inhibited.

In the desilvering step, the agitation is preferably intensified as much as possible. In particular, the agitation can be intensified by various methods. For example, the processing solution may be jetted to the surface of the emulsion layer in the light-sensitive material as described in JP-A-62-183460 and JP-A-62-183461. The agitating effect can be improved by a rotary means as described in JP-A-62-183461. Furthermore, the agitating effect can be improved by moving the light-sensitive material with the emulsion surface in contact with a wiper blade provided in the bath so that turbulence occurs on the emulsion surface. Moreover, the agitation can be intensified by increasing the total circulated amount of processing solution. Such an agitation improving method can be effectively applied to the bleaching bath, the blix bath or the fixing bath. The improvement in agitation effect expedites the supply of a bleaching agent, fixing agent or the like into the emulsion film, resulting in an improvement in the desilvering rate. The above mentioned agitation improving method is more effective when a bleach accelerator is used. In this case, the agitation improving method can remarkably enhance the bleach accelerating effect or eliminate the effect of inhibiting fixation by the bleach accelerator.

The automatic developing machine to be used in the present invention is preferably equipped with a light-sensitive material conveying means as described in JP-A-60 191257, JP-A-60-191258, and JP-A-60-191259. As described in the above cited JP-A-60-191257, such a conveying means can remarkably reduce the amount of the processing solution carried over from a bath to its succeeding bath, exhibiting a high effect of inhibiting the deterioration of properties of the processing solution. This procedure is particularly effective for reducing the processing time at each step or for reducing the replenishment rate of the processing solution.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of the washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May 1955).

According to the multi-stage counter-flow system described in the above reference, although the requisite amount of water can be greatly reduced, bacteria would grow due to an increase in the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabendazoles as described in JP-A-57-8542, chlorine type bactericides, e.g., chlorinated sodium isocyanurate, benzotriazole, and bactericides described by Hiroshi Horiguchi, "Bokinbobaizai no kagaku", Eisei Gijutsu Gakkai (ed.), "Biseibutsu no mekkin, sakkin, bobigijutsu", and Nippon Bokin Bobi Gakkai (ed.), "Bokin bobizai jiten" (1986).

The washing water has a pH value of from 4 to 9, preferably from 5 to 8. The temperature of the water and the washing time can be selected from broad ranges depending on the characteristics and the end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For stabilization, any of the known techniques as described in JP-A-57-8543, JP-A-58-14834, and JP-A-60-220345 can be used.

The aforesaid washing step may be followed by stabilization in some cases. For example, a stabilizing bath containing a dye stabilizer and a surface active agent is used as a final bath for the color light-sensitive materials for photography. Examples of such a dye stabilizer include aldehydes such as formalin and glutaraldehyde, N-methylol compounds, hexamethylenetetramine, and aldehyde-sulfurous acid adducts.

The stabilizing bath may also contain various chelating agents or bactericides.

The overflow accompanying the replenishment of the washing bath and/or stabilizing bath can be reused in other steps such as desilvering.

In the processing using an automatic developing machine, if these processing solutions are concentrated due to evaporation, water may be preferably supplied to the system to compensate for the evaporation.

The present silver halide color light-sensitive material may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The present silver halide color light-sensitive material may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, thereby reducing the processing time. On the contrary, a lower temperature range can be used to improve the picture quality or the stability of the processing solutions.

The present silver halide photographic material can also be applied to a heat-developable light-sensitive material as described in U.S. Pat. No. 4,500,626, JP-A-60-133449, JP-A-59-218443, land JP-A-61-238056, and European Patent 210,660A2.

The present invention will be further described in the following examples, but the present invention should not be construed as being limited thereto.

EXAMPLE 1

Preparation of Specimen 101

A multilayer color light-sensitive material was prepared as Specimen 101 by coating on a 127-μm thick undercoated cellulose triacetate film support various layers having the following compositions. The values indicate the amount of each component added per $m^2$. The effects of the compounds thus added are not limited to their name.

| | |
|---|---|
| 1st Layer: anti-halation layer | |
| Black colloidal silver | 0.25 g |
| Gelatin | 1.9 g |
| Ultraviolet absorbent U-1 | 0.04 g |
| Ultraviolet absorbent U-2 | 0.1 g |
| Ultraviolet absorbent U-3 | 0.1 g |
| Ultraviolet absorbent U-6 | 0.1 g |
| High boiling organic solvent Oil-1 | 0.1 g |
| 2nd Layer: interlayer | |
| Gelatin | 0.40 g |
| High boiling organic solvent Oil-3 | 40 mg |
| 3rd layer: interlayer | |

-continued

| | |
|---|---|
| Emulsion of fogged finely divided silver bromoiodide grains (average grain diameter: 0.06 μm; AgI content: 1 mol %) | 0.05 g (as silver) |
| Gelatin | 0.05 g |
| 4th Layer: low sensitivity red-sensitive emulsion layer | 0.4 g |
| Silver bromoiodide emulsion spectrally sensitized with sensitizing dyes S-1 and S-2 (1:1 mixture of a monodisperse emulsion of cubic silver bromoiodide grains with an average grain diameter of 0.4 μm and AgI content of 4.5 mol % and a monodisperse emulsion of cubic silver bromoiodide grains with an average grain diameter of 0.3 μm and AgI content of 4.5 mol %) | 0.4 g (as silver) |
| Gelatin | 0.8 g |
| Coupler C-1 | 0.20 g |
| Coupler C-9 | 0.05 g |
| Compound Cpd-D | 0.015 g |
| High boiling organic solvent Oil-2 | 0.10 g |
| 5th Layer: middle sensitivity red-sensitive emulsion layer | |
| Silver bromoiodide emulsion spectrally sensitized with sensitizing dyes S-1 and S-2 (monodisperse emulsion of cubic silver bromoiodide grains with an average grain diameter of 0.5 μm and AgI content of 4.5 mol %) | 0.4 g (as silver) |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| 6th Layer: high sensitivity red-sensitive emulsion layer | |
| Silver bromoiodide emulsion spectrally sensitized with sensitizing dyes S-1 and S-2 (monodisperse emulsion of twined crystal silver bromoiodide grains with an average grain diameter of 0.7 μm and AgI content of 2 mol %) | 0.4 g (as silver) |
| Gelatin | 1.1 g |
| Coupler C-3 | 0.7 g |
| Coupler C-1 | 0.3 g |
| 7th layer: interlayer | |
| Gelatin | 0.6 g |
| Dye D-1 | 0.02 g |
| 8th layer: interlayer | |
| Emulsion of fogged silver bromoiodide grains (average grain diameter: 0.06 μm; AgI content: 0.3 mol %) | 0.02 g |
| Gelatin | 1.0 g |
| Color stain inhibitor Cpd-A | 0.2 g |
| 9th layer: low sensitivity green-sensitive emulsion layer | |
| Silver bromoiodide emulsion spectrally sensitized with sensitizing dyes S-3 and S-4 (1:1 mixture of a monodisperse emulsion of cubic silver bromoiodide grains with an average grain diameter of 0.4 μm and AgI content of 4.5 mol % and a monodisperse emulsion of cubic silver bromoiodide grains with an average grain diameter of 0.2 μm and AgI content of 4.5 mol %) | 0.5 g (as silver) |
| Gelatin | 0.5 g |
| Coupler C-4 | 0.20 g |
| Coupler C-7 | 0.10 g |
| Coupler C-8 | 0.10 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| Compound Cpd-D | 10 mg |
| High boiling organic solvent Oil-1 | 0.1 g |
| High boiling organic solvent Oil-2 | 0.1 g |
| 10th Layer: middle sensitivity green-sensitive emulsion layer | |

-continued

| | |
|---|---|
| Silver bromoiodide emulsion spectrally sensitized with sensitizing dyes S-3 and S-4 (monodisperse emulsion of cubic silver bromoiodide grains with an average grain diameter of 0.5 μm and AgI content of 3 mol %) | 0.4 g (as silver) |
| Gelatin | 0.6 g |
| Coupler C-4 | |
| Coupler C-7 | 0.1 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High boiling organic solvent Oil-2 | 0.01 g |
| 11th Layer: high sensitivity green-sensitive emulsion layer | |
| Silver bromoiodide emulsion spectrally sensitized with sensitizing dyes S-3 and S-4 (monodisperse emulsion of tabular silver bromoiodide grains with an average grain diameter of 0.6 μm as calculated in terms of sphere, AgI content of 1.3 mol % and an average diameter/thickness ratio of 7) | 0.5 g (as silver) |
| Gelatin | 1.0 g |
| Coupler C-4 | 0.4 g |
| Coupler C-7 | 0.2 g |
| Coupler C-8 | 0.2 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.02 g |
| High boiling organic solvent Oil-2 | 0.02 g |
| 12th Layer: interlayer | |
| Gelatin | 0.6 g |
| Dye D-2 | 0.05 g |
| 13th Layer: yellow filter layer | |
| Yellow colloidal silver | 0.1 g (as silver) |
| Gelatin | 1.1 g |
| Color stain inhibitor | 0.01 g |
| High boiling organic solvent Oil-1 | 0.01 g |
| 14th Layer: interlayer | 0.6 g |
| Gelatin | |
| 15th Layer: low sensitivity blue-sensitive emulsion layer | |
| Silver bromoiodide emulsion spectrally sensitized with sensitizing dyes S-5 and S-6 (1:1 mixture of a monodisperse emulsion of cubic silver bromoiodide grains with an average grain diameter of 0.4 μm and AgI content of 3 mol % and a monodisperse emulsion of cubic silver bromoiodide grains with an average diameter of 0.2 μm and AgI content of 3 mol %) | 0.6 g (as silver) |
| Gelatin | 0.8 g |
| Coupler C-5 | 0.6 g |
| High boiling organic solvent Oil-2 | 0.02 g |
| 16th layer: middle sensitivity blue-sensitive emulsion layer | |
| Silver bromoiodide emulsion spectrally sensitized with sensitizing dyes S-5 and S-6 (monodisperse emulsion of cubic silver bromoiodide grains with an average grain diameter of 0.5 μm and AgI content of 2 mol %) | 0.4 g (as silver) |
| Gelatin | 0.9 g |
| Coupler C-5 | 0.3 g |
| Coupler C-6 | 0.3 g |
| High boiling organic solvent Oil-2 | 0.02 g |
| 17th layer: high sensitivity blue-sensitive emulsion layer | |
| Silver bromoiodide emulsion spectrally sensitized with sensitizing dyes S-5 and S-6 (monodisperse emulsion of | 0.4 g (as silver) |

-continued

| | |
|---|---|
| tabular silver bromoiodide grains with an average grain diameter of 0.7 μm as calculated in terms of sphere, AgI content of 1.5 mol % and an average diameter/thickness ratio of 7) | |
| Gelatin | 1.2 g |
| Coupler C-6 | 0.7 g |
| 18th layer: 1st protective layer | |
| Gelatin | 0.7 g |
| Ultraviolet absorbent U-1 | 0.04 g |
| Ultraviolet absorbent U-3 | 0.03 g |
| Ultraviolet absorbent U-4 | 0.03 g |
| Ultraviolet absorbent U-5 | 0.05 g |
| Ultraviolet absorbent U-6 | 0.05 g |
| High boiling organic solvent Oil-1 | 0.02 g |
| Formalin scavenger Cpd-C | 0.8 g |
| Dye D-1 | 0.05 g |
| 19th layer: 2nd protective layer | |
| Emulsion of fogged finely divided silver bromoiodide grains (average grain diameter: 0.06 μm; AgI content: 1 mol %) | 0.1 g (as silver) |
| Gelatin | 0.4 g |
| 20th layer: 3rd protective layer | |
| Gelatin | 0.4 g |
| Polymethyl methacrylate (average grain diameter: 1.5 μm) | 0.1 g |
| 4:6 Copolymer of methyl methacrylate and acrylic acid (average grain diameter: 1.5 μm) | 0.1 g |
| Silicone oil | 0.03 g |
| Surface active agent W-1 | 3.0 mg |

In addition to the above mentioned components, a gelatin hardener H-1, surface active agents for facilitating coating and emulsification, and the like were incorporated in each of these layers.

Futhermore, 1,2-benzisothiazoline-3-one, 2-phenoxyethanol, and phenethyl alcohol were incorporated in these layers as preservatives and antifungal agents.

The term "monodisperse emulsion" as used herein means an "emulsion having a grain diameter variation coefficient of 20% or less".

C-1

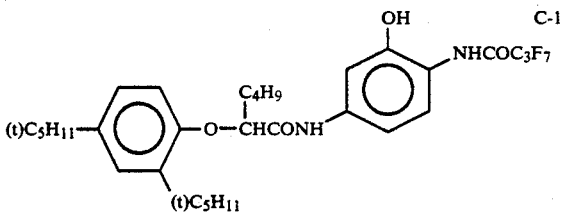

C-2

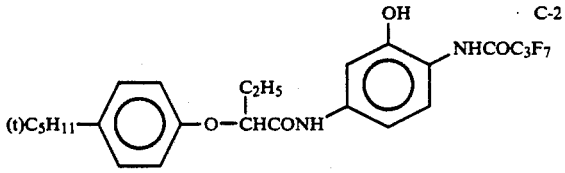

C-3

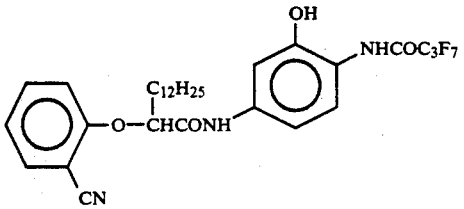

-continued

C-4

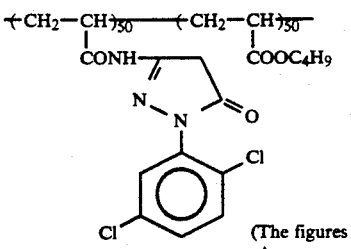

(The figures indicate wt %; Average molecular weight: approx. 25,000)

C-5

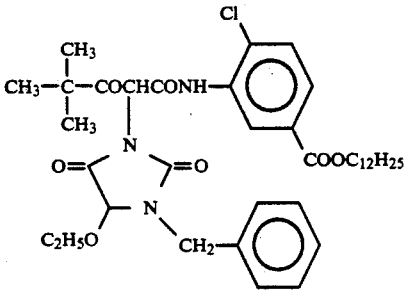

C-6

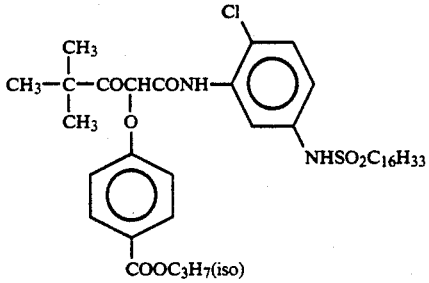

C-7

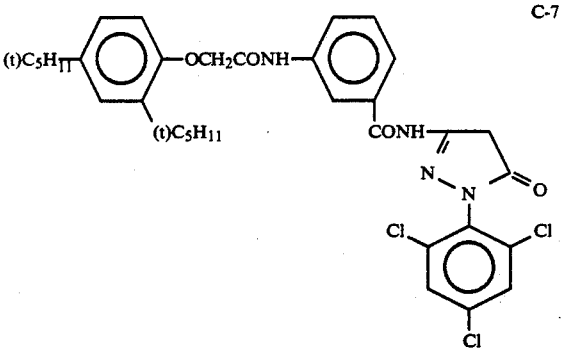

C-8

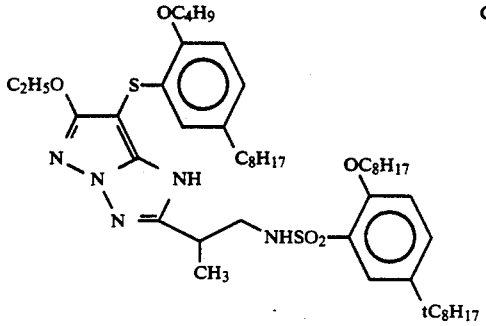

-continued
C-9
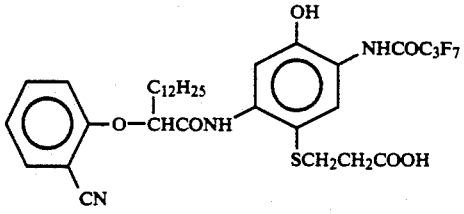
Oil-1: Dibutyl phthalate
Oil-2: Tricresyl phosphate
Oil-3
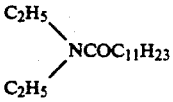
Cpd-A
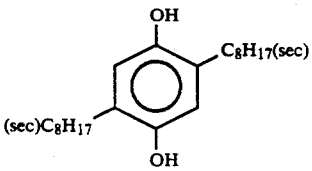
Cpd-B
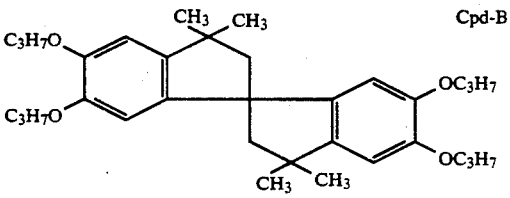
Cpd-C
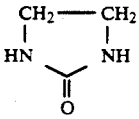
Cpd-D
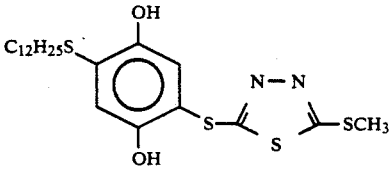
Cpd-E
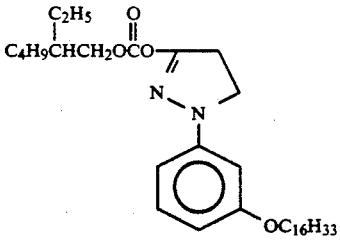
Cpd-F
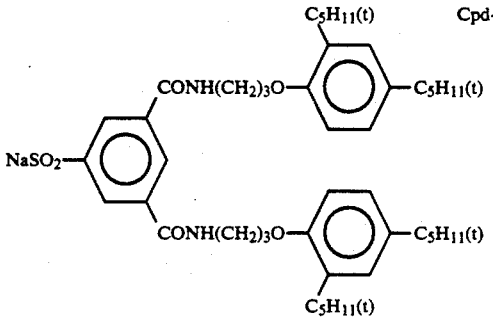
-continued
Cpd-G
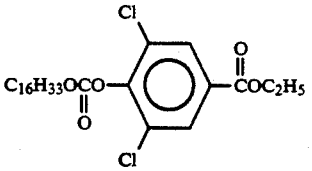
Cpd-H
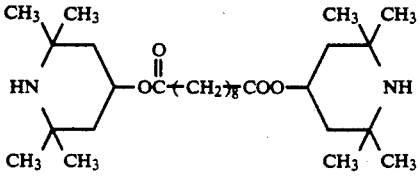
U-1
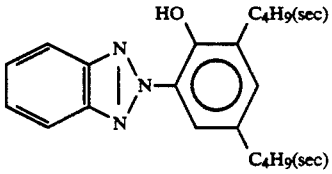
U-2
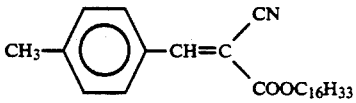
U-3
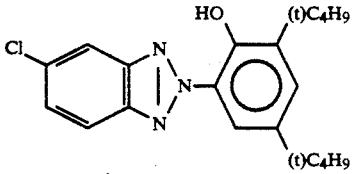
U-4
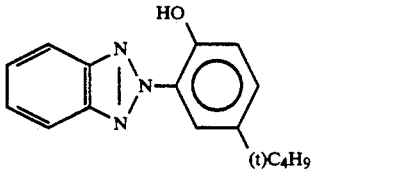
U-5
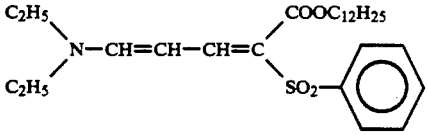
U-6
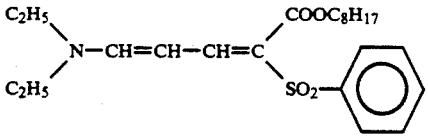
S-1
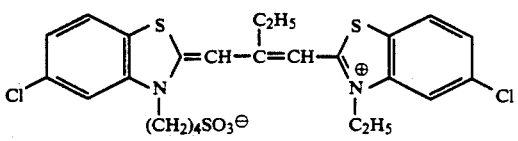

-continued

S-2

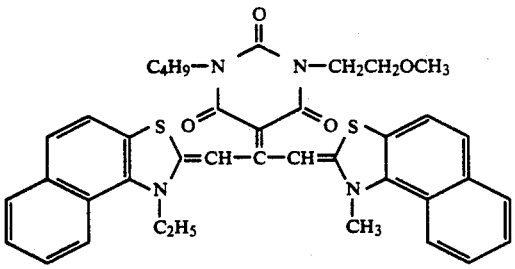

S-3

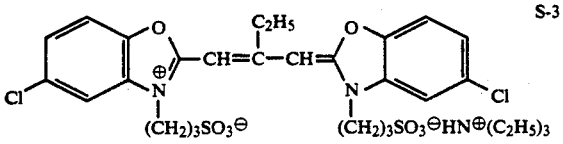

S-4

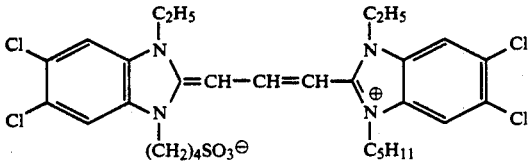

S-5

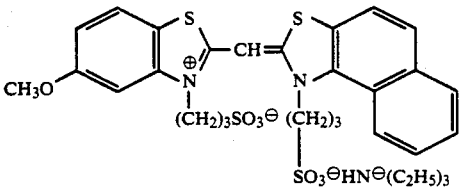

S-6

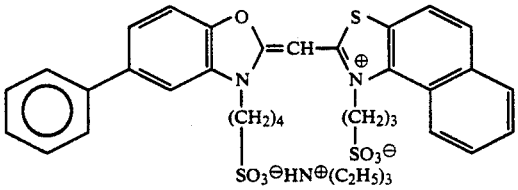

D-1

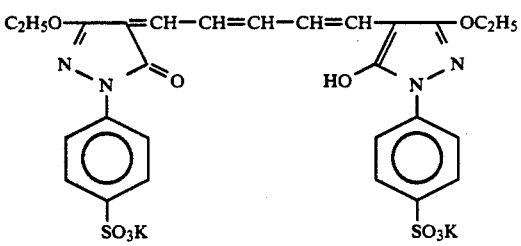

D-2

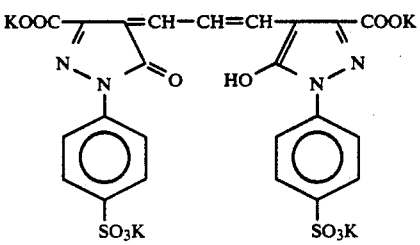

-continued

D-3

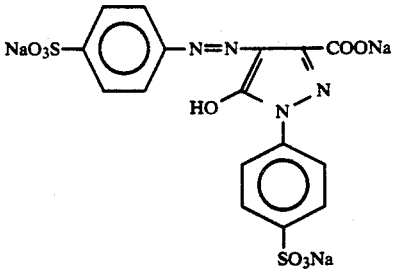

H-1

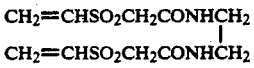

W-1

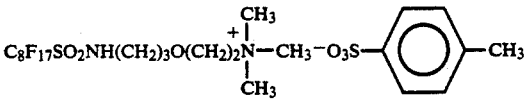

Preparation of Specimens 102 to 118

Specimens 102 to 113 were prepared in the same manner as in Specimen 101 except that DIR compound Cpd-D incorporated in the 4th layer was replaced by Comparative Compound A, Comparative Compound B, Comparative Compound C, and Present Compounds I-(1), I-(2), I-(3), I-(4), I-(5), I-(12), I-(16), I-(19), I-(21), I-(25), I-(31), I-(32), I-(35), and I-(40) in equimolecular amounts, respectively.

Specimens 101 to 118 thus obtained were cut into strips. These specimens were imagewise exposed to light through a red filter, and then uniformly exposed to light through a green filter. These specimens were then exposed to soft X-rays with widths of 20 μm and 1 mm for the evaluation of edge effect. These specimens were processed in a manner as described later. For the evaluation of interimage effect, the difference in magenta density between the portion in which the cyan color density is 2.0 and the portion in which the cyan color density is minimum was determined. For the measurement of edge effect, the density at 1-mm wide and 20-μm wide portions was determined through a red filter by means of a microdensitometer. For the evaluation of edge effect, the ratio of these measurements was determined. These specimens were then stored at a temperature of 40° C. and a relative humidity of 80% for 14 days. Another batch of these specimens were stored at room temperature for 14 days. These specimens were processed at the same time. These specimens were then compared for the maximum density of the cyan coloring layer.

The results are set forth in Table 1.

Table 1 shows that the use of the present DIR compound [I] provides great interimage and edge effects and a small drop in the maximum density (corresponding to a rise in fogging) during storage.

TABLE 1

| Specimen No. | Compound incorporated in 4th layer | Interimage effect | Edge effect | Difference in max. density before and after storage |
|---|---|---|---|---|
| 101 (comparative) | Cpd-D | 0.02 | 1.07 | 0.29 |
| 102 (comparative) | Comparative compound A | 0.02 | 1.02 | 0.18 |
| 103 | Comparative | 0.02 | 1.04 | 0.06 |

TABLE 1-continued

| Specimen No. | Compound incorporated in 4th layer | Interimage effect | Edge effect | Difference in max. density before and after storage |
|---|---|---|---|---|
| (comparative) 104 | compound B Comparative | 0.01 | 1.03 | 0.06 |
| (comparative) 105 | compound C I-(1) | 0.07 | 1.18 | 0.06 |
| (present invention) 106 | I-(2) | 0.07 | 1.19 | 0.07 |
| (present invention) 107 | I-(3) | 0.05 | 1.16 | 0.08 |
| (Present Invention) 108 | I-(4) | 0.04 | 1.15 | 0.08 |
| (Present Invention) 109 | I-(5) | 0.06 | 1.18 | 0.05 |
| (Present Invention) 110 | I-(12) | 0.05 | 1.16 | 0.08 |
| (Present Invention) 111 | I-(16) | 0.03 | 1.11 | 0.05 |
| (Present Invention) 112 | I-(19) | 0.07 | 1.19 | 0.07 |
| (Present Invention) 113 | I-(21) | 0.06 | 1.17 | 0.07 |
| (Present Invention) 114 | I-(25) | 0.06 | 1.13 | 0.08 |
| (Present Invention) 115 | I-(31) | 0.08 | 1.22 | 0.06 |
| (Present Invention) 116 | I-(32) | 0.08 | 1.23 | 0.05 |
| (Present Invention) 117 | I-(35) | 0.08 | 1.22 | 0.06 |
| (Present Invention) 118 | I-(40) | 0.07 | 1.21 | 0.07 |
| (Present Invention) | | | | |

Comparative Compound A

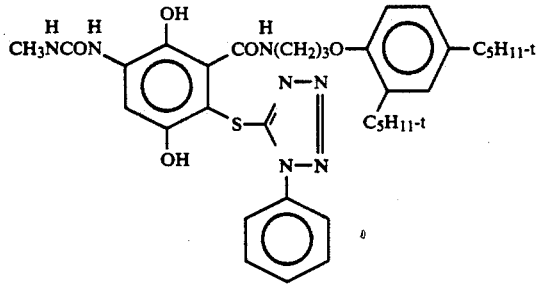

(Compound described in U.S. Pat. No. 4,740,453)

Comparative Compound B

-continued

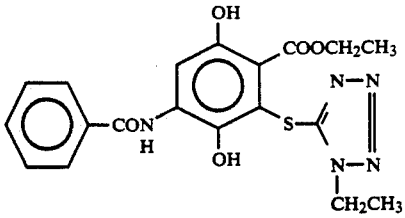

(Compound described in U.S. Pat. No. 4,740,453)

Comparative Compound C

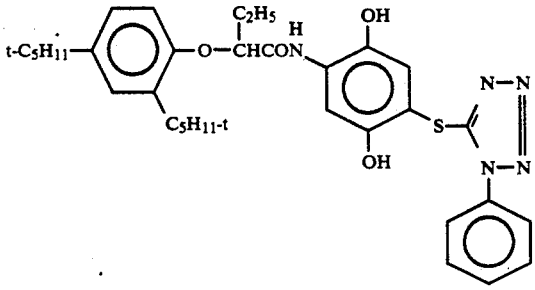

(Compound described in JP-A-64-546)

Processing step

| Step | Time | Temp. | Tank capacity | Replenishment rate |
|---|---|---|---|---|
| Black-and-white development | 6 min. | 38° C. | 12 l | 2.2 l/m$^2$ |
| 1st rinse | 2 min. | 38° C. | 4 l | 7.5 l/m$^2$ |
| Reverse | 2 min. | 38° C. | 4 l | 1.1 l/m$^2$ |
| Color development | 6 min. | 38° C. | 12 l | 2.2 l/m$^2$ |
| Adjustment | 2 min. | 38° C. | 4 l | 1.1 l/m$^2$ |
| Bleach | 6 min. | 38° C. | 12 l | 0.22 l/m$^2$ |
| Fixing | 4 min. | 38° C. | 8 l | 1.1 l/m$^2$ |
| 2nd rinse | 4 min. | 38° C. | 8 l | 7.5 l/m$^2$ |
| Stabilization | 1 min. | 25° C. | 2 l | 1.1 l/m$^2$ |

| | Tank solution | Replenisher |
|---|---|---|
| Black-and-white developer | | |
| Pentasodium nitrilo-N,N,N-trimethylene-phosphonate | 2.0 g | 2.0 g |
| Sodium sulfite | 30 g | 30 g |
| Hydroquinone potassium monosulfonate | 20 g | 20 g |
| Potassium carbonate | 33 g | 33 g |
| 1-Phenyl-4-methyl-4-hydroxy-methyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH adjusted with hydrochloric acid or potassium hydroxide | 9.60 | 9.60 |
| Reversing solution | | |
| Pentasodium nitrilo-N,N,N-trimethylene-phosphonate | 3.0 g | Same as left |
| Stannous chloride dihydrate | 1.0 g | " |
| p-Aminophenol | 0.1 g | " |
| Sodium hydroxide | 8 g | " |
| Glacial acetic acid | 15 ml | " |
| Water to make | 1,000 ml | " |
| pH adjusted with hydro- | 6.00 | " |

-continued

| | Tank solution | Replenisher |
|---|---|---|
| chloric acid or sodium hydroxide | | |
| Color developer | | |
| Pentasodium nitrilo-N,N,N-trimethylenephosphonate | 2.0 g | 2.2 g |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate | 11 g | 11 g |
| 3,6-Dithia-1,8-octanediol | 1.0 g | 1.0 g |
| Water to make | 1,000 ml | 1,000 ml |
| pH adjusted with hydrochloric acid or potassium hydroxide | 11.80 | 12.00 |
| Adjusting solution | | |
| Disodium ethylenediaminetetraacetate dihydrate | 8.0 g | Same as left |
| Sodium sulfite | 2 g | " |
| 1-Thioglycerin | 0.4 ml | " |
| Sorbitan ester* | 0.1 g | " |
| Water to make | 1,000 ml | " |
| pH adjusted with hydrochloric acid or sodium hydroxide | 6.20 | " |
| Bleaching solution | | |
| Disodium ethylenediaminetetraacetate dihydrate | 2.0 g | 4.0 g |
| Ferric ammonium ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH adjusted with hydrochloric acid or sodium hydroxide | 5.70 | 5.50 |
| Fixing solution | | |
| Ammonium thiosulfate | 8.0 g | Same as left |
| Sodium sulfite | 5.0 g | " |
| Sodium bisulfite | 5.0 g | " |
| Water to make | 1,000 ml | " |
| pH adjusted with hydrochloric acid or aqueous ammonia | 6.60 | " |
| Stabilizing solution | | |
| 37% Formalin | 5.0 ml | Same as left |
| Polyoxyethylene-p-monononylphenylether (average polymerization degree: 10) | 0.5 ml | " |
| Water to make | 1,000 ml | " |
| pH | not adjusted | " |

Sorbitan ester

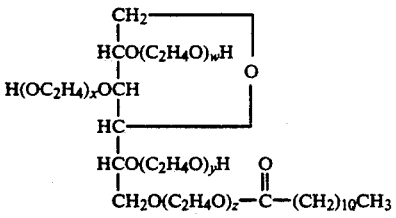

(w + x + y + z = 20)

Furthermore, specimens obtained by incorporating these DIR compounds in the 2nd layer, 3rd layer, 8th layer 9th layer, 14th layer and/or 15th layer instead of the 4th layer gave similar results.

EXAMPLE 2

Preparation of Specimen 101' and 201 to 220

Specimen 101' was prepared by repeating Example 1.

Specimens 201 to 220 were prepared in the same manner as in Specimen 101 except that the DIR compound Cpd-D in the 4th layer was replaced by Comparative Compound A, Comparative Compound B, Comparative Compound C, Comparative Compound D, Comparative Compound E, Comparative Compound F, and Present Compounds II-(1), II-(2), II-(3), II-(4), II-(6), II-(9), II-(10), II-(14), II-(15), II-(23), II-(26) and II-(27) in equimolecular amounts, respectively.

Specimens 101' and 201 to 220 thus obtained were then processed in the same manner as in Example 1. The results are set forth in Table 2.

Table 2 shows that the use of the present DIR compound [II] provides great interimage and edge effects and a small drop in the maximum density (corresponding to a rise in fogging) during storage.

Comparative Compound A

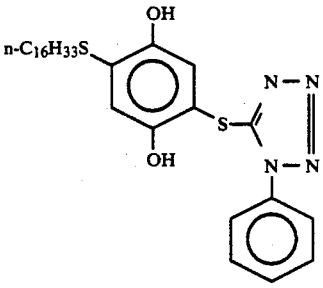

Comparative Compounds B and C

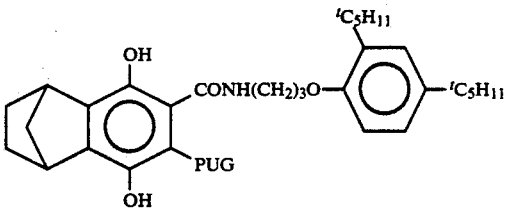

(Compound described in U.S. Pat. No. 4,740,453)

Comparative Compound B:

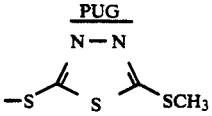

Comparative Compound C:

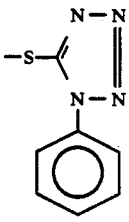

Comparative Compound D

-continued

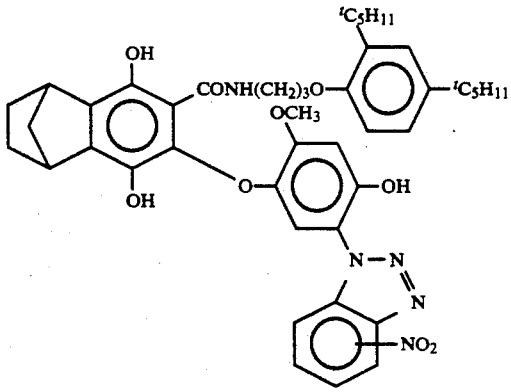

(Compound described in U.S. Pat. No. 4,770,982)

Comparative Compound E

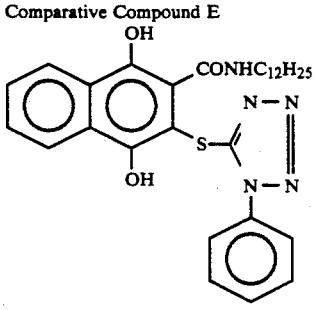

(Compound described in JP-A-60-233648)

Comparative Compound F

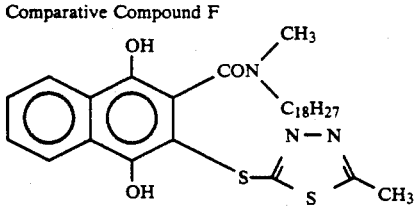

(Compound described in JP-A-60-233648)

TABLE 2

| Specimen No. | Compound incorporated in 4th layer | Interimage effect | Edge effect | Difference in max. density before and after storage |
|---|---|---|---|---|
| 101' (comparative) | Cpd-D | 0.03 | 1.07 | 0.28 |
| 202 (comparative) | Comparative compound A | 0.02 | 1.02 | 0.21 |
| 203 (comparative) | Comparative compound B | 0.03 | 1.08 | 0.22 |
| 204 (comparative) | Comparative compound C | 0.02 | 1.04 | 0.20 |
| 205 (comparative) | Comparative compound D | 0.04 | 1.04 | 0.19 |
| 206 (comparative) | Comparative compound E | 0.02 | 1.04 | 0.22 |
| 207 (comparative) | Comparative compound F | 0.03 | 1.09 | 0.23 |
| 208 (present invention) | II-(1) | 0.07 | 1.13 | 0.08 |
| 209 (present invention) | II-(2) | 0.05 | 1.14 | 0.07 |
| 210 (present invention) | II-(3) | 0.05 | 1.15 | 0.07 |
| 211 (present invention) | II-(4) | 0.06 | 1.18 | 0.08 |
| 212 (present invention) | II-(5) | 0.07 | 1.16 | 0.09 |
| 213 (present invention) | II-(6) | 0.06 | 1.18 | 0.06 |
| 214 (Present Invention) | II-(9) | 0.06 | 1.17 | 0.07 |
| 215 (Present Invention) | II-(10) | 0.06 | 1.16 | 0.13 |
| 216 (Present Invention) | II-(14) | 0.05 | 1.16 | 0.11 |
| 217 (Present Invention) | II-(15) | 0.06 | 1.17 | 0.08 |
| 218 (Present Invention) | II-(23) | 0.07 | 1.19 | 0.08 |
| 219 (Present Invention) | II-(26) | 0.08 | 1.20 | 0.08 |
| 220 (Present Invention) | II-(27) | 0.07 | 1.20 | 0.07 |

Furthermore, specimens obtained by incorporating these DIR compounds in the 2nd layer, 3rd layer, 8th layer, 9th layer, 14th layer and/or 15th layer instead of the 4th layer gave similar results.

EXAMPLE 3

Preparation of Specimens 101" and 302 to 316

Example 1 was repeated to prepare Specimen 101".

Specimens 302 to 316 were prepared in the same manner as in Specimen 101 except that the DIR compound Cpd-D in the 4th layer was replaced by Comparative Compound A, Comparative Compound B, Comparative Compound C, and Present Compounds III-(1), III-(2), III-(3), III-(4), III-(6), III-(13), III-(15), III-(16), III-(17), III-(18), III-(27) and III-(30) in equimolecular amounts, respectively.

Specimens 101", and 302 to 316 thus obtained were then processed in the same manner as in Example 1. The results are set forth in Table 3.

Table 3 shows that the use of the present DIR compound [III] provides great interimage and edge effects and a small drop in the maximum density (corresponding to a rise in fogging) during storage.

TABLE 3

| Specimen No. | Compound incorporated in 4th layer | Interimage effect | Edge effect | Difference in max. density before and after storage |
|---|---|---|---|---|
| 101" (comparative) | Cpd-D | 0.02 | 1.07 | 0.28 |
| 302 (comparative) | Comparative compound A | 0.02 | 1.02 | 0.20 |
| 303 (comparative) | Comparative compound B | 0.01 | 1.03 | 0.06 |
| 304 (comparative) | Comparative compound C | 0.01 | 1.03 | 0.18 |

TABLE 3-continued

| Specimen No. | Compound incorporated in 4th layer | Interimage effect | Edge effect | Difference in max. density before and after storage |
|---|---|---|---|---|
| 305 (Present invention) | III-(1) | 0.06 | 1.15 | 0.07 |
| 306 (Present invention) | III-(2) | 0.05 | 1.16 | 0.06 |
| 307 (Present invention) | III-(3) | 0.06 | 1.17 | 0.06 |
| 308 (Present invention) | III-(4) | 0.04 | 1.11 | 0.06 |
| 309 (Present invention) | III-(6) | 0.05 | 1.15 | 0.07 |
| 310 (Present invention) | III-(13) | 0.06 | 1.16 | 0.07 |
| 311 (Present invention) | III-(15) | 0.05 | 1.15 | 0.06 |
| 312 (Present invention) | III-(16) | 0.06 | 1.15 | 0.06 |
| 313 (Present Invention) | III-(17) | 0.06 | 1.15 | 0.07 |
| 314 (Present Invention) | III-(18) | 0.06 | 1.16 | 0.06 |
| 315 (Present Invention) | III-(27) | 0.07 | 1.18 | 0.07 |
| 316 (Present Invention) | III-(30) | 0.07 | 1.18 | 0.07 |

Comparative Compound A

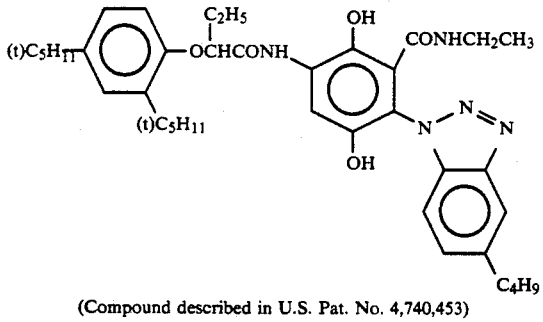

(Compound described in U.S. Pat. No. 4,740,453)

Comparative Compound B

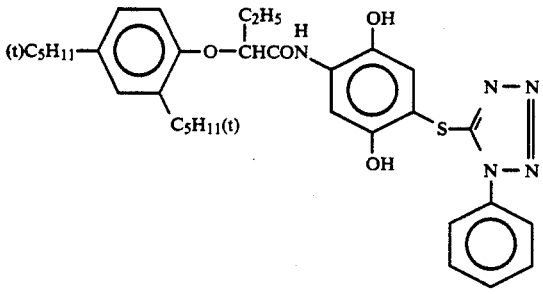

(Compound described in JP-A-64-546)

Comparative Compound C

-continued

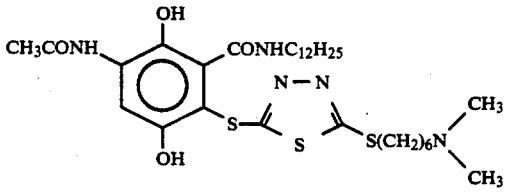

(Compound described in JP-A-62-103639)

Furthermore, specimens obtained by incorporating these DIR compounds in the 2nd layer, 3rd layer, 8th layer, 9th layer, 14th layer and/or 15th layer instead of the 4th layer gave similar results.

EXAMPLE 4

A multilayer color light-sensitive material was prepared as Specimen 401 by coating on an undercoated cellulose triacetate film support various layers having the following compositions.

Composition of Light-Sensitive Layer

The coated amount of silver halide and colloidal silver is represented in g/m$^2$ as calculated in terms of the amount of silver. The coated amount of coupler, additive and gelatin is represented in g/m$^2$. The coated amount of sensitizing dye is represented in the molar amount per mol of silver halide contained in the same layer. The marks indicating the additive are as defined hereinafter, provided that if there are a plurality of effects, one of them is set forth below as representative.

UV: ultraviolet absorbent; Solv: high boiling organic solvent; ExF: dye; ExS: sensitizing dye; ExC: cyan coupler; ExM: magenta coupler; ExY: yellow coupler; Cpd: additive

| | |
|---|---|
| 1st Layer: anti-halation layer | |
| Black colloidal silver | 0.15 g |
| Gelatin | 2.0 g |
| ExM-6 | 0.2 |
| UV-1 | 0.03 |
| UV-2 | 0.06 |
| UV-3 | 0.07 |
| Solv-1 | 0.3 |
| Solv-2 | 0.08 |
| ExF-1 | 0.01 |
| ExF-2 | 0.01 |
| ExF-3 | 0.005 |
| Cpd-6 | 0.001 |
| 2nd Layer: low sensitivity red-sensitive emulsion layer | |
| Silver bromoiodide emulsion (AgI content: 4 mol %; 4 mol %; uniform AgI type; variation coefficient: 30% (as calculated in terms of sphere); tabular grain; diameter/thickness ratio: 3.0) | 0.37 (as silver) |
| Silver bromoiodide emulsion (AgI content: 6 mol %; high internal AgI type (core/shell ratio: 2:1); grain diameter: 0.45 (as calculated in terms of sphere); variation coefficient: 23% (as calculated in terms of sphere); tabular grain; diameter/thickness: 2.0) | 0.19 (as silver) |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.17 |
| ExC-2 | 0.03 |
| ExC-3 | 0.009 |

-continued

| | |
|---|---|
| 3rd layer: middle sensitivity red-sensitive emulsion layer | |
| Silver bromoiodide emulsion (AgI content: 6 mol %; high internal AgI type (core/shell ratio: 2:1); grain diameter: 0.65 (as calculated in terms of sphere); variation coefficient: 23% (as calculated in terms of sphere); tabular grain; diameter/thickness: 2.0) | 0.65 (as silver) |
| Gelatin | 1.0 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $4.2 \times 10^{-6}$ |
| ExC-1 | 0.31 |
| ExC-2 | 0.01 |
| ExC-3 | 0.10 |
| 4th Layer: high sensitivity red-sensitive emulsion layer | |
| Silver bromoiodide emulsion (AgI content: 9.3 mol %; multistructural grain (core/shell ratio: 3:4:2); AgI content: 24, 0, 6 mol % toward the surface; grain diameter: 0.75 (as calculated in terms of sphere); variation coefficient: 23% (as calculated in terms of sphere); tabular grain; diameter/thickness: 2.5) | 1.5 (as silver) |
| Gelatin | 1.4 |
| ExS-1 | $1.9 \times 10^{-4}$ |
| ExS-2 | $1.2 \times 10^{-4}$ |
| ExS-5 | $1.9 \times 10^{-4}$ |
| ExS-7 | $8.0 \times 10^{-6}$ |
| ExC-1 | 0.08 |
| ExC-4 | 0.09 |
| Solv-1 | 0.08 |
| Solv-2 | 0.20 |
| Cpd-7 | $4.6 \times 10^{-4}$ |
| 5th Layer: interlayer | |
| Gelatin | 0.6 |
| Cpd-1 | 0.1 |
| Polyethyl acrylate latex | 0.08 |
| Solv-1 | 0.08 |
| 6th Layer: low sensitivity green-sensitive emulsion layer | |
| Silver bromoiodide emulsion (AgI content: 4 mol %; uniform AgI type; grain diameter: 0.33 μm (as calculated in terms of sphere); variation coefficient: 37% (as calculated in terms of sphere); tabular grain; diameter/thickness: 2.0) | 0.18 (as silver) |
| Gelatin | 0.4 |
| ExS-3 | $1.6 \times 10^{-4}$ |
| ExS-4 | $4.8 \times 10^{-4}$ |
| ExS-5 | $1 \times 10^{-4}$ |
| ExM-5 | 0.16 |
| ExM-7 | 0.03 |
| ExM-8 | 0.01 |
| Solv-1 | 0.06 |
| Solv-4 | 0.01 |
| 7th layer: middle sensitivity green-sensitive emulsion layer | |
| Silver bromoiodide emulsion (AgI content: 4 mol %; uniform AgI type; grain diameter: 0.55 μm (as calculated in terms of sphere); variation coefficient: 15% (as calculated in terms of sphere); tabular grain; diameter/thickness: 4.0) | 0.27 (as silver) |
| Gelatin | 0.6 |
| ExS-3 | $2 \times 10^{-4}$ |
| ExS 4 | $7 \times 10^{-4}$ |
| ExS-5 | $1.4 \times 10^{-4}$ |
| ExM-5 | 0.17 |
| ExM-7 | 0.04 |
| ExY-8 | 0.04 |
| Solv-1 | 0.14 |
| Solv-4 | 0.01 |
| 8th layer: high sensitivity green-sensitive emulsion layer | |
| Silver bromoiodide emulsion (AgI content: 8.8 mol %; multistructural grain (core/shell ratio: 3:4:2); AgI content: 24, 0, 3 mol % toward the surface; grain diameter: 0.75 (as calculated in terms of sphere); variation coefficient: 23% (as calculated in terms of sphere); tabular grain; diameter/thickness: 1.6) | 0.5 (as silver) |
| Gelatin | 0.6 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.08 |
| ExM-6 | 0.03 |
| ExY-8 | 0.02 |
| ExC-1 | 0.01 |
| ExC-4 | 0.01 |
| Solv-1 | 0.23 |
| Solv-2 | 0.05 |
| Solv-4 | 0.01 |
| Cpd-7 | $1 \times 10^{-4}$ |
| Cpd-8 | 0.01 |
| 9th layer: interlayer | |
| Gelatin | 0.6 |
| Cpd-1 | 0.04 |
| Polyethylene acrylate latex | 0.05 |
| Solv-1 | 0.02 |
| UV-4 | 0.03 |
| UV-5 | 0.04 |
| 10th Layer: donor layer having interimage effect on red-sensitive layer | |
| Silver bromoiodide emulsion (AgI content: 8 mol %; high internal AgI type (core/shell ratio: 2:1); grain diameter: 0.65 (as calculated in terms of sphere); variation coefficient: 25% (as calculated in terms of sphere); tabular grain; diameter/thickness: 2.0) | 0.72 (as silver) |
| Silver bromoiodide emulsion (AgI content: 4 mol %; uniform AgI type; grain diameter: 0.4 μm (as calculated in terms of sphere); variation coefficient: 30% (as calculated in terms of sphere); tabular grain; diameter/thickness: 3.0) | 0.21 (as silver) |
| Gelatin | 1.0 |
| ExS-3 | $6 \times 10^{-4}$ |
| ExM-10 | 0.19 |
| Solv-1 | 0.30 |
| Solv-6 | 0.03 |
| 11th Layer: yellow filter layer | |
| Yellow colloidal silver | 0.06 |
| Gelatin | 0.8 |
| Cpd-2 | 0.13 |
| Cpd-6 | 0.002 |
| H-1 | 0.13 |
| 12th Layer: low sensitivity blue-sensitive emulsion layer | |
| Silver bromoiodide emulsion (AgI content: 4.5 mol %; uniform AgI type; grain diameter: 0.7 μm (as calculated in terms of sphere); variation coefficient: 15% (as calculated in terms of sphere); tabular grain; diameter/thickness: 7.0) | 0.45 (as silver) |
| Silver bromoiodide emulsion (AgI content: 3 mol %; uniform AgI type; grain diameter: 0.3 μm (as calculated in terms of sphere); variation coefficient: 30% (as calculated in terms of sphere); tabular grain; diameter/thickness: 7.0) | 0.25 (as silver) |
| Gelatin | 2.1 |
| ExS-6 | $9 \times 10^{-4}$ |
| ExC-1 | 0.13 |
| ExC-4 | 0.03 |
| ExY-9 | 0.16 |
| ExY-11 | 1.04 |

-continued

| | |
|---|---|
| Solv-1 | 0.51 |
| 13th Layer: interlayer | |
| Gelatin | 0.4 |
| ExY-12 | 0.20 |
| Solv-1 | 0.19 |
| 14th Layer: high sensitivity blue-sensitive emulsion layer | |
| Silver bromoiodide emulsion (AgI content: 10 mol %; high internal AgI type; grain diameter: 1.0 (as calculated in terms of sphere); variation coefficient: 25% (as calculated in terms of sphere); multitwin tabular grain; diameter/thickness: 2.0) | 0.4 (as silver) |
| Gelatin | 0.5 |
| ExS-6 | $1 \times 10^{-4}$ |
| ExY-9 | 0.01 |
| ExY-11 | 0.20 |
| ExC-1 | 0.01 |
| Solv-1 | 0.10 |
| 15th Layer: 1st protective layer | |
| Silver bromoiodide emulsion (AgI content: 2 mol %; uniform AgI type; grain diameter: 0.07 μm (as calculated in terms of sphere) | 0.12 (as silver) |
| Gelatin | 0.7 |
| UV-4 | 0.11 |

-continued

| | |
|---|---|
| UV-5 | 0.16 |
| Solv-5 | 0.02 |
| H-1 | 0.13 |
| Cpd-5 | 0.10 |
| Polyethyl acrylate latex | 0.09 |
| 16th layer: 2nd protective layer | |
| Silver bromoiodide emulsion (AgI content: 2 mol %; uniform AgI type; grain diameter: 0.07 μm (as calculated in terms of sphere) | 0.36 (as silver) |
| Gelatin | 0.85 |
| Polymethyl methacrylate grain (diameter: 1.5 μm) | 0.2 |
| Cpd 4 | 0.04 |
| W-4 | 0.02 |
| H-1 | 0.17 |

In addition to the above-mentioned components, an emulsion stabilizer Cpd-3 (0.07 g/m$^2$), and surface active agents W-1 (0.006 g/m$^2$), W-2 (0.33 g/m$^2$) and W-3 (0.10 g/m$^2$) for facilitating coating and emulsification were incorporated in each of these layers.

Furthermore, 1,2-benzisothiazoline-3-one, 2-phenoxyethanol, and phenethyl alcohol were incorporated in these layers in order to mainly improve the bacteria resistance of the light-sensitive material.

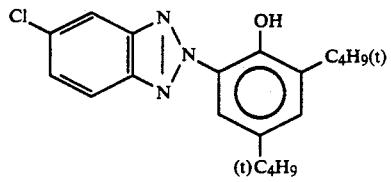

UV-1

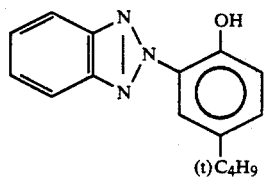

UV-2

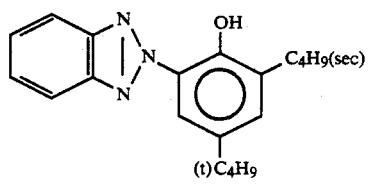

UV-3

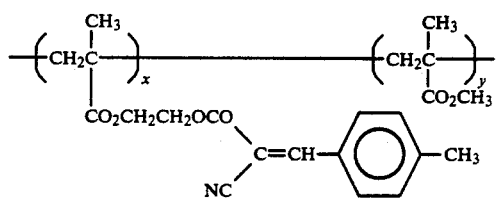

x:y = 70:30 (wt %)

UV-4

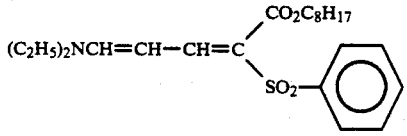

UV-5

Tricresyl phosphate — Solv-1:

Dibutyl phthalate — Solv-2:

-continued
Solv-4:
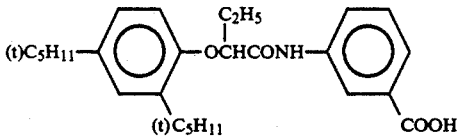
Trihexyl phosphate
Solv-5:
Solv-6
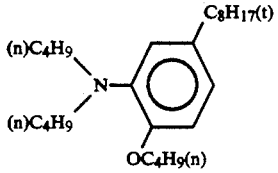
ExF-1
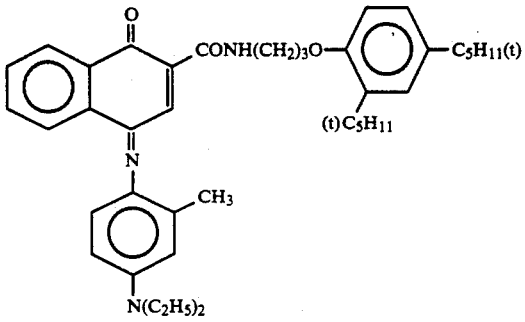
ExF-2
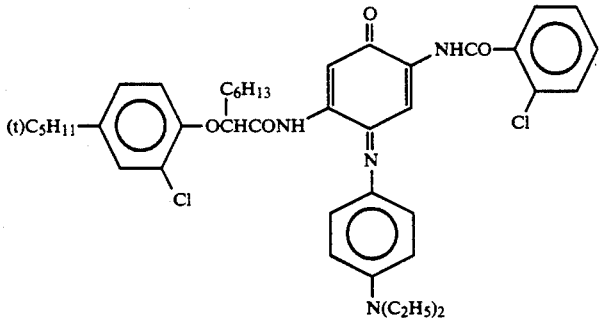
ExF-3
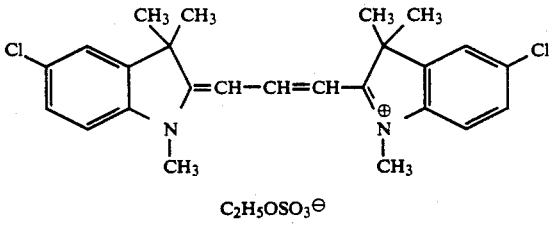
ExS-1
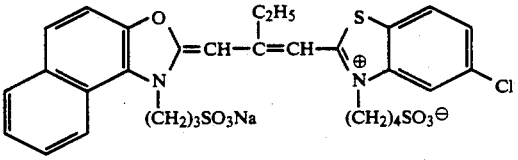
ExS-2
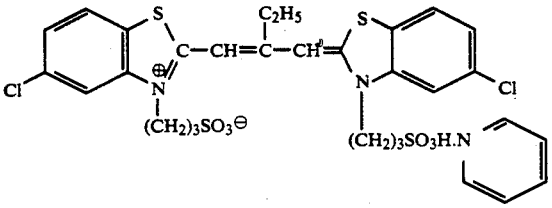

-continued
ExS-3
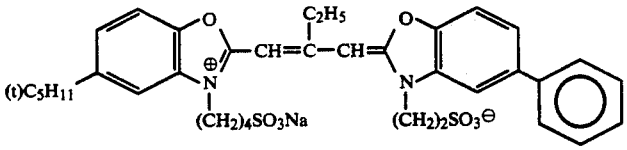
ExS-4
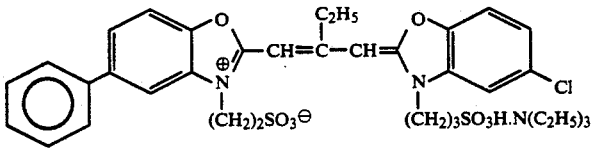
ExS-5
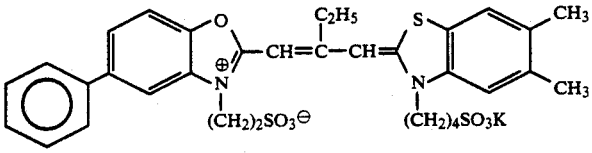
ExS-6
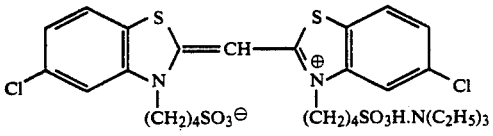
ExS-7
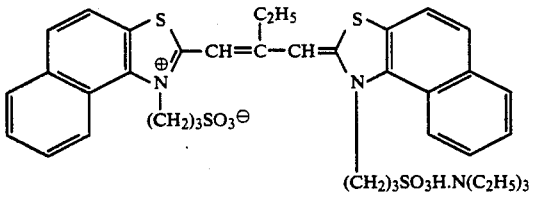
ExS-8
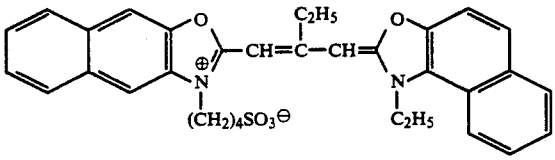
ExC-1
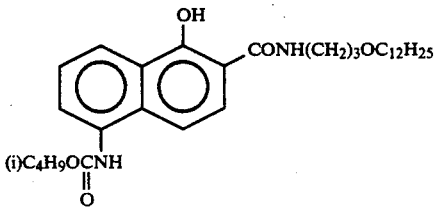

-continued
ExC-2
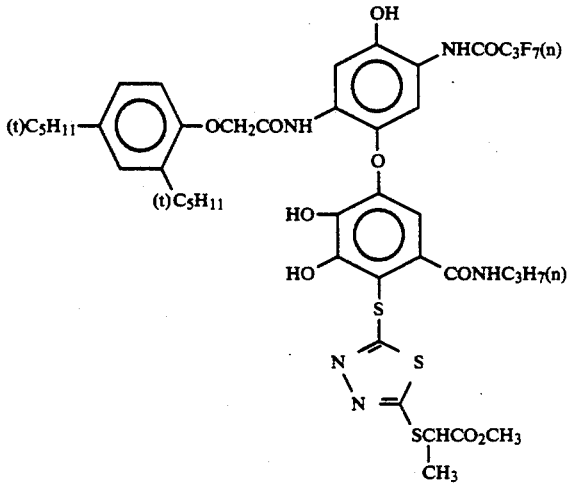
ExC-3
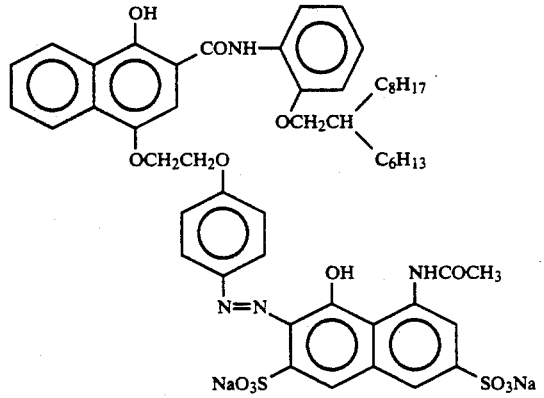
ExC-4
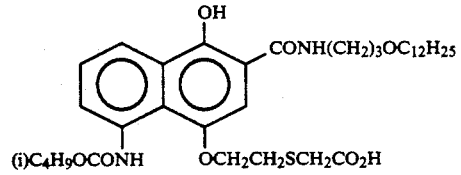
ExM-5
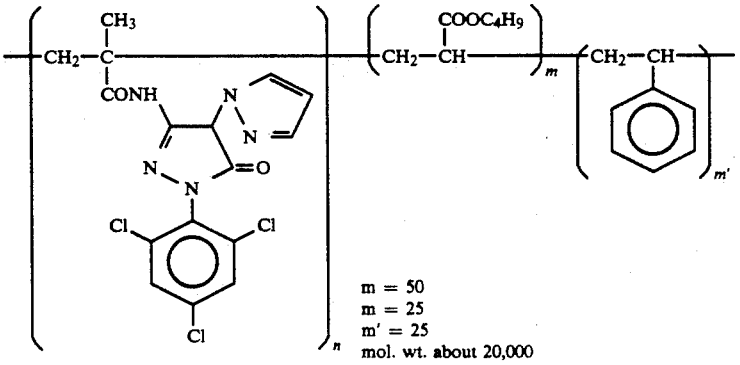

-continued
ExM-6
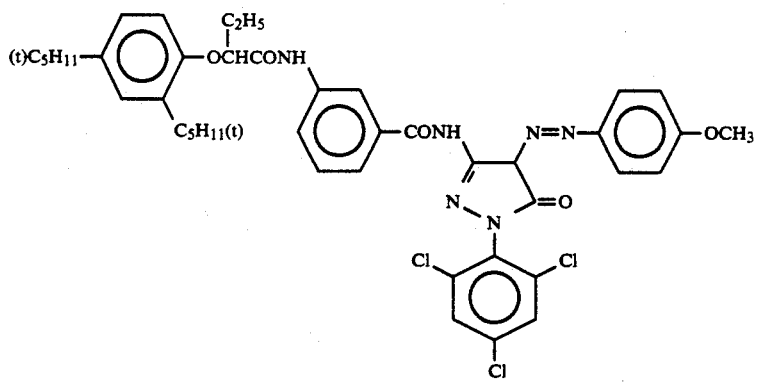
ExM-7
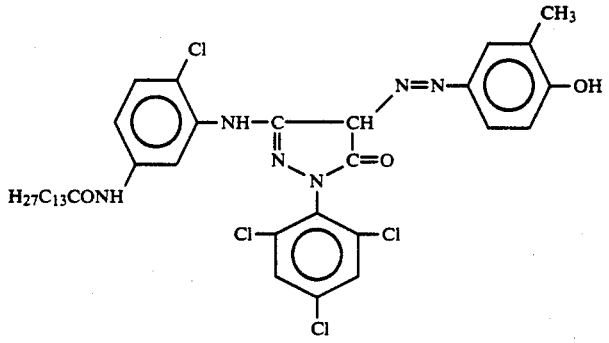
ExM-10
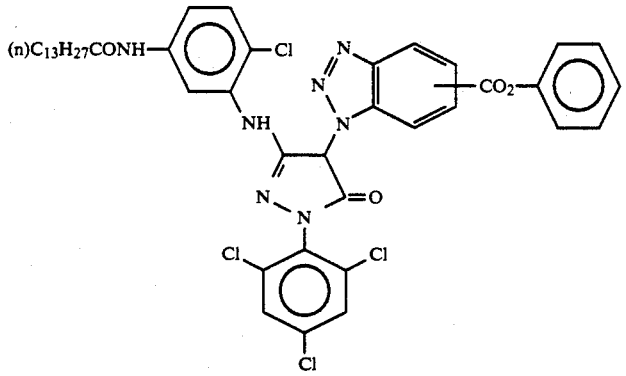
ExY-8
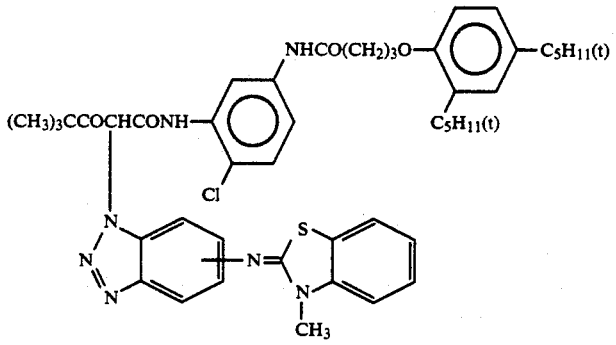

-continued
ExY-9
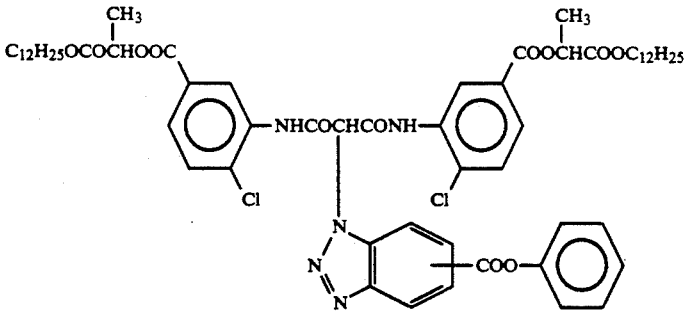
ExY-11
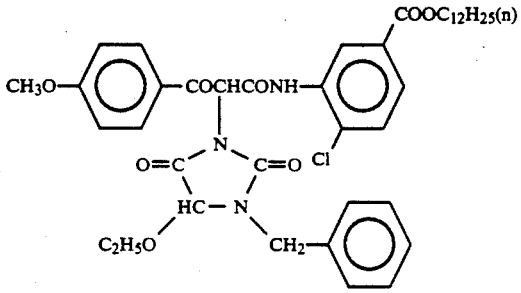
ExY-12
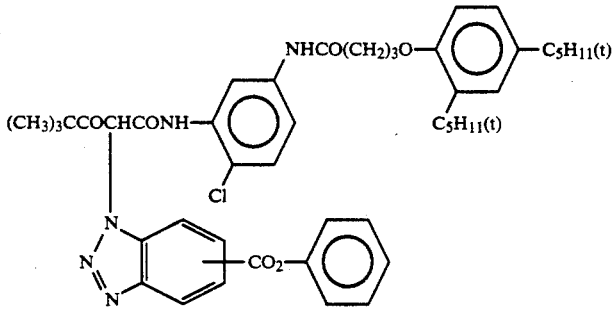
Cpd-1
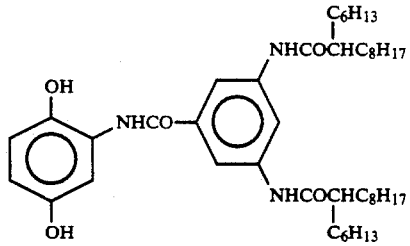
Cpd-2
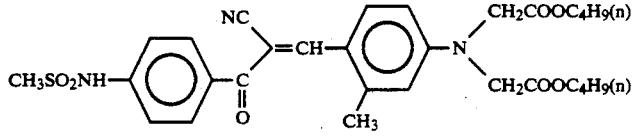
Cpd-3
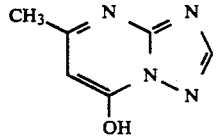

-continued

Cpd-4

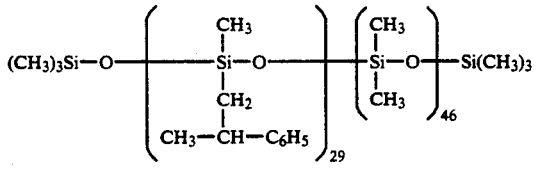

Cpd-5

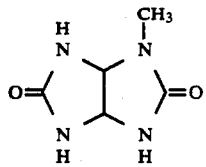

Cpd-6

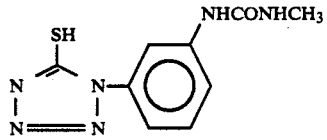

Cpd-7

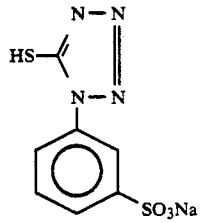

Cpd-8

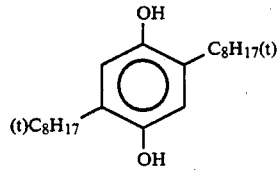

H-1

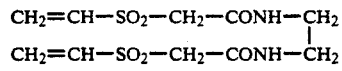

W-1

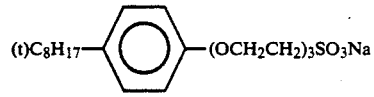

W-2

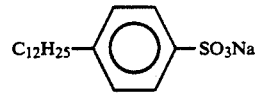

W-3

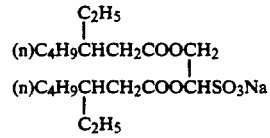

W-4

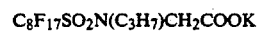

Preparation of Specimens 402 to 452

Specimens 402 to 452 were prepared in the same manner as Specimen 401 except that DIR compound ExY-9 in the 10th layer was replaced by the comparative compounds and the present compounds as set forth in Table 1 in amounts of $3\times10^{-4}$ mole/m$^2$, respectively. Specimens 401 to 452 thus obtained were then evaluated for interimage effect, edge effect, fogging during prolonged storage, etc. in the same manner as in Example 1. The processing was effected in the following manner.

These specimens exhibited results similar to that of Example 1.

| Step | Time | Temperature | Replenishment rate | Tank capacity |
|---|---|---|---|---|
| | Processing step | | | |
| Color development | 3 min. 15 sec. | 38° C. | 45 ml | 10 l |
| Bleach | 1 min. 00 sec. | 38° C. | 20 ml | 4 l |
| Blix | 3 min. 15 sec. | 38° C. | 30 ml | 8 l |
| Rinse (1) | 40 sec. | 35° C. | — | 4 l |
| Rinse (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*Determined per 35-mm width and 1-mm length

The rinse step was effected in a countercurrent process wherein the washing water flows backward.

The various processing solutions had the following compositions:

| | Tank Solution | Replenisher |
|---|---|---|
| Color developer | | |
| Diethylenetriamine-pentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-ethyl-N-(β-hydroxyethyl)-amino]aniline sulfate | 4.5 g | 5.5 g |
| Water to make | 1.0 l | 1.0 l |
| pH | 10.05 | 10.10 |
| Bleaching solution | | |
| Ferric ammonium ethylenediamine-tetraacetate dihydrate | 120.0 g | Same as left |
| Ethylenediaminetetraacetic acid | 10.0 g | " |
| Ammonium bromide | 100.0 g | " |
| Ammonium nitrate | 10.0 g | " |
| Bleach accelerator | 0.005 mol | " |

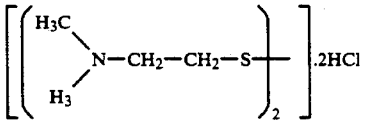

| | | |
|---|---|---|
| 27% Aqueous ammonia | 15.0 ml | " |
| Water to make | 1.0 l | " |
| pH | 6.3 | " |
| Blix solution (The tank solution was also used as replenisher) | | |
| Ferric ammonium ethylenediamine-tetraacetate dihydrate | 50.0 g | Same as left |
| Disodium ethylenediamine-tetraacetate | 5.0 g | " |
| Sodium sulfite | 12.0 g | " |
| 70% Aqueous solution of ammonium thiosulate | 240.0 ml | " |
| 27% Aqueous ammonia | 6.0 ml | " |
| Water to make | 1.0 l | " |
| pH | 7.2 | " |

Washing Solution (The tank solution was also used as replenisher)

Tap water was passed through a mixed bed column packed with an H-type strongly acidic cation exchange resin (Amberlite IR-120B available from Rohm & Haas) and an OH-tpe strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively.

The washing solution thus obtained had a pH value of 6.5 to 7.5.

| Stabilizing solution (The running solution was also used as replenisher) | |
|---|---|
| 37% Formalin | 2.0 ml |
| Polyoxyethylene-p-monononylphenylether (mean polymerization degree: 10) | 0.3 g |
| Disodium ethylenediaminetetraacetate | 0.05 |
| Water to make | 1.0 l |
| pH | 5.0–8.0 |

Furthermore, specimens obtained by incorporating these DIR compounds in the 1st layer, 2nd layer, 5th layer, 6th layer, and/or 9th layer instead of the 10th layer gave similar results.

p EXAMPLE 5

Preparation of Specimen 501

Preparation of Emulsion of Amorphous (thick twined crystal tablet) Silver Halide Grains An aqueous solution of silver nitrate and an aqueous solution of potassium bromide were added to a solution of 25 g of potassium bromide, 24 g of potassium iodide, 1.9 g of potassium thiocyanate and 24 g of gelatin in 1 l of water in a vessel at a temperature of 60° C. with vigorous stirring in an ordinary ammonia process by a double jet process. Finally, an emulsion of relatively amorphous thick tabular silver bromoiodide grains with an iodine content of 8 mol % and an average grain diameter of 1.0 μm was prepared. To this emulsion was added Dye (a) in an amount of 230 mg/mol Ag and phenoxy ethanol in an amount of 50,000 ppm based on gelatin. The emulsion was then subjected to chemical sensitization (after-ripening) with sodium thiosulfate and chloroauric acid to obtain a light-sensitive silver bromoiodide emulsion (B). A light sensitive silver bromoiodide emulsion (C) was prepared in the same manner as Emulsion (B) except that the content of potassium iodide in the starting solution was altered to 18 g and the temperature was altered to 40° C. The emulsion grains had an iodine content of 6 mol % and an average grain diameter of 0.6 μm.

Furthermore, Emulsion D was prepared in the same manner as Emulsion C except that the material was not subjected to chemical sensitization.

Dye (a)

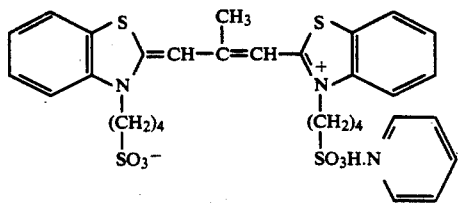

Preparation of Coated Specimen

Onto a double-undercoated polyethylene terephthalate support was coated various layers having the following compositions:

| | |
|---|---|
| (Back side) | |
| Lowermost layer | |
| Gelatin | 0.45 g/m$^2$ |
| Anionic polymer* | 0.37 g/m$^2$ |
| 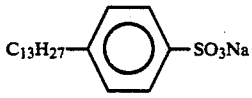 | 2 mg/m$^2$ |
| 2nd layer | |
| Gelatin | 5 g/m$^2$ |
| Anionic polymer* | 2.9 g/m$^2$ |
| Uppermost layer | |
| Gelatin | 1 g/m$^2$ |
| 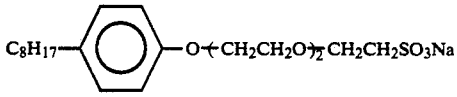 | 21 mg/m$^2$ |
| $C_8F_{17}SO_3K$ | 6 mg/m$^2$ |
| Polypotassium p-vinylbenzenesulfonate | 51 mg/m$^2$ |
| Finely divided polymethyl methacrylate (average grain diameter: 3 μm) | 35 mg/m$^2$ |
| * 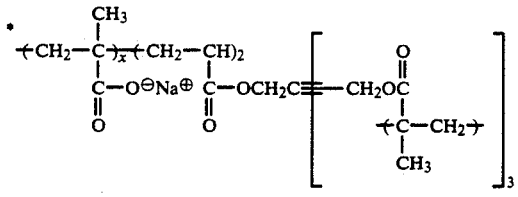 x:z = 80:20 (mol %) | |
| 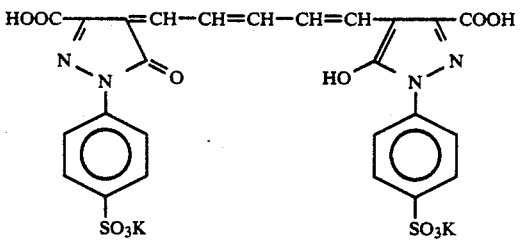 | 113 mg/m$^2$ |
| 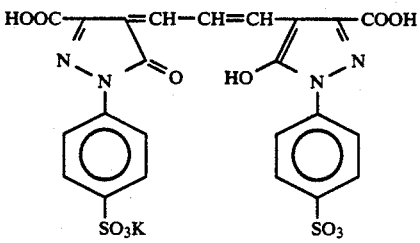 | 53 mg/m$^2$ |

-continued

| | |
|---|---|
| 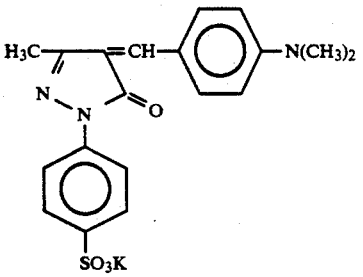 | 72 mg/m$^2$ |
| Bis-(vinylsulfonylacetamido)ethane | 470 mg/m$^2$ |
| (Emulsion layer) | |
| Lowermost layer | |
| Ag (Emulsion (D) was used) | 0.8 g/m$^2$ |
| Gelatin | 1.1 g/m$^2$ |
| Polyethylene oxide | 4 mg/m$^2$ |
| 4-Hydroxy-6-methyl-1,3,3a,7-tetrazaindene | 8.5 mg/m$^2$ |
| 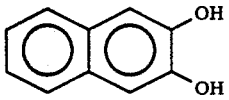 | 0.8 mg/m$^2$ |
| Polypotassium p-vinylbenzenesulfonate | 17 mg/m$^2$ |
| 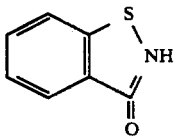 | 0.5 mg/m$^2$ |
| 2nd layer | |
| Ag (Emulsion (C) was used) | 1.4 g/m$^2$ |
| Gelatin | 2 g/m$^2$ |
| Polyethylene oxide | 7 mg/m$^2$ |
| 4-Hydroxy-6-methyl-1,3,3a,7-tetrazaindene | 15 mg/m$^2$ |
| 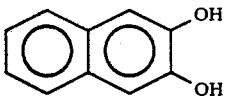 | 1.5 mg/m$^2$ |
| Polypotassium p-vinylbenzenesulfonate | 50 mg/m$^2$ |
| 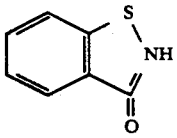 | 0.4 mg/m$^2$ |
| 3rd layer | |
| Ag (Emulsion (B) was used) | 4.5 g/m$^2$ |
| Gelatin | 8.3 g/m$^2$ |
| Polyethylene oxide | 55 mg/m$^2$ |
| 4-Hydroxy-6-methyl-1,3,3a,7-tetrazaindene | 45 mg/m$^2$ |
| $CH_3CH_2C(CH_2OH)_3$ | 210 mg/m$^2$ |
| Polypotassium p-vinylbenzenesulfonate | 63 mg/m$^2$ |
| Phenoxyethanol | 205 mg/m$^2$ |
| Uppermost layer | |
| Gelatin | 0.9 g/m$^2$ |
| 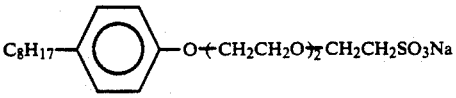 | 13 mg/m$^2$ |

-continued

| | |
|---|---|
| 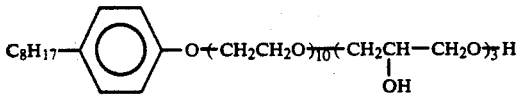 | 50 mg/m$^2$ |
| 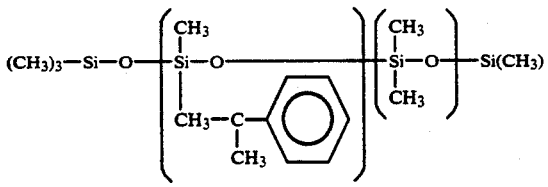 | 88 mg/m$^2$ |
| 4-Hydroxy-6-methyl-1,3,3a,7-tetrazaindene | 15 mg/m$^2$ |
| Finely divided polymethyl methacrylate grains (average grain diameter: 3 μm) | 24 mg/m$^2$ |
| Polypotassium p-vinylbenzenesulfonate | 6 mg/m$^2$ |
| Fluorine-containing surface active agent $C_8F_{17}SO_2NH(CH_2)_3OCH_2CH_2N^{\oplus}(CH_3)_3$ 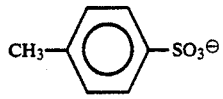 | |

Preparation of Specimens 502 to 552

Specimens 502 to 552 were prepared in the same manner as Specimen 501 except that the DIR compounds as set forth in Tables 1 to 3 in Examples 1 to 3 were incorporated in the 2nd and 3rd layers in amounts of $5\times10^{-4}$ mole per mole of silver contained in each layer, respectively.

These emulsions were dissolved in a mixture of tricresyl phosphate in the same amount and ethyl acetate in a 10-fold amount, and then subjected to dispersion in a homogenizer.

Specimens 501 to 552 thus obtained were then evaluated for edge effect in the same manner as in Example 1.

These specimens were processed at a temperature of 20° C. in a small tank in accordance with D-76 proessing method for 7 minutes.

The results show that the specimens comprising DIR compounds exhibit a high edge effect and, among them, the specimens comprising DIR compounds of the present invention particularly exhibit a high edge effect.

EXAMPLE 6

A color photographic light sensitive material was prepared by coating on a polyethylene double-laminated paper support the following 1st to 12th layers. The polyethylene contained 15 % by weight of an anatase type titanium oxide as a white pigment and a slight amount of ultramarine as a bluish dye on the 1st layer side.

Composition of Light-Sensitive Material

The coated amount of each component is represented in g/m$^2$, except that that of silver halide emulsion is represented as calculated in terms of amount of silver.

| | |
|---|---|
| 1st Layer: gelatin layer | |
| Gelatin | 1.30 |
| 2nd Layer: antihalation layer | |
| Black colloidal silver | 0.10 |
| Gelatin | 0.70 |

-continued

| | |
|---|---|
| 3rd Layer: low sensitivity red-sensitive layer | |
| Silver bromochloroiodide emulsion spectrally sensitized with red sensitizing dyes ExS-1, 2 and 3 (silver chloride content: 1 mol %; silver iodide content: 4 mol %; average grain size: 0.3 μm; grain size distribution: 10%; cubic iodine core type core/shell) | 0.06 |
| Silver bromoiodide emulsion spectrally sensitized with red sensitizing dyes ExS-1, 2 and 3 (silver iodide content: 4 mol %; average grain size: 0.5 μm; grain size distribution: 15%; cubic) | 0.10 |
| Gelatin | 1.00 |
| Cyan coupler ExC 1 | 0.14 |
| Cyan coupler ExC-2 | 0.07 |
| Color stain inhibitor (Cpd-2, 3, 4: equal amount) | 0.12 |
| Coupler dispersant Cpd-6 | 0.03 |
| Coupler solvent (Solv-1, 2, 3: equal amount) | 0.06 |
| Development inhibitor Cpd-13 | 0.05 |
| 4th Layer: high sensitivity red-sensitive layer | |
| Silver bromoiodide emulsion spectrally sensitized with red sensitizing dyes ExS-1, 2 and 3 (silver iodide content: 6 mol %; average grain size: 0.8 μm; grain size distribution: 20%; tabular grains (aspect ratio: 8; iodine core)) | 0.15 |
| Gelatin | 1.00 |
| Cyan coupler ExC-1 | 0.20 |
| Cyan coupler ExC-2 | 0.10 |
| Color stain inhibitor Cpd-2, 3 and 4: equal amount) | 0.15 |
| Coupler dispersant Cpd-6 | 0.03 |
| Coupler solvent (Solv-1, 2 and 3: equal amount) | 0.10 |
| 5th Layer: interlayer | |
| Magenta colloidal silver | 0.02 |
| Gelatin | 1.00 |
| Color stain inhibitor (Cpd-7, 16) | 0.08 |
| Color stain inhibiting solvent Solv-4, 5) | 0.16 |
| Polymer latex (Cpd-8) | 0.10 |
| DIR hydroquinone (Cpd-24) | 0.015 |

-continued

| | |
|---|---|
| 6th Layer: low sensitivity green-sensitive layer | |
| Silver bromochloroiodide emulsion spectrally sensitized with green sensitizing dyes ExS-3 and 4 (silver chloride content: 1 mol %; silver iodide content: 2.5 mol %; average grain size: 0.28 μm; grain size distribution: 8%; cubic iodine core type core/shell) | 0.04 |
| Silver bromoiodide emulsion spectrally sensitized with green sensitizing dyes ExS-3 and 4 (silver iodide content: 2.5 mol %; average grain size: 0.48 μm; grain size distribution: 12%; cubic grains) | 0.06 |
| Gelatin | 0.80 |
| Magenta coupler (ExM-1 and 2: equal amount) | 0.10 |
| Color stain inhibitor Cpd-9 | 0.10 |
| Stain inhibitor (Cpd-10 and 11: equal amount) | 0.01 |
| Stain inhibitor Cpd-5 | 0.001 |
| Stain inhibitor Cpd-12 | 0.01 |
| Coupler dispersant Cpd-6 | 0.05 |
| Coupler solvent (Solv-4 and 6) | 0.15 |
| DIR hydroguinone Cpd-24 | 0.015 |
| 7th Layer: high sensitivity green-sensitive layer | |
| Silver bromoiodide emulsion spectrally sensitized with green sensitizing dyes ExS-3 and 4 (silver iodide content: 3.5 mol %; average grain size: 1.0 μm; grain size distributin: 21%; tabular (aspect ratio = 9; uniform iodine type)) | 0.10 |
| Gelatin | 0.80 |
| Magenta coupler (ExM-1 and 2: equal amount) | 0.10 |
| Color stain inhibitor Cpd-9 | 0.10 |
| Stain inhibitor (Cpd-10, 11 and 22: equal amount) | 0.01 |
| Stain inhibitor Cpd 5 | 0.001 |
| Stain inhibitor Cpd-12 | 0.01 |
| Coupler dispersant Cpd-6 | 0.05 |
| Coupler solvent (Solv 4, 6) | 0.15 |
| 8th Layer: yellow filter layer | |
| Yellow colloidal silver. | 0.20 |
| Gelatin | 1.00 |
| Color stain inhibitor (Cpd-7) | 0.06 |
| Color stain inhibiting solvent (Solv-4 and 5) | 0.15 |
| Polymer latex (Cpd-8) | 0.10 |
| 9th Layer: low sensitivity blue-sensitive layer | |
| Silver bromochloroiodide emulsion spectrally sensitized with blue sensitizing dyes ExS-5 and 6 (silver chloride content: 2 mol %; silver iodide content: 2.5 mol %; average grain size: 0.38 μm: grain size distribution: 8%; cubic iodine core type core/shell) | 0.07 |
| Silver bromoiodide emulsion spectrally sensitized with blue sensitizing dyes ExS-5 and 6 (silver iodide content: 2.5 mol %; average grain size: 0.55 μm: grain size distribution: 11%; cubic) | 0.10 |
| Gelatin | 0.50 |
| Yellow coupler (ExY-1 and 2: equal amount) | 0.20 |
| Stain inhibitor (Cpd-5) | 0.001 |
| Color stain inhibitor (Cpd-14) | 0.10 |
| Coupler dispersant (Cpd-6) | 0.05 |
| Coupler solvent (Solv-2) | 0.05 |
| 10th Layer: high sensitivity blue-sensitive layer | |
| Silver bromoiodide emulsion spectrally sensitized with blue sensitizing dyes ExS-5 and 6 (silver iodide content: 2.5 mol %; average grain size: 1.4 μm; grain size distribution: 21%; tablet (aspect ratio = 14)) | 0.25 |
| Gelatin | 1.00 |
| Yellow coupler (ExY-1 and 2: equal amount) | 0.40 |
| Stain inhibitor (Cpd-5) | 0.002 |
| Color stain inhibitor (Cpd-14) | 0.10 |
| Coupler dispersant (Cpd-6) | 0.15 |
| Coupler solvent (Solv-2) | 0.10 |
| 11th Layer: ultraviolet-absorbing layer | |
| Gelatin | 1.50 |
| Ultraviolet absorbent (Cpd-1, 2, 4, and 15: equal amount) | 1.00 |
| Color stain inhibitor (Cpd-7 and 16) | 0.06 |
| Dispersant (Cpd-6) | |
| Ultraviolet absorbent solvent (Solv-1 and 2) | 0.15 |
| Anti-irradiation dye (Cpd-17 and 18) | 0.02 |
| Anti-irradiation dye (Cpd-19 and 20) | 0.02 |
| 12th Layer: protective layer | |
| Finely divided silver bromochloride grains (silver chloride content: 97 mol %; average grain size: 0.2 μm) | 0.07 |
| Modified POVAL | 0.02 |
| Gelatin | 1.50 |
| Gelatin hardener (H-1 and 2: equal amount) | 0.17 |

In addition to the above mentioned components, there were added to each of these layers Alkanol XC (available from Dupont) and sodium alkylbenzenesulfonate as emulsion dispersion aids and ester succinate and Magefac F-120 (available from Dainippon Ink And Chemicals, Incorporated) as coating aids. Cpd-21, 22 and 23 were incorporated in the silver halide or colloidal silver-containing layers as stabilizers. The compounds used in the present example will be set forth hereinafter.

ExS-1

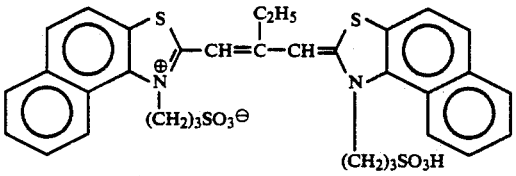

ExS-2

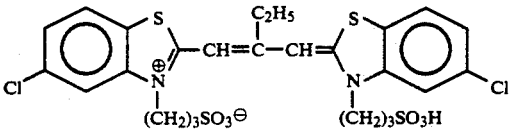

-continued
ExS-3
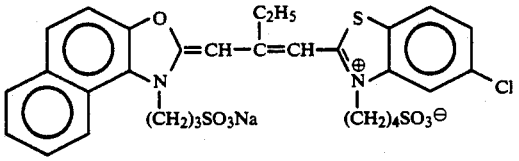
ExS-4
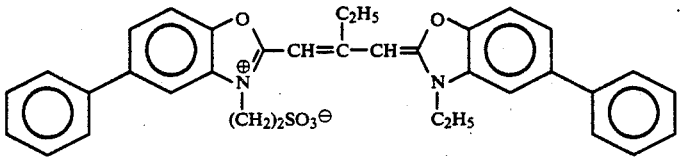
ExS-5
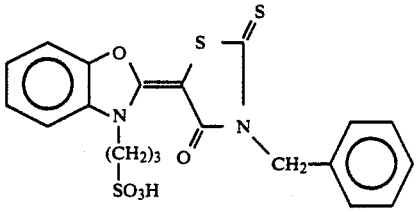
ExS-6
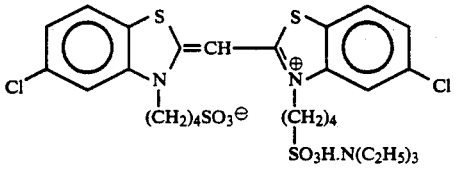
Cpd-1
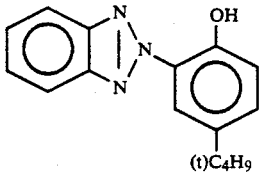
Cpd-2
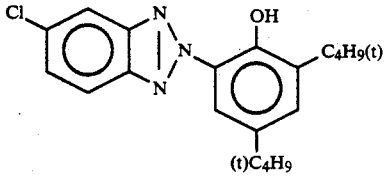
Cpd-3
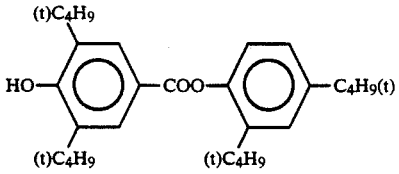
Cpd-4
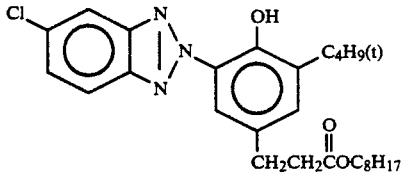
Cpd-5
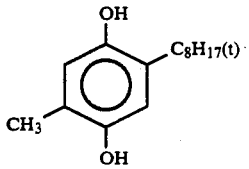
Cpd-6
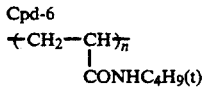
(n = 100~1000)
Cpd-7
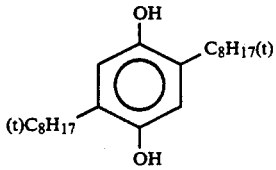
Cpd-8
Polyethyl acrylate (MW = 10,000~100,000)

-continued
Cpd-9
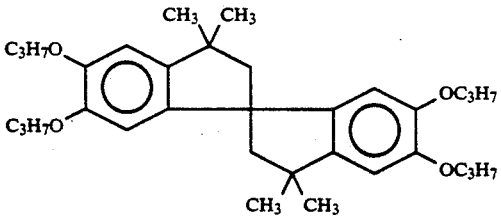
Cpd-10
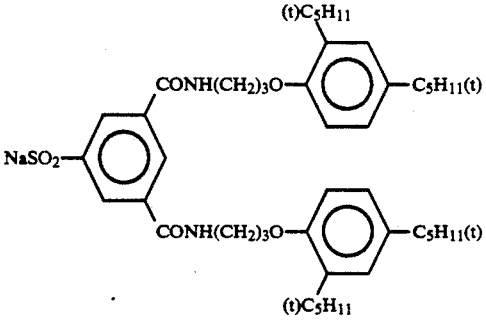
Cpd-11
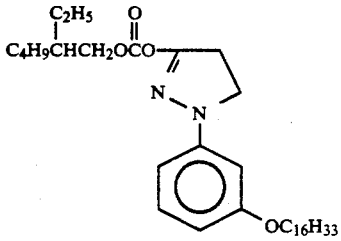
Cpd-12
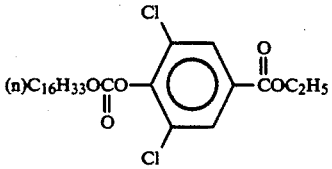
Cpd-13
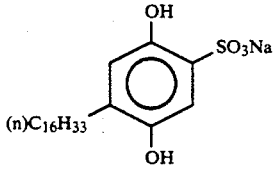
Cpd-14
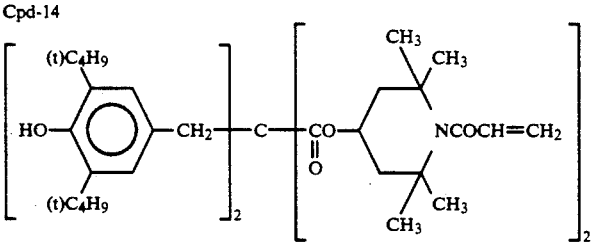
Cpd-15
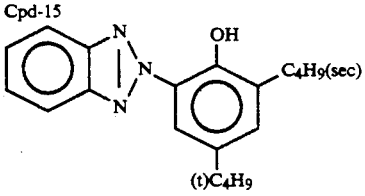
Cpd-16
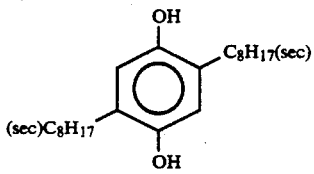
Cpd-17
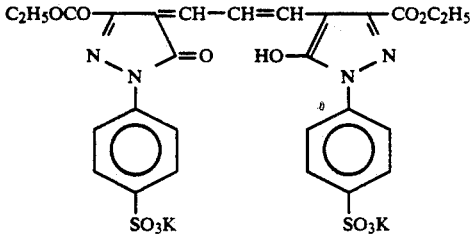
Cpd-18
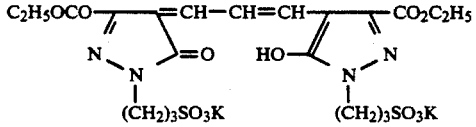

-continued
Cpd-19
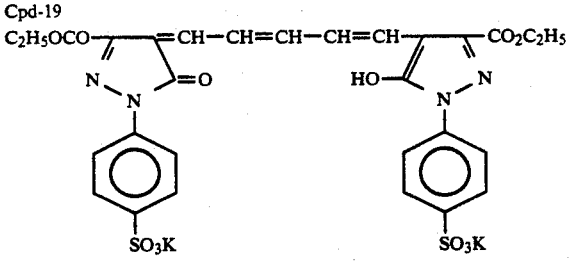
Cpd-20
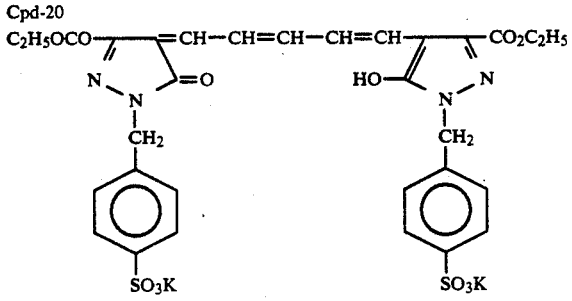
Cpd-21
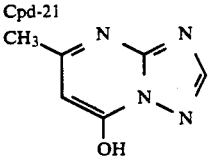
Cpd-22
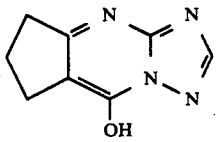
Cpd-23
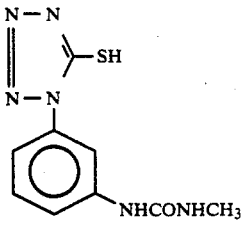
Cpd-24
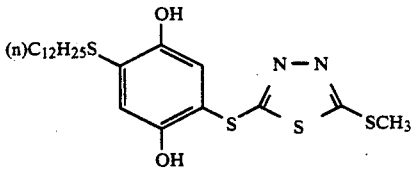
ExC-1
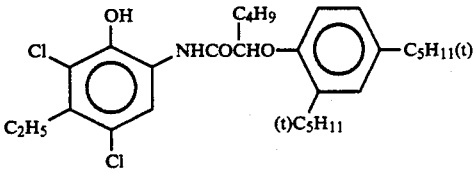
ExC-2
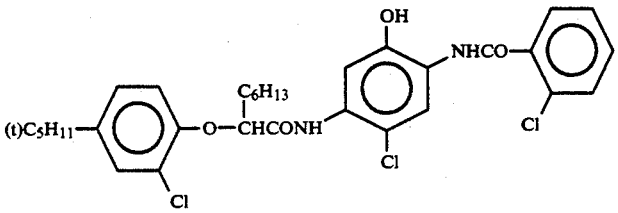

-continued

ExM-1

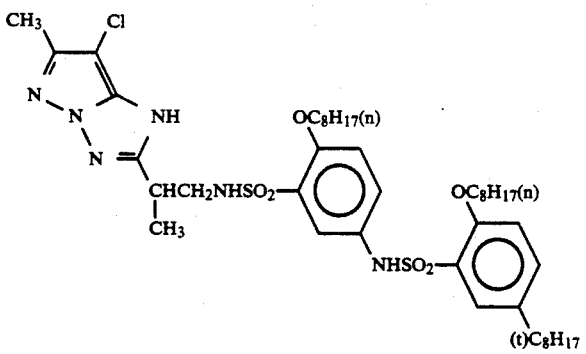

ExM-2

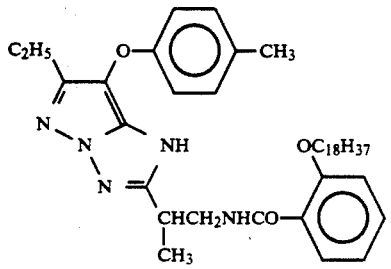

ExY-1

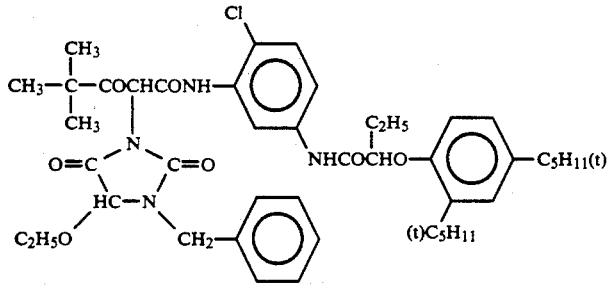

ExY-2

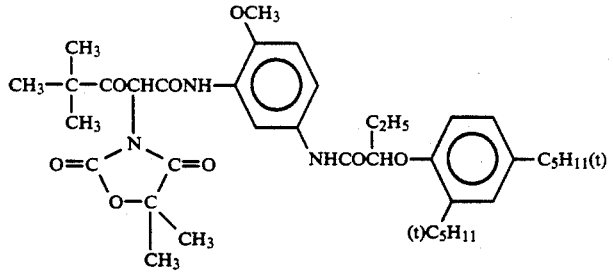

| | | | |
|---|---|---|---|
| Solv-1: | Di(2-ethylhexyl) phthalate | Solv-2: | Trinonyl phosphate |
| Solv-3: | Di(3-methylhexyl) phthalate | Solv-4: | Tricresyl phosphate |
| Solv-5: | Dibutyl phthalate | Solv-6: | Trioctyl phosphate |

H-1

$CH_2{=}CH{-}SO_2{-}CH_2{-}CONH{-}CH_2$ $CH_2{=}CH{-}SO_2{-}CH_2{-}CONH{-}CH_2$

H-2

Sodium salt of 2,4-Dichloro-6-hydroxy-1,3,5-triazine

| Processing step | | |
|---|---|---|
| 1st Development (black-and-white development) | 38° C. | 75 sec. |
| Rinse | 38° C. | 90 sec. |
| Reverse exposure | 100 lux or more | 60 sec. or more |

-continued

| | | |
|---|---|---|
| Color development | 38° C. | 135 sec. |
| Rinse | 38° C. | 45 sec. |
| Blix | 38° C. | 120 sec. |
| Rinse | 38° C. | 135 sec. |

-continued

| | | |
|---|---|---|
| Drying | 75° C. | 45 sec. |
| Composition of processing solutions | | |
| (1st Developer) | | |
| Pentasodium nitrilo-N,N,N-trimethylenephosphonate | 0.6 g | |
| Pentasodium diethylenetriaminepentaacetate | 4.0 g | |
| Potassium sulfite | 30.0 g | |
| Potassium thiocyanate | 1.2 g | |
| Potassium carbonate | 35.0 g | |
| Potassium hydroquinonemonosulfonate | 25.0 g | |
| Diethylene glycol | 15.0 ml | |
| 1-Phenyl-4-hydroxymethyl-4-methyl-3-pyrazolidone | 2.0 g | |
| Potassium bromide | 0.5 g | |
| Potassium iodide | 5.0 mg | |
| Water to make | 1 l | |
| pH | 9.70 | |
| (Color developer) | | |
| Benzyl alcohol | 15.0 ml | |
| Diethylene glycol | 12.0 ml | |
| 3,6-Dithia-1,8-octanediol | 0.2 g | |
| Pentasodium nitrilo-N,N,N-trimethylenephosphonate | 0.5 g | |
| Pentasodium diethylenetriamine-pentaacetate | 2.0 g | |
| Sodium sulfite | 2.0 g | |
| Potassium carbonate | 25.0 g | |
| Hydroxylamine sulfate | 3.0 g | |
| N-ethyl-N-(β-methanesulfonamidoethyl)-3-methyl-4-aminoaniline sulfate | 5.0 g | |
| Potassium bromide | 0.5 g | |
| Poatssium iodide | 1.0 mg | |
| Water to make | 1 l | |
| pH | 10.40 | |
| (Blix solution) | | |
| 2-Mercapto-1,3,4-triazole | 1.0 g | |
| Disodium ethylenediaminetetraacetate dihydrate | 5.0 g | |
| Ferric ammonium ethylenediaminetetraacetate monohydrate | 80.0 g | |
| Sodium sulfite | 15.0 g | |
| Sodium thiosulfate (700 g/l) | 160.0 ml | |
| Glacial acetic acid | 5.0 ml | |
| Water to make | 1 l | |
| pH | 6.50 | |

Thus, Specimen 601 was prepared. Furthermore, Specimens 602 to 610 were prepared in the same manner as Specimen 601 except that Cpd-24 in the 5th and 6th layers was replaced by Comparative Compounds A, B and C, and Present Compounds I-(1), I-(2), I-(3), I-(4), I-(31) and I-(32) in equimolecular amounts, respectively, as shown in Table 4.

Onto these specimens was printed a pattern for the measurement of sharpness from a light source having a color temperature of 3,200° K. Furthermore, onto these specimens was printed a reversal film (RTP available from Fuji Photo Film Co., Ltd.) on which a Macbeth color chart had been photographed. These exposed specimens were then processed in accordance with the above-described steps.

The sharpness was determined by the MTF value. On the other hand, the green color saturation of the Macbeth color chart was determined by means of a color computer in the Munsell system. The results are set forth in Table 4.

Table 4 shows that the use of the present compounds provides improvements in sharpness and saturation.

TABLE 4

| Specimen No. | Compound contained in 5th and 6th layers | Sharpness 10 cycle/mm | Green color (original:9.65) |
|---|---|---|---|
| 601 (comparative) | Cpd-24 | 0.85 | 7.88 |
| 602 (comparative) | Comparative Compound A | 0.84 | 7.99 |
| 603 (comparative) | Comparative Compound B | 0.83 | 8.01 |
| 604 (comparative) | Comparative Compound C | 0.83 | 8.03 |
| 605 (present invention) | I-(1) | 0.94 | 9.53 |
| 606 (present invention) | I-(2) | 0.95 | 9.51 |
| 607 (present invention) | I-(3) | 0.90 | 9.22 |
| 608 (present invention) | I-(4) | 0.92 | 9.18 |
| 609 (present invention) | I-(31) | 0.96 | 9.63 |
| 610 (present invention) | I-(32) | 0.96 | 9.62 |

EXAMPLE 7

Specimens 702 to 709 were prepared in the same manner as Specimen 601 in Example 6 except that Cpd-4 in the 5th and 6th layers was replaced by Comparative Compounds A and B, and Present Compounds II-(1), II-(2), II-3), II-(23), II-(26) and II-(27) as used in Example 2 in equimolecular amounts, respectively, as shown in Table 5. These specimens were then processed in the same manner as in Example 6. The results are set forth in Table 5. Table 5 shows that the use of the present compounds provides improvements in sharpness and saturation.

TABLE 5

| Specimen No. | Compound contained in 5th and 6th layers | Sharpness 10 cycle/mm | Green saturation (original: 9.65) |
|---|---|---|---|
| 601 (comparative) | Cpd-24 | 0.84 | 7.86 |
| 702 (comparative) | Comparative Compound A | 0.83 | 7.85 |
| 703 (comparative) | Comparative Compound B | 0.85 | 7.98 |
| 704 (present invention) | II-(1) | 0.96 | 9.28 |
| 705 (present invention) | II-(2) | 0.95 | 9.31 |
| 706 (present invention) | II-(3) | 0.93 | 9.32 |
| 707 (present invention) | II-(23) | 0.97 | 9.45 |
| 708 (present invention) | II-(26) | 0.98 | 9.47 |
| 709 (present invention) | II-(27) | 0.97 | 9.44 |

EXAMPLE 8

Specimens 802 to 810 were prepared in the same manner as Specimen 601 in Example 6 except that Cpd 4 in the 5th and 6th layers was replaced by Comparative Compounds A, B, and C and Present Compounds III-(1), III-(2), III-(3), III-(4), III-(27) and III-(30) as used in Example 3 in equimolecular amounts, respectively, as shown in Table 6. These specimens were then processed in the same manner as in Example 6. The results are set forth in Table 6. Table 6 shows that the use of the present compounds provides improvements in sharpness and saturation.

TABLE 6

| Specimen No. | Compound contained in 5th and 6th layers | Sharpness 10 cycle/mm | Green saturation (original: 9.65) |
|---|---|---|---|
| 601 (comparative) | Cpd-24 | 0.85 | 7.87 |
| 802 (comparative) | Comparative Compound A | 0.85 | 8.10 |
| 803 (comparative) | Comparative Compound B | 0.83 | 8.22 |
| 804 (comparative) | Comparative Compound C | 0.82 | 8.51 |
| 805 (present invention) | III-(1) | 0.92 | 9.59 |
| 806 (present invention) | III-(2) | 0.94 | 9.60 |
| 807 (present invention) | III-(3) | 0.93 | 9.58 |
| 808 (present invention) | III-(4) | 0.92 | 9.61 |
| 809 (present invention) | III-(27) | 0.96 | 9.59 |
| 810 (present invention) | III-(30) | 0.95 | 9.60 |

EXAMPLE 9

Specimens as prepared in Examples 1, 2 and 3 were exposed to light in the same manner as in Example 1, and then subjected to the following development A instead of development as effected in Example 1.

Development A

| Step | Time | Temp. | Tank capacity | Replenishment rate |
|---|---|---|---|---|
| Black-and-white development | 6 min. | 38° C. | 12 l | 2.2 l/m$^2$ |
| 1st rinse | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.2 l/m$^2$ |
| Adjustment | 2 min. | 38° C. | 4 l | 1.1 l/m$^2$ |
| Blix | 6 min. | 38° C. | 12 l | 1.3 l/m$^2$ |
| 2nd rinse (1) | 2 min. | 38° C. | 4 l | — |
| 2nd rinse (2) | 2 min. | 38° C. | 4 l | 7.5 l/m$^2$ |
| Stabilization | 2 min. | 38° C. | 4 l | 1.1 l/m$^2$ |
| 3rd rinse | 1 min. | 38° C. | 4 l | 7.5 l/m$^2$ |

The 2nd rinse was effected in a countercurrent process wherein the rinsing water flows backward.

The various processing solutions had the following compositions:

Black-and-white developer

| | Tank solution | Replenisher |
|---|---|---|
| Pentasodium nitrilo-N,N,N-trimethylenephosphonate | 2.0 g | 2.0 g |
| Pentasodium diethylenetriaminepentaacetate | 3.0 g | 3.0 g |
| Potassium sulfite | 30.0 g | 30.0 g |
| Hydroquinone potassium monosulfonate | 20.0 g | 20.0 g |
| Potassium carbonate | 33.0 g | 33.0 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |
| Potassium iodide | 2.0 mg | 2.0 mg |
| Water to make | 1.0 l | 1.0 l |
| pH (25° C.) | 9.60 | 9.70 |

The pH value was adjusted with hydrochloric acid or potassium hydroxide.

Reversing solution

| | Tank solution | Relenisher |
|---|---|---|
| Pentasodium nitrilo-N,N,N-trimethylenephosphonate | 3.0 g | Same as left |
| Stannous chloride dihydrate | 1.0 g | " |
| p-Aminophenol | 0.1 g | " |
| Sodium hydroxide | 8.0 g | " |
| Glacial acetic acid | 15.0 ml | " |
| Water to make | 1.0 l | |
| pH (25° C.) | 6.00 | " |

The pH value was adjusted with hydrochloric acid or sodium hydroxide.

Color developer

| | Tank solution | Replenisher |
|---|---|---|
| Pentasodium nitrilo-N,N,N-trimethylenephosphonate | 2.0 g | 2.0 g |
| Pentasodium diethylenetriaminepentaacetate | 2.0 g | 2.0 g |
| Sodium sulfite | 7.0 g | 7.0 g |
| Trisodium phosphate dodecahydrate | 36.0 g | 36.0 g |
| Potassium bromide | 1.0 g | — |
| Potassium iodide | 90.0 mg | — |
| Sodium hydroxide | 3.0 g | 3.0 g |
| Citrazinic acid | 1.5 g | 1.5 g |
| N-ethyl-(β-methanesulfonamidoethyl)-3-methyl-4-aminoaniline sulfate | 10.5 g | 10.5 g |
| 3,6-Dithiaoctane-1,8-diol | 3.5 g | 3.5 g |
| Water to make | 1.0 l | 1.0 l |
| pH (25° C.) | 11.90 | 12.05 |

The pH value was adjusted with hydrochloric acid or potassium hydroxide.

Adjusting solution

| | Tank solution | Replenisher |
|---|---|---|
| Disodium ethylenediaminetetraacetate dihydrate | 8.0 g | Same as left |
| Sodium sulfite | 12.0 g | " |
| 2-Mercapto-1,3,4-triazole | 0.5 g | " |
| TWEEN 20# | 2.0 ml | " |

-continued

| Adjusting solution | Tank solution | Replenisher |
|---|---|---|
| Water to make | 1.0 l | " |
| pH (25° C.) | 6.20 | " |

The pH value was adjusted with hydrochloric acid or sodium hydroxide.

TWEEN 20#: Surface active agent available from ICI American Inc.

| Blix solution | Tank solution | Replenisher |
|---|---|---|
| 1,3-Diaminopropane-tetraacetic acid | 2.0 g | Same as left |
| Ferric ammonium 1,3-diaminopropanetetraacetate monohydrate | 70.0 g | " |
| Ammonium thiosulfate (700 g/l) | 200.0 g | " |
| Ammonium sulfite | 20.0 g | " |
| Water to make | 1.0 l | " |
| pH (25° C.) | 6.60 | " |

The pH value was adjusted with acetic acid or aqueous ammonia.

| Stabilizing solution | Tank solution | Replenisher |
|---|---|---|
| Disodium ethylenediamine-tetraacetate dihydrate | 1.0 g | Same as left |
| Imidazole | 1.0 g | " |
| Dimethylol urea | 8.0 g | " |
| Water to make | 1.0 l | " |
| pH (25° C.) | 7.50 | " |

The pH value was adjusted with acetic acid or aqueous ammonia.

The results show that the specimen also exhibits effects similar to that of Examples 1, 2 and 3 when subjected to the above-mentioned development A.

EXAMPLE 10

Specimens as prepared in Examples 1, 2 and 3 were exposed to light in the same manner as in Example 1, and then subjected to development B, C and D.

| Development B | | | | |
|---|---|---|---|---|
| Step | Time | Temp. | Tank capacity | Replenishment rate |
| Black-and-white development | 6 min. | 38° C. | 12 l | 2.2 l/m$^2$ |
| 1st rinse | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.2 l/m$^2$ |
| Bleach | 3 min. | 38° C. | 6 l | 0.15 l/m$^2$ |
| Fixing | 4 min. | 38° C. | 8 l | 2.2 l/m$^2$ |
| 2nd rinse (1) | 2 min. | 38° C. | 4 l | — |
| 2nd rinse (2) | 2 min. | 38° C. | 4 l | 7.5 l/m$^2$ |
| Stabilization | 2 min. | 38° C. | 4 l | 1.1 l/m$^2$ |
| 3rd rinse | 1 min. | 38° C. | 4 l | 1.1 l/m$^2$ |

The 2nd rinse was effected in a countercurrent process wherein the rinsing water flows backward.

The black-and-white developer and the color developer had the same compositions as used in Development A in Example 9.

| Bleaching solution | Tank solution | Replenisher |
|---|---|---|
| 1,3-Diaminopropane-tetraacetic acid | 2.8 g | 4.0 g |
| Ferric ammonium 1,3-diaminopropanetetraacetate monohydrate | 138.0 g | 207.0 g |
| Ammonium bromide | 80.0 g | 120.0 g |
| Ammonium nitrate | 20.0 g | 30.0 g |
| Hydroxyacetic acid | 50.0 g | 75.0 g |
| Acetic acid | 50.0 g | 75.0 g |
| Water to make | 1.0 l | 1.0 l |
| pH (25° C.) | 3.40 | 2.80 |

The pH value was adjusted with acetic acid or aqueous ammonia.

| Fixing solution | Tank solution | Replenisher |
|---|---|---|
| Disodium ethylenediamine-tetraacetate dihydrate | 1.7 g | Same as left |
| Sodium benzaldehyde-o-sulfonate | 20.0 g | " |
| Sodium bisulfite | 15.0 g | " |
| Ammonium thiosulfate (700 g/l) | 340.0 ml | " |
| Imidazole | 28.0 g | " |
| Water to make | 1.0 l | " |
| pH (25° C.) | 4.00 | " |

The pH value was adjusted with acetic acid or aqueous ammonia.

| Stabilizing solution | Tank solution | Replenisher |
|---|---|---|
| Disodium ethylenediamine-tetraacetate dihydrate | 1.0 g | Same as left |
| Sodium carbonate | 6.0 g | " |
| Dimethylol urea | 8.0 g | " |
| Water to make | 1.0 l | " |
| pH (25° C.) | 10.00 | " |

The pH value was adjusted with acetic acid or aqueous ammonia.

| 3rd Rinsing solution | Tank solution | Replenisher |
|---|---|---|
| Disodium ethylenediamine-tetraacetate dihydrate | 0.2 g | Same as left |
| Hydroxyethylidene-1,1-diphosphonic acid | 0.05 g | " |
| Ammonium acetate | 2.0 g | " |
| Sodium dodecylbenzene-sulfonate | 0.3 g | " |
| pH (25° C.) | 4.50 | " |

The ph value was adjusted acetic acid or aqueous ammonia.

| Development C | | | | |
|---|---|---|---|---|
| Step | Time | Temp. | Tank capacity | Replenishment rate |
| Black-and-white development | 6 min. | 38° C. | 12 l | 2.2 l/m$^2$ |
| 1st rinse | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.2 l/m$^2$ |
| Stop | 2 min. | 38° C. | 4 l | 1.1 l/m$^2$ |
| Blix | 4 min. | 38° C. | 8 l | 1.3 l/m$^2$ |
| Stabilization (1) | 2 min. | 38° C. | 4 l | — |
| Stabilization (2) | 2 min. | 38° C. | 4 l | — |
| Stabilization (3) | 2 min. | 38° C. | 4 l | 1.1 l/m$^2$ |

The stabilization step was effected in a countercurrent process wherein the stabilizing solution flows backward.

The various processing solutions had the following compositions.

The black-and-white developer and the color developer had the same compositions as used in Development A in Example 9.

| Stopping solution | | |
|---|---|---|
| | Tank solution | Replenisher |
| Acetic acid | 30.0 g | Same as left |
| Sodium hydroxide | 1.65 g | " |
| pH (25° C.) | 3.20 | " |

The pH value was adjusted with acetic acid or sodium hydroxide.

| Blix solution | | |
|---|---|---|
| | Tank solution | Replenisher |
| 1,3-Diaminopropane-tetraacetic acid | 2.8 g | Same as left |
| Ferric ammonium 1,3-diaminopropanetetraacetate monohydrate | 144.0 g | " |
| Ammonium thiosulfate (700 g/l) | 200.0 g | " |
| Ammonium bisulfite | 21.0 g | " |
| Sodium benzaldehyde-o-sulfonate | 42.0 g | " |
| Imidazole | 28.0 g | " |
| pH (25° C.) | 6.80 | " |

The pH value was adjusted with acetic acid or aqueous ammonia.

| Stabilizing solution | | |
|---|---|---|
| | Tank solution | Replenisher |
| Disodium ethylenediamine-tetraacetate dihydrate | 0.5 g | Same as left |
| Hydroxyethylidene-1,1-diphosphonic acid | 0.05 g | " |
| Imidazole | 1.0 g | " |
| Dimethylol urea | 8.0 g | " |
| Sodium p-toluenesulfonate | 1.0 g | " |
| Sodium dodecylbenzene sulfonate | 0.3 g | " |
| Water to make | 1.0 l | " |
| pH (25° C.) | 7.50 | " |

The pH value was adjusted with acetic acid or aqueous ammonia.

| Development D | | | | |
|---|---|---|---|---|
| Step | Time | Temp. | Tank capacity | Replenishment rate |
| Black-and-white development | 6 min. | 38° C. | 12 l | 2.2 l/m$^2$ |
| 1st rinse | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.2 l/m$^2$ |
| Blix | 8 min. | 38° C. | 16 l | 1.3 l/m$^2$ |
| Stabilization (1) | 2 min. | 38° C. | 4 l | — |
| Stabilization (2) | 2 min. | 38° C. | 4 l | — |
| Stabilization (3) | 2 min. | 38° C. | 4 l | 1.1 l/m$^2$ |

The stabilization step was effected in a countercurrent process wherein the stabilizing solution flows backward.

The various processing solutions had the following compositions.

The black-and-white developer and the color developer had the same compositions as used in Development A in Example 9.

| Stabilizing solution | | |
|---|---|---|
| | Tank solution | Replenisher |
| Disodium ethylenediamine-tetraacetate dihydrate | 0.5 g | Same as left |
| Imidazole | 1.0 g | " |
| Dimethylol urea | 8.0 g | " |
| Sodium p-toluenesulfonate | 1.0 g | " |
| Sodium dodecylbenzene-sulfonate | 0.3 g | " |
| Water to make | 1.0 l | " |
| pH (25° C.) | 7.50 | " |

The pH value was adjusted with acetic acid or aqueous ammonia.

The results show that the specimen also exhibits effects similar to that of Example 9 when subjected to the above mentioned Development B, C and D instead of Development A in Example 9.

The results in Example 1 and 10 show that the use of the present compounds provides a high color stain inhibiting effect and an excellent storage stability. The results also show that these effects become remarkable particularly when the pH value of the color developer is high.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support at least one silver halide emulsion layer containing at least one of the compounds represented by formula (IB):

(IB)

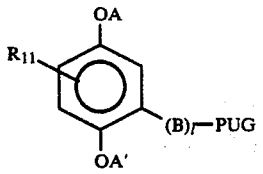

wherein $R_{11}$ represents

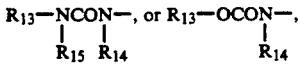

in which $R_{13}$ represents an alkyl, aryl or heterocyclic group, $R_{14}$ represents hydrogen; and $R_{15}$ each represents hydrogen, an alkyl group or an aryl group; B represents a timing group which releases PUG after being separated from a hydroquinone nucleus; PUG represents a development inhibitor; l represents an integer; and A and A' each represents a hydrogen atom or a group capable of being removed by an alkali; $R_{11}$ and A or A' may together form a ring.

2. The silver halide photographic material as claimed in claim 1, wherein $R_{13}$ and $R_{15}$ each represents an $C_{1-30}$ alkyl group or an $C_{6-30}$ aryl group.

3. The silver halide photographic material as claimed in claim 1, wherein l represents an integer of 0 to 2.

4. The silver halide photographic material as claimed in claim 1, wherein A and A' are each a hydrogen atom.

5. The silver halide photographic material as claimed in claim 4, wherein $R_{11}$ is represented by

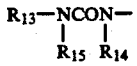

wherein $R_{13}$, $R_{14}$ and $R_{15}$ are as defined above.

6. The silver halide photographic material as claimed in claim 4, wherein $R_{11}$ is represented by

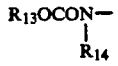

wherein $R_{13}$ and $R_{14}$ are as defined above.

7. The silver halide photographic material as claimed in claim 4, wherein PUG is a triazolylthio group, an oxadiazolylthio or a thiadiazolylthio group.

* * * * *